US006610454B2

(12) United States Patent
Hashimoto et al.

(10) Patent No.: US 6,610,454 B2
(45) **Date of Patent: *Aug. 26, 2003**

(54) TONER AND IMAGE FORMING METHOD

(75) Inventors: Akira Hashimoto, Numazu (JP); Tsutomu Kukimoto, Yokohama (JP); Manabu Ohno, Numazu (JP); Tsuyoshi Takiguchi, Shizuoka-ken (JP); Yasukazu Ayaki, Numazu (JP); Satoshi Handa, Shizuoka-ken (JP); Masanori Ito, Numazu (JP); Keiji Komoto, Numazu (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/146,356

(22) Filed: Sep. 3, 1998

(65) Prior Publication Data

US 2002/0022188 A1 Feb. 21, 2002

(30) Foreign Application Priority Data

| | | |
|---|---|---|
| Sep. 5, 1997 | (JP) | 9-241134 |
| Sep. 5, 1997 | (JP) | 9-241135 |
| Jun. 30, 1998 | (JP) | 10-183457 |

(51) Int. Cl.[7] ..... G03G 9/087; G03G 13/16

(52) U.S. Cl. ..... 430/109.2; 430/109.1; 430/109.3; 430/109.4; 430/110.2; 430/110.3; 430/124; 430/125; 430/126

(58) Field of Search ..... 430/109, 110, 430/111, 109.1, 110.2, 110.3, 109.2, 109.3, 109.4, 124, 126, 125; 399/260, 264, 308, 350, 343, 314, 310

(56) References Cited

U.S. PATENT DOCUMENTS

| | | | | | |
|---|---|---|---|---|---|
| 2,297,691 | A | | 10/1942 | Carlson | 95/5 |
| 4,457,998 | A | | 7/1984 | Gruber et al. | 430/98 |
| 4,645,727 | A | * | 2/1987 | Ong et al. | 430/109 |
| 4,954,412 | A | * | 9/1990 | Breton et al. | 430/110.2 |
| 5,187,526 | A | | 2/1993 | Zaretsky | 355/273 |
| 5,605,778 | A | * | 2/1997 | Onuma et al. | 430/110 |
| 5,698,354 | A | * | 12/1997 | Ugai et al. | 430/111 |

FOREIGN PATENT DOCUMENTS

| | | |
|---|---|---|
| JP | 10231 | 7/1961 |
| JP | 24748 | 10/1967 |
| JP | 23910 | 11/1967 |

(List continued on next page.)

OTHER PUBLICATIONS

Diamond, Arthur S. (Editor) Handbook of Imaging Materials. New York: Marcel–Dekker, Inc. pp. 170, 171, 178, 179, 1991.*

Schaffert, R. M. Electrophotography. New York: John Wliey & Sons. pp. 557–562, 1975.*

Database WPI, Section Ch, Week 8111, Derwent Publ., XP002086708 for JP 56–005559.

(List continued on next page.)

*Primary Examiner*—Christopher Rodee

(74) *Attorney, Agent, or Firm*—Fitzpatrick, Cella, Harper & Scinto

(57) ABSTRACT

A toner is comprised of a binder resin, a colorant and a wax. The binder resin has a polycarbonate resin in an amount of from 0.1% by weight to 50.0% by weight and a resin other than the polycarbonate resin in an amount of from 50.0% by weight to 99.9% by weight, based on the weight of the binder resin. In molecular weight distribution as measured by gel permeation chromatography of tetrahydrofuran-soluble matter, the toner contains in an amount of 15.0% by weight or less based on the weight of the toner a component which has in its structure a repeating unit of the polycarbonate resin and is contained in components having a molecular weight of 1,000 or less.

44 Claims, 9 Drawing Sheets

FOREIGN PATENT DOCUMENTS

| | | |
|---|---|---|
| JP | 28588 | 8/1971 |
| JP | 46-6084 | 12/1971 |
| JP | 52-3304 | 1/1977 |
| JP | 3305 | 7/1977 |
| JP | 52574 | 3/1982 |
| JP | 5046 | 1/1984 |
| JP | 15739 | 1/1984 |
| JP | 53856 | 3/1984 |
| JP | 59-050473 | 3/1984 |
| JP | 61842 | 4/1984 |
| JP | 133573 | 7/1984 |
| JP | 217366 | 7/1984 |
| JP | 59-125739 | 7/1984 |
| JP | 252360 | 12/1985 |
| JP | 252361 | 12/1985 |
| JP | 94062 | 5/1986 |
| JP | 138259 | 6/1986 |
| JP | 273554 | 12/1986 |
| JP | 14166 | 1/1987 |
| JP | 203182 | 9/1987 |
| JP | 133179 | 6/1988 |
| JP | 208863 | 8/1988 |
| JP | 20587 | 1/1989 |
| JP | 109359 | 4/1989 |
| JP | 79860 | 3/1990 |
| JP | 302772 | 12/1990 |
| JP | 50559 | 3/1991 |
| JP | 16426 | 1/1992 |
| JP | 2289 | 1/1993 |
| JP | 61383 | 3/1993 |
| JP | 05-053482 | 3/1993 |
| JP | 197203 | 8/1993 |
| JP | 273782 | 10/1993 |
| JP | 43688 | 2/1994 |
| JP | 281485 | 10/1995 |
| JP | 305074 | 11/1996 |

OTHER PUBLICATIONS

Patent Abstracts of Japan, vol. 96, No. 010, Oct. 1996 for JP 08–160667.

Patent Abstracts of Japan vol. 4, No. 138 (P–029), Sep. 1980 for JP 55–088073.

* cited by examiner

TONER AND IMAGE FORMING METHOD

BACKGROUND OF THE INVENTION

1. Field of the Invention

This invention relates to a toner for forming toner images in image forming processes such as electrophotography, electrostatic printing, magnetic recording and toner jet recording, and an image forming method employing such a toner. More particularly, this invention relates to a toner for developing electrostatic images which is used in a fixing system in which visible images formed out of toner are heat-fixed to recording mediums, and an image forming method employing such a toner.

2. Related Background Art

A number of methods as disclosed in U.S. Pat. No. 2,297,691, Japanese Patent Publications No. 42-23910 and No. 43-24748 and so forth are conventionally known as electrophotography. In general, copies are obtained by forming an electrostatic latent image on a photosensitive member by utilizing a photoconductive material and by various means, subsequently developing the latent image by the use of a toner, and transferring the toner image to a recording medium such as paper by an direct or indirect means as the occasion demands, followed by fixing by the action of heat, pressure or solvent vapor. The toner that has not transferred thereto and has remained on the photosensitive member is removed by cleaning by various means, and then the above process is repeated.

A usual full-color image forming method will be described. A photosensitive member (electrostatic latent image bearing member) such as a photosensitive drum is electrostatically uniformly charged by means of a primary charging assembly, and imagewise exposure is carried out using laser light modulated by magenta image signals of an original, to form an electrostatic latent image on the photosensitive drum. The electrostatic latent image is developed by means of a magenta developing assembly holding a magenta toner, to form a magenta toner image. Next, to a recording medium transported, the magenta toner image developed on the photosensitive drum is transferred by a direct or indirect means by means of a transfer charging assembly.

The photosensitive drum on which the electrostatic latent image has been developed is decharged by a residual charge eliminator, and is further cleaned through a cleaning means. Thereafter, it is again electrostatically charged by the primary charging assembly, and a cyan toner image is similarly formed. The cyan toner image is transferred to the recording medium on which the magenta toner image has been transferred, and then a yellow toner image and a black toner image are successively formed and developed so that the four color toner images are transferred to the recording medium. The recording medium having these four color toner images is passed through a fixing roller so that they are fixed to the recording medium by the action of heat and pressure. Thus, a full-color image is formed.

In recent years, such image forming apparatus are not only used as copying machines for office work to merely take copies of originals, but also have began to be used in the field of laser beam printers (LBPs) serving as the output of computers and in the field of personal copying (PC) of private use.

In addition to the field as typified by LBPs and PC, such apparatus are also being rapidly expanded to plain-paper facsimile machines to which basic engines are applied.

Under such circumstances, the apparatus are more severely sought to be made small-sized, light-weight, high-speed, image high-quality and highly reliable, and such machines have now been composed of more simple components in various respects. As the result, a higher performance has become required for toners, and superior machines can now no longer be accomplished unless improvement in the performance of toners is achieved. In recent years, with a need for various modes of copying, demand for color copying is rapidly increasing. In order to more faithfully copy original color images, it is sought to achieve a much higher image quality and a much higher resolution. Moreover, there is an increasing demand for the copying of double-side color originals.

From these viewpoints, as the toners used in the color image forming process, it is preferable to use toners having good melt properties and color-mixing properties when heat is applied thereto and also having a low softening point and high sharp-melt properties in a low melt viscosity.

Use of such sharp-melt toners makes it possible to broaden the range of color reproduction of copied matter and obtain color copies faithful to original images.

Color toners having such high sharp-melt properties, however, is so high in affinity for the fixing roller that it tends to cause offset with respect to the fixing roller at the time of fixing.

In particular, in the case of a fixing assembly in full-color image forming apparatus, an increase in toner layer thickness tends to cause the offset since a plurality of toner layers corresponding to magenta, cyan, yellow and black are formed on the recording medium.

In order to allow no toner to adhere to the surface of the fixing roller, a measure has been conventionally taken in which the roller surface is formed out of a material, such as silicon rubber or a fluorine resin, having an excellent releasability to toner, and, in order to prevent offset and to prevent fatigue of the roller surface, its surface is further covered with a thin film formed using a fluid having a high releasability as exemplified by silicone oil or fluorine oil. However, although this method is very effective in view of the prevention of the offset of toner, it requires a device for feeding an anti-offset fluid, and hence has such a problem that a complicated fixing assembly is required. In addition, the application of oil may bring about separation of layers on the fixing roller, and consequently, shorten the lifetime of the fixing roller.

Accordingly, based on the idea that the fluid for preventing offset should be fed from the inside of toner particles at the time of heat fixing, without use of any device for feeding silicone oil, a method has been proposed in which a release agent such as a low-molecular-weight polyethylene or a low-molecular-weight polypropylene is added in toner particles.

Japanese Patent Publications No. 52-3304 and No. 3305 and Japanese Patent Publication 57-52574 disclose that as the release agent a wax is incorporated into toner particles.

Japanese Patent Applications Laid-open No. 3-50559, No. 2-79860, No. 1-109359, No. 62-14166, No. 61-273554, No. 61-94062, No. 61-138259, No. 60-252361, No. 60-252360 and No. 60-217366 disclose techniques for incorporating waxes.

In the case of black toners, release agents having a relatively high crystallizability as typified by polyethylene wax and polypropylene wax can be used in order to improve high-temperature anti-offset properties at the time of fixing. However, in the case of full-color toners, this crystallizability of release agents may cause great damage to the transparency of OHP (overhead projector) toner images when outputted. Moreover, the wax may cause a lowering of blocking resistance of toners, and a lowering of developing performance because of migration of wax toward toner particle surfaces when toners are exposed to heat as a result of temperature rise in image forming apparatus such as printers and copying machines and also when toners are left standing for a long term.

To cope with such problems, various improvements are attempted from the aspect of binder resin. More specifically, a cross-linking component or a high-molecular-weight component is used in a binder resin in a larger quantity so that the high-temperature anti-offset properties at the time of fixing can be improved.

This method can certainly improve high-temperature anti-offset properties to a certain extent and also can be effective for improving durability such that external additives are prevented from being buried in toner particle surfaces and toners are prevented from melt-adhereing to the photosensitive member and toner carrying member.

However, this method conflicts with the improvement of grindability and low-temperature fixing performance of toners, and there is still room for improvement in order to achieve both the high-temperature anti-offset properties or durability and the low-temperature fixing performance.

Accordingly, to solve the above problems, much hope has been put in the development of novel toners.

To cope with the above subject, a toner produced by suspension polymerization is proposed (Japanese Patent Publication No. 36-10231). In this suspension polymerization, polymerizable monomers and a colorant (and also optionally a polymerization initiator, a cross-linking agent, a charge control agent and other additives) are uniformly dissolved or dispersed to form a monomer composition, and thereafter this monomer composition is dispersed in a continuous phase (e.g., an aqueous phase) containing a dispersion stabilizer, by means of a suitable stirrer to simultaneously carry out polymerization reaction to obtain toner particles having the desired particle diameters.

In this suspension polymerization, droplets of the monomer composition are produced in a dispersion medium having a large polarity such as water, and hence what is called core/shell structure can be formed in which components having polar groups, contained in the monomer composition, tend to present at the surface layer portions which are interfaces with the aqueous phase and non-polar components are not present at the surface layer portions.

Because of encapsulation of the release agent wax component, the toner produced by polymerization makes it possible to achieve both the low-temperature fixing performance or blocking resistance and the high-temperature anti-offset properties and also makes it possible to prevent high-temperature offset without applying any oil release agent to the fixing roller.

Toners for developing electrostatic images commonly contain a binder resin and a colorant as essential components, and various methods for improving binder resins are proposed for the purpose of improving the developing performance, fixing performance, storage stability and environmental stability of toners. For example, with regard to the above toners produced polymerization, a method is presented in which shells of a resin having a relatively low glass transition temperature (Tg) are covered with a resin having a relatively high Tg in order to achieve both the low-temperature fixing performance and the storage stability (e.g., Japanese Patent Application Laid-open No. 5-197203). However, most resins having a relatively high Tg which are used therein are polar resins having a moisture absorption, such as polyesters. Even though such resins can achieve both the low-temperature fixing performance and the storage stability, they have often caused a problem on charging stability resistant to environment variations.

Moreover, toners are commonly known to undergo deterioration caused by external additives that may be buried in toner particle surfaces when images are printed on many sheets, to adversely affect the images. As a means for improving the running performance of toners, a method is available in which the binder resin is made to have a higher mechanical strength. Since, however, problems may actually arise on the grindability of the binder resin and the fixing performance of toners, it is commonly difficult to use such a tough resin as a binder resin.

As resins having superior mechanical strength, electrical characteristics and aging resistance (weatherability), polycarbonates are commonly widely known and are used in various purposes. Some methods in which polycarbonates are used as binder resins are disclosed also in respect of toners.

For example, Japanese Patent Application Laid-open No. 46-28588 discloses an image forming method making use of a specific polycarbonate copolymer and a granular carrier. According to this publication, a toner having a superior blocking resistance can be obtained by using a specific polycarbonate copolymer as the binder resin. However, according to this publication, a polycarbonate copolymer having a glass transition temperature of from 70 to 95° C. is used as the binder resin and also any wax component is not contained in the toner, resulting in a very poor low-temperature fixing performance. Thus, there is room for improvement. The publication also has no description as to any influence on electrophotographic performance that may be caused by impurities contained in the polycarbonate copolymer. The publication still also discloses, in Examples, processes for producing toners by spray drying and pulverization, but has no disclosure at all as to differences in transfer performance of toner images from the electrostatic latent image bearing member to the recording medium and differences in charging uniformity, which are ascribable to the shapes of the toners obtained.

Japanese Patent Application Laid-open No. 63-208863 discloses a method in which a polycarbonate terpolymer with a specific structure, having a glass transition temperature of about 50° C., is used as a binder resin of a toner for flash fixing. According to this publication, the toner can be free from any bad smell and eluted matter because the binder resin polycarbonate terpolymer does not thermally decompose during flash fixing, and a toner having a good fixing performance can be obtained even though it contains no wax component. On the other hand, however, since only the polycarbonate terpolymer having a low glass transition temperature is used as the binder resin, the toner has not reached satisfactory levels in respect of blocking resistance and running performance. Also, since the toner is one designed for flash fixing, it is difficult for the toner to be applied to a type of fixing assembly, e.g., in which the toner comes into contact with a heating element as in heat-roll fixing.

U.S. Pat. No. 4,457,998 also discloses a toner having a structure wherein a linear binder resin is incorporated in a binder resin cross-linked in a high degree, and states that a polycarbonate copolymer can be used as the highly cross-linked resin or the linear binder resin or as both of the two. In the specification of this publication, however, there is no disclosure of an example where the polycarbonate copolymer is used, and it is unclear about any effect obtainable when the polycarbonate copolymer is used as the binder resin.

Japanese Patent Application Laid-Open No. 5-273782 discloses that filming can be prevented by using a toner with a value of Izot impact strength of 2 to 500 kg·cm/cm when made into a plate in an image forming method using a developing roller in which many minute closed electric fields are formed near the surface of the developing roller. It is said that a mixture of styrene-acrylic resin and polycarbonate may be used as a binder resin for the toner. However, in this publication, there is no description about polycarbonate. In addition, it has conducted no investigation of a component which has a repeating unit of polycarbonate and is contained in components having a molecular weight of 1,000 or less in a molecular weight distribution as measured by GPC, and the molecular weight of the polycarbonate.

Japanese Patent Application Laid-open No. 6-43688 discloses a method in which a polycarbonate copolymer having a specific structure that exhibits thermotropic liquid-crystal properties is used as a binder resin. The polycarbonate copolymer that exhibits thermotropic liquid-crystal properties usually has a high crystallizability, shows a gentle heat softening behavior up to its melting point, and further abruptly liquefies (melts) upon temperature rise to cause a decrease in viscosity and a drop in temperature. Because of such properties, the toner in which such a polycarbonate copolymer is used as the binder resin, even though it contains no wax component, can be fixed at a low energy while maintaining the grindability and blocking resistance. However, since the toner disclosed in this publication is constituted only of one kind of binder resin, the toner is so low in a viscosity at the time of its melting that what is called high-temperature offset is brought about, where the molten toner adheres to fixing members such as heat rolls. Such a problem remains unsettled. Moreover, the publication has no specific description as to any influence on electrophotographic performance that may be caused by impurities contained in the polycarbonate copolymer and as to the shape of toner particles.

As previously mentioned, in recent years, among users there is an increasing demand for the copying of double-side originals or the double-side copying of single-side orginals. Thus, double-side images having a higher image quality and a higher reliability are required for such purpose.

Among various problems of conventional techniques for double-side color copying, one of the most important subjects is paper curl that occurs after the fixing on one side. If this paper curl greatly occurs, the fixed images may have too poor transport performance to obtain images having a high image quality and a high reliability. To cope with this, toners are required to have, e.g., the performance of providing high-quality images satisfying image density, color reproducibility and so forth are obtainable in such a state that the toner is transferred to the recording medium in a small quantity. For this end, it becomes necessary to improve the coloring power of the toners themselves. In the double-side copying, since images that pass through a fixing assembly twice occur, it is required to be more improved in the high-temperature anti-offset properties.

In conventional full-color copying machines, commonly used are a method in which four photosensitive members and a belt-like transfer member are used, where electrostatic images formed on the photosensitive members are developed by the use of cyan, magenta, yellow and black toners and thereafter a recording medium is transported between the photosensitive members and the belt-like transfer member to transfer toner images by straight-pass, forming a full-color image, and a method in which a recording medium is wound around the surface of a transfer member by electrostatic force or by a mechanical means such as a gripper, the transfer member being set opposite to a photosensitive member, where the steps of development and transfer are carried out four times, finally obtaining a full-color image.

In recent years, as recording mediums for full-color copying, it has become increasingly necessary to expand materials to various ones including not only usual paper and overhead projector (OHP) films but also cardboards and small-sized sheets of paper such as cards and postcards. In the above method making use of four photosensitive members, the recording medium is straight transported, and hence the method can be widely applied to a variety of recording mediums. However, since a plurality of toner images must be superimposed accurately at given positions on the recording medium, there is such a problem that even any slight mis-registration makes it difficult to obtain high-quality images in a good reproducibility, requiring a complicated mechanism for transporting the recording medium to make the necessity for reliability higher and the number of component parts larger. Moreover, when cardboards having a large basis weight are used in a method in which the recording medium is wound around the transfer member surface by suction, the rear end of the recording medium may cause faulty attraction because of a strong stiffness of the recording medium, consequently undesirably causing faulty images ascribable to transfer. Similar faulty images may also occur on the small-sized sheets of paper.

Accordingly, as a system that can be applied in various recording mediums and can be miniaturized, a process system making use of an intermediate transfer member is proposed. For example, full-color image forming apparatus employing a drum-shaped intermediate transfer member are already known as disclosed in U.S. Pat. No. 5,187,526 and Japanese Patent Application Laid-open No. 4-16426.

The above U.S. Pat. No. 5,187,526 discloses that a high image quality can be achieved when an intermediate transfer roller comprising a surface layer formed of polyurethane as a base material is made to have a volume resistivity below $10^9$ Ω·cm and a transfer roller comprising a similar surface layer is made to have a volume resistivity of $10^{10}$ Ω·cm or above. In such a system, however, a high-output electric field is necessary for imparting transfer charges to the toner in a sufficient quantity when the toner is transferred to the recording medium, and hence a conductivity-providing agent is dispersed in the surface layer formed of polyurethane. This surface layer may locally cause breakdown to undesirably cause a conspicuous image disorder in halftone images where the toner is laid in a smaller quantity. Moreover, in an environment of high humidity which is higher than 60%RH (relative humidity), the application of such a high voltage tends to cause faulty transfer because transfer electric currents may leak as recording mediums are made to have a lower resistance. Meanwhile, in an environment of low humidity which is lower than 40%RH (relative humidity), it may also cause faulty transfer ascribable to non-uniform resistance of recording mediums.

In addition, in the full-color image forming apparatus in which a plurality of toner images are transferred, the toners on the intermediate transfer member are in a larger quantity than that in black-and-white copying and necessarily remain as transfer residual toners in a larger quantity. Hence, it becomes necessary to strengthen the shear force or rubbing force acting between the intermediate transfer member and a cleaning member. Accordingly, when color toners having a good fixing performance are used, the melt-adhesion or filming of toner tends to occur on the surface of the intermediate transfer member, so that transfer efficiency may become poor and problems on color uniformity and color balance tend to occur because of four color toner images not uniformly transferred in full-color copying. Thus, it has been difficult to stably form full-color images with a high image quality. That is, also in this transfer step, toners having well balanced fixing performance and running performance are desired.

As publications disclosing the relationship between the toner and the constitution employing an intermediate transfer member, named are Japanese Patent Applications Laid-open No. 59-15739 and No. 59-5046. These publications, however, only indicate that a toner with particle diameters of 10 $\mu$m or smaller is transferred in a good efficiency by the use of an adherent intermediate transfer member. Usually, in the system employing the intermediate transfer member, toner visible images must be once transferred from the photosensitive member to the intermediate transfer member and further again transferred from the intermediate transfer member to the recording medium, where the transfer efficiency of toner must be made much higher than that in the above conventional processes. Especially when a full-color copying machine is used in which a plurality of toner images are transferred after development, the toners on the photosensitive member are in a larger quantity than a monochromatic black toner used in black-and-white copying machines, and it is difficult to improve the transfer efficiency only by using conventional toners. Moreover, when conventional toners are used, the melt-adhesion or filming of toners may occur on the surfaces of the photosensitive member and intermediate transfer member because of the shear force or rubbing force acting between the photosensitive member or intermediate transfer member and the cleaning member and/or between the photosensitive member and the intermediate transfer member, so that the transfer efficiency may become poor and problems on color uniformity and color balance tend to occur because of four color toner images not uniformly transferred in full-color copying. Thus, it has been difficult to stably form full-color images with a high image quality.

In addition, as toners set in usual full-color copying machines, all the color toners are required to be well color-mixed in the step of fixing. From this viewpoint, the improvement of color reproducibility and the transparency of OHP images are important, and, compared with black toners, it is commonly preferable to use in color toners sharp-melt and low-molecular weight resins. In usual black toners, as previously stated, release agents having a relatively high crystallizability as typified by polyethylene wax and polypropylene wax are used in order to improve the high-temperature anti-offset properties at the time of fixing. In the full-color toners, however, as previously stated, this crystallizability of release agents may cause a great damage in the transparency of OHP toner images when outputted. For this reason, usually, silicone oil is uniformly applied to the heat fixing roller without addition of any release agents as color toner constituents so that the high-temperature anti-offset properties can be improved. However, an excess silicone oil may adhere to the surface of the recording medium having fixed toner images thus formed, to undesirably give users disagreeable feeling when used. Thus, the full-color image formation making use of the intermediate transfer member, having many contact portions, has many difficult problems at present. The above Japanese Patent Applications Laid-open No. 59-15739 and No. 59-5046 do not present any proposal for contriving the toners or intermediate transfer member in this regard.

Meanwhile, when the toner image formed on the photosensitive member in the developing step is transferred to the recording medium in the transfer step and when the transfer residual toner remains on the photosensitive member as previously stated, it becomes necessary for the transfer residual toner to be removed by cleaning in the cleaning step and stored in a waste toner container. In this cleaning step, blade cleaning, fur brush cleaning and roller cleaning have been used as cleaning means. Such means are those by which the toner remaining after transfer (transfer residual toner) is mechanically scraped off or blocked up so that it is collected in the waste toner container. Hence, because of such a member that is brought into pressure touch with the photosensitive member, unavoidable problems have tended to arise. For example, if a cleaning member is strongly pressed, the surface of the photosensitive member is worn to shorter the lifetime of the photosensitive member.

When viewed from the aspect of apparatus, the whole apparatus must be made larger in order to provide such a cleaning means. This has been a bottleneck in attempts to make apparatus compact. In addition, from the viewpoint of ecology, a system that may produce no waste toner is long-awaited in the sense of effective utilization of toners.

As publications disclosing techniques relating to a cleanerless system, Japanese Patent Applications Laid-open No. 59-133573, named are No. 62-203182, No. 63-133179, No. 64-20587, No. 2-302772, No. 5-2289, No. 5-53482 and No. 5-61383. None of these, however, refer to any desirable toner composition.

In a cleaning-at-development system (or cleaning-cum-development) having substantially no cleaning assembly, it is essential to provide a system in which the surface of the photosensitive member is rubbed with a toner and a toner carrying member. This may cause deterioration of the toner, deterioration of the toner carrying member surface and deterioration or wear of the photosensitive member surface as a result of long-term operation, leaving the problem of deterioration of running performance. Any conventional toners attaching importance to fixing performance can not well solve such problems. Thus, it is also sought to provide a technique that can achieve both fixing performance and running performance of toners.

In respect of non-magnetic one-component contact development, Japanese Patent Application Laid-open No. 7-281485 discloses a technique of a polymerization toner having the effect of restraining the deterioration of the toner carrying member surface and the deterioration of the photosensitive member surface. However, resins used therein are those commonly available, and the publication does not mention at all any influence coming from the composition of resin. It also has no disclosure relating to the compatibility with fixing performance.

Japanese Patent Application Laid-open No. 8-305074 discloses a cleanerless image forming method making use of a toner having a specific particle shape and having 1,000 ppm or less of residual monomers. There, however, is room for further improvement in relation to the adhesion of toner to the surface of the photosensitive member or toner carrying member.

SUMMARY OF THE INVENTION

An object of the present invention is to provide a toner solving the problems arising in prior art, and an image forming method employing such a toner.

Another object of the present invention is to provide a toner for developing electrostatic images which has a high running performance and a high transfer efficiency, and an image forming method employing such a toner.

Still another object of the present invention is to provide a toner for developing electrostatic images which may less vary in charging performance depending on environment and has a high transfer efficiency, and an image forming method employing such a toner.

A further object of the present invention is to provide an image forming method that can greatly improve running performances (or durability) such as resistance to toner deterioration and resistance to melt-adhesion of toner while maintaining low-temperature fixing performance by using a special toner in a contact development type image forming process employing a cleanerless system or an intermediate transfer member.

To achieve the above objects, the present invention provides a toner comprising a binder resin, a colorant and a wax, wherein;

the binder resin has a polycarbonate resin in an amount of from 0.1% by weight to 50.0% by weight and a resin other than the polycarbonate resin in an amount of from 50.0% by weight to 99.9% by weight, based on the weight of the binder resin; and in a molecular weight distribution as measured by gel permeation chromatography (GPC) of tetrahydrofuran (THF)-soluble matter, the toner contains in an amount of 15.0% by weight or less based on the weight of the toner a component having in its structure a repeating unit of the polycarbonate resin, contained in components having a molecular weight of 1,000 or less.

The present invention also provides an image forming method comprising the steps of;

(I) externally applying a voltage to a charging member to electrostatically charge an electrostatic latent image bearing member;

(II) forming an electrostatic latent image on the electrostatic latent image bearing member thus charged;

(III) developing the electrostatic latent image formed on the electrostatic latent image bearing member by using a toner to form a toner image;

(IV) transferring the toner image formed on the electrostatic latent image bearing member, to a recording medium via, or not via, an intermediate transfer member; and (V) heat-fixing to the recording medium the toner image transferred to the recording medium;

the toner comprising a binder resin, a colorant and a wax, wherein;

the binder resin has a polycarbonate resin in an amount of from 0.1% by weight to 50.0% by weight and a resin other than the polycarbonate resin in an amount of from 50.0% by weight to 99.9% by weight, based on the weight of the binder resin; and in a molecular weight distribution as measured by gel permeation chromatography (GPC) of tetrahydrofuran (THF)-soluble matter, the toner contains in an amount of 15.0% by weight or less based on the weight of the toner a component having in its structure a repeating unit of the polycarbonate resin, contained in components having a molecular weight of 1,000 or less.

DESCRIPTION OF THE PREFERRED EMBODIMENTS

Figure 1A:
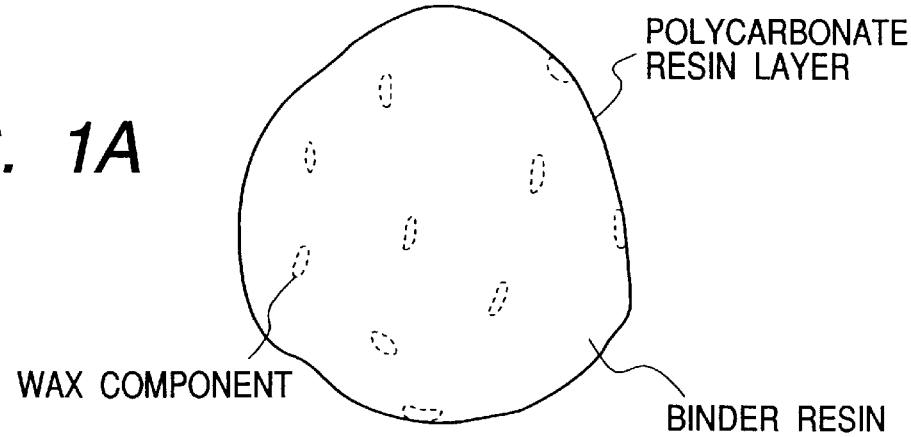
FIGS. 1A, 1B and 1C diagrammatically illustrate cross sections of toner particles according to the present invention.

As a result of extensive studies, the present inventors have discovered that a toner having a good running performance and a good transfer efficiency can be obtained by using a polycarbonate resin as part of a binder resin and also controlling the content of a specific compound contained in the toner. Thus, they have accomplished the present invention.

It is essential for the toner according to the present invention to be constituted of at least a binder resin, a colorant and a wax component and to contain a polycarbonate resin as the binder resin.

The polycarbonate resin, the essential component in the present invention, has in its molecular structure a repeating unit represented by the following Formula (I)

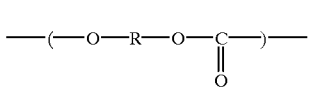

(I)

wherein R represents an organic group.

The repeating unit represented by the above Formula (I) includes those having various structures. All known polycarbonates produced by, e.g., allowing divalent phenols to react with carbonate precursors by a solution process or a melting process. For example, it may include polymers having a repeating unit represented by the following Formula (II)

(II)

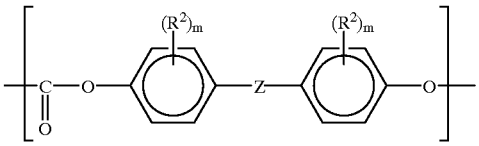

wherein $R^2$ represents a hydrogen atom, an aliphatic hydrocarbon group or an aromatic substituent, m represents an integer of 0 to 4, and when $R^2$ is in plurality, they may be the same or different; and Z represents a linkage represented by a single bond, an aliphatic hydrocarbon group, an aromatic substituent, —S—, —SO—, —$SO_2$—, —O— or —CO—.

This polycarbonate resin is available from various routes. Usually, it can be readily produced by allowing a divalent phenol represented by any of Formulas (III) to (V):

(III)

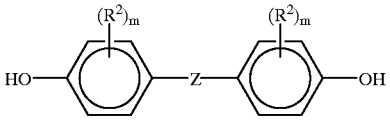

(IV)

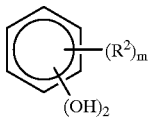

(V)

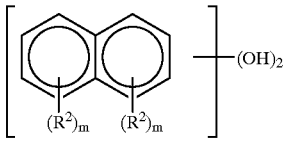

wherein $R^2$ represents a hydrogen atom, an aliphatic hydrocarbon group or an aromatic substituent, m represents an integer of 0 to 4, and when $R^2$ is in plurality, they may be the same or different; and Z represents a linkage represented by a single bond, an aliphatic hydrocarbon group, an aromatic substituent, —S—, —SO—, —$SO_2$—, —O— or —CO—;

to react with a carbonate precursor such as phosgene or a carbonate compound. More specifically, it can be produced by, e.g., allowing the divalent phenol to react with a carbonate precursor such as phosgene or subjecting the divalent phenol and a carbonate precursor such as diphenyl carbonate to transesterification, in a solvent such as methylene chloride in the presence of a known acid acceptor or molecular weight modifier.

The divalent phenols represented by the above Formulas (III) to (V) may include various ones, and may include 2,2-bis(4-hydroxyphenyl)propane (commonly called "bisphenol A"), and also dihydroxyarylalkanes such as bis(4-hydroxyphenyl)methane, bis(4-hydroxyphenyl) phenylmethane, bis(4-hydroxyphenyl)naphthylmethane, bis (4-hydroxyphenyl)-(4-isopropylphenyl)methane, bis(3,5-diemthyl-4-hydroxyphenyl)methane, 1,-bis(4-hydroxyphenyl)ethane, 1-naphthyl-1,1-bis (4-hydroxyphenyl)ethane, 1-phenyl-1,1-bis(4-hydroxyphenyl)ethane, 1,2-bis(4-hydroxyphenyl)ethane, 2-methyl-1,1-bis(4-hydroxyphenyl)propane, 2,2-bis(3,5-dimethyl-4-hydroxyphenyl)propane, 1-ethyl-1,1-bis(4-hydroxyphenyl)propane, 2,2-bis(3-methyl-4-hydroxyphenyl)propane, 1,1-bis(4-hydroxyphenyl)butane, 2,2-bis(4-hydroxyphenyl)butane, 1,4-bis(4-hydroxyphenyl) butane, 2,2-bis(4-hydroxyphenyl)pentane, 4-methyl-2,2-bis (4-hydroxyphenyl)pentane, 1,1-bis(4-hydroxyphenyl) cyclohexane, 2,2-bis(4-hydroxyphenyl)hexane, 4,4-bis(4-hydroxyphenyl)heptane, 2,2-bis(4-hydroxyphenyl)nonane, 1,10-bis(4-hydroxyphenyl)decane and 1,1-bis(4-hydroxyphenyl)cyclodecane; dihydroxyarylsulfones such as bis(4-hydroxyphenyl)sulfone and bis(3,5-dimethyl-4-hydroxyphenyl)sulfone; dihydroxyaryl ethers such as bis(4-hydroxyphenyl) ether and bis(3,5-dimethyl-4-hydroxyphenyl) ether; dihydroxyaryl ketones such as 4,4'-dihydroxybenzophenone and 3,3',5,5'-tetramethyl-4,4'-dihydroxybenzophenone; dihydroxyaryl sulfides such as bis (4-hydroxyphenyl) sulfide, bis(3-methyl-4-hydroxyphenyl) sulfide and bis(3,5-dimethyl-4-hydroxyphenyl) sulfide; dihydroxyaryl sulfoxides such as bis(4-hydroxyphenyl) sulfoxide; dihyroxydiphenyls such as 4,4'-dihydroxydiphenyl; dihyroxybenzenes such as hydroquinone, resorcinol and methylhydroquinone; and dihyroxynaphthalenes such as 1,5-dihydroxynaphthalene and 2,6-dihydroxynaphthalene. These divalent phenols may each be used alone or in combination.

The carbonate compound may include diaryl carbonates such as diphenyl carbonate, and dialkyl carbonates such as dimethyl carbonate and diethyl carbonate.

The polycarbonate resin used in the present invention may be used in the form of a homopolymer making use of one of these divalent phenols, a copolymer making use of two or more of them, or a blend of any of these. It may also be a thermoplastic random-branched polycarbonate resin obtained by allowing a polyfunctional aromatic compound to react with the above divalent phenol and/or carbonate precursor.

In order to control the glass transition temperature or viscoelasticity of the polycarbonate resin, also preferred is the use of a modified polycarbonate resin which has such a form that part of the above divalent phenol has been replaced with a polyhydric alcohol such as ethylene glycol, diethylene glycol, triethylene glycol, 1,2-propylene glycol, 1,3-propylene glycol, 1,4-butanediol, neopentyl glycol, 1,4-bis (hydroxymethyl)cyclohexane, 1,4-bis(2-hydroxyethyl) benzene, 1,4-cyclohexanedimethanol, polyethylene glycol, propylene glycol, hydrogenated bisphenol A or a derivative thereof, an ethylene oxide addition product of bisphenol A, a propylene oxide addition product of bisphenol A, glycerol, trimethylolpropane, or pentaerythritol. In this instance, it may be produced simply by replacement of part of the divalent phenol by the use of the above process. Alternatively, as another example of the production process, a method may be used in which the divalent phenol is reacted with an aliphatic or aromatic bischloroformate in a methylene chloride solvent using pyridine as a catalyst. Of course, it may be synthesized by any production process other than these.

In the present invention, as the polycarbonate resin, it is also possible to use a block copolymer of the above polycarbonate with a polymer such as polystyrene, styrene-acrylic or methacrylic copolymer, polyester, polyurethane, epoxy resin, polyolefin, polyamide, polysulfone, polycyanoaryl ether or polyarylene sulfide, and a graft-modified copolymer obtained by grafting an alkyl acrylate or methacrylate monomer, an acrylic or methacrylic acid monomer, a maleic acid monomer or a styrene monomer.

It is essential in the toner according to the present invention that, in molecular weight distribution as measured by GPC of THF-soluble matter, a component having in its structure a repeating unit of the polycarbonate resin, contained in components having a molecular weight of 1,000 or less, is contained in an amount of 15.0% by weight or less based on the weight of the toner.

In general, impurities contained in polycarbonate resins may differ in types depending on the types of the polycarbonate resin and their production process, and may include various compounds such as starting materials for the polycarbonate resins, auxiliary starting materials, by-products, decomposition products of these, polymerization catalysts, polymerization terminators, polymerization solvents and antioxidants. For example, they are chlorinated aliphatic or aromatic hydrocarbons (e.g., dichloromethane), phosgene, phenol, t-butylphenol, organic amines, sodium chloride, aromatic compounds having two or more hydroxyl groups per molecule [e.g., divalent phenols used as monomers of the polycarbonate resin, such as 2,2-bis(3-methyl-4-hydroxyphenyl)propane], aliphatic compounds having two or more hydroxyl groups per molecule (e.g., diols used as monomers of the polycarbonate resin, such as 1,4-butanediol), polycarbonate oligomers, compounds formed by ester linkage of a compound having two or more hydroxyl groups per molecule and a polymerization terminator with a carbonic acid intervening therebeween (e.g., compounds formed by ester linkage of a divalent phenol and p-tert-butylphenol with a carbonic acid intervening therebetween), mono- and/or diformates of aromatic compounds having two or more hydroxyl groups per molecule (e.g., phenylenebischloroformate), mono- and/or diformates of aliphatic compounds having two or more hydroxyl groups per molecule (e.g., ethylenebischloroformate), diaryl carbonates (e.g., diphenyl carbonate), and dialkyl carbonates (e.g., dimethyl carbonate).

Of these impurities, low-boiling compounds such as dichloromethane and water-soluble compounds such as sodium chloride can be removed relatively with ease in the steps of producing the polycarbonate resin. Most of high-boiling impurities, however, remain in the polycarbonate resin in usual cases. Of these high-boiling and low-molecular-weight impurities, monomers having two or more hydroxyl groups per molecule (e.g., divalent phenols) and components having repeating units of the polycarbonate resin in the structure and having molecular weight of 1,000 or less (i.e., the polycarbonate oligomers or the compounds formed by ester linkage of a compound having two or more hydroxyl groups per molecule and a polymerization terminator such as a monovalent phenol with a carbonic acid intervening therebetween), which are used when the polycarbonate resin is produced, bring up problems. When toners containing such monomers and components in a large quantity are produced, the toners may cause a variety of serious problems such as a lowering of charge quantity of toner (a decrease in image density and an increase in fog), a lowering of environmental stability of toner, a coloring (a change in color of images) due to aerial oxidation of phenol type impurities, a bad smell of impurities at the time of fixing, a lowering of OHP transparency that is caused by crystallization of impurities, an unexpected cross-linking of binder resin in the step of melt-kneading which is one of toner production steps in a pulverization process, and a polymerization inhibitory action caused by phenol type impurities when toners are produced by polymerization. This has been found as a result of the analysis of toners and evolution of images which have been made by the present inventors.

The toner of the present invention is so controlled that, in molecular weight distribution as measured by GPC of THF-soluble matter, the component having in its structure a repeating unit of the polycarbonate resin, contained in the components having a molecular weight of 1,000 or less, i.e., the component having a repeating unit of the polycarbonate resin in the structure and having a molecular weight of 1,000 or less, is in an amount of 15.0% by weight or less based on the weight of the toner. As stated above, the compounds that may adversely affect various performances and properties of toners include not only the component having a repeating unit of the polycarbonate resin in the structure and having a molecular weight of 1,000 or less, but also the monomers of the polycarbonate resin. The content of such monomers has a proportionality to the content of the component having a repeating unit of the polycarbonate resin in the structure and having a molecular weight of 1,000 or less, and the above various problems do not occur so long as the content of the component having a repeating unit of the polycarbonate resin in the structure and having a molecular weight of 1,000 or less is kept not more than 15.0% by weight based on the weight of the toner. This has been found as a result of extensive studies made by the present inventors. In order to more improve the performances and properties of the toner, the component having a repeating unit of the polycarbonate resin in the structure and having a molecular weight of 1,000 or less may be made not more than 10.0% by weight, and particularly preferably not more than 5.0% by weight. Of course, it is most desirable to use as the binder resin a polycarbonate resin purified by re-precipitation so highly that the component having a repeating unit of the polycarbonate resin in the structure and having a molecular weight of 1,000 or less is not detected at all even if the toner is analyzed in various manners.

If, in molecular weight distribution as measured by GPC of THF-soluble matter, the component having in its structure a repeating unit of the polycarbonate resin, contained in components having a molecular weight of 1,000 or less, is contained in the toner in an amount more than 15.0% by weight, the durability of the toner is lowered, storage stability is deteriorated, and change in image density comes to be large when many sheets are printed out, and in addition, a transfer efficiency variation due to environmental change and fogging are increased.

In the present invention, the component having in its structure a repeating unit of the polycarbonate resin, contained in components having molecular weight of 1,000 or less, in molecular weight distribution as measured by GPC of THF-soluble matter, can be qualitatively and quantitatively analyzed by various methods. For example, the toner may be analyzed by spectroscopy such as nuclear magnetic resonance spectroscopy ($^{1}$H-NMR, $^{13}$C-NMR), infrared absorption spectroscopy (IR), Raman spectroscopy, ultraviolet absorption spectroscopy (UV) or mass spectroscopy (MS), elementary analysis, GPC, gas chromatography (GC), high-pressure liquid chromatography (HPLC), and other chemical analyses. When it is difficult for the toner to be analyzed by itself, the toner may be subjected to Soxhlet extraction with a solvent capable of dissolving binder resin, such as tetrahydrofuran or toluene, the filtrate obtained may be concentrated with an evaporator, and thereafter the above analysis may be made. Various analytical means may also be employed; e.g., a sample of the components having molecular weight of 1,000 or less, separated and collected by liquid chromatography or GPC, or a sample extracted with a single or mixed solvent may be analyzed by the above method. Any of these analytical means may be used alone, or in combination.

Another method is also available in which the components having molecular weight of 1,000 or less contained in the toner are separated and collected by GPC, the components thus collected are completely hydrolyzed with, e.g., an alkali, and thereafter the monomers having two or more hydroxyl groups in the molecule (e.g., divalent phenols) used when the polycarbonate resin is produced are qualitatively and quantitatively analyzed by the analytical means such as $^{1}$H-NMR, $^{13}$C-NMR or IR. The content of the monomers quantitated here is the sum total of monomers produced by hydrolysis of the polycarbonate oligomers having molecular weight of 1,000 or less and the compounds formed by ester linkage of a compound having two or more hydroxyl groups per molecule and a polymerization terminator such as a monovalent phenol with a carbonic acid intervening therebetween, and residual monomers originally contained in the polycarbonate resin (at the time of polymerization). This total content is calculated as the content of the polycarbonate oligomers and the compounds formed by ester linkage of a monomer and a polymerization terminator with a carbonic acid intervening therebetween (after the polymerization terminator has been qualitatively and quantitatively analyzed separately). So long as the value thus obtained is 15.0% by weight or less based on the weight of the toner, consequently the content of the compounds having repeating units of the polycarbonate resin in the structure and having a molecular weight of 1,000 or less can not be more than 15.0% by weight. Thus, this method can be employed as one means for the analysis of the toner according to the present invention.

The molecular weight distribution of the THF-soluble matter of the toner is measured by gel permeation chromatography (GPC). As a specific method for the measurement by GPC, a solution prepared by dissolving the binder resin or toner in tetrahydrofuran (THF) at room temperature over a period of 24 hours is filtered with a solvent-resistant membrane filter of 0.2 $\mu$m in pore diameter to obtain a sample solution, which is then measured under conditions shown below. To prepare the sample, the amount of THF is so controlled that the component soluble in THF is in a concentration of from 0.4 to 0.6% by weight.

Apparatus: High-speed GPC HLC8120 GPC (manufactured by Toso Co., Ltd.)

Columns: Combination of seven columns, Shodex KF-801, 802, 803, 804, 805, 806 and 807 (available from Showa Denko K.K.)

Eluant: Tetrahydrofuran

Flow rate: 1.0 ml/min.

Oven temperature: 40.0° C.

Amount of sample injected: 0.10 ml

To calculate the molecular weight of the sample, a molecular weight calibration curve is used which is prepared using a standard polystyrene resin (available from Toso Co., Ltd., TSK Standard Polystyrene F-850, F-450, F-288, F-128, F-80, F-40, F-20, F-10, F-4, F-2, F-1, A-5000, A-2500, A-1000, A-500).

There are no particular limitations on the molecular weight of the polycarbonate resin used in the present invention. The polycarbonate resin may preferably be those having a peak molecular weight in the region of molecular weight of from 1,000 to 500,000, and more preferably in the region of molecular weight of from 2,000 to 100,000, in molecular weight distribution as measured by gel permeation chromatography (GPC). If it has a peak molecular weight in the region of molecular weight lower than 1,000, it may adversely affect charging performance, and, in the region of molecular weight higher than 500,000, its melt viscosity may be so high as to cause a problem on fixing performance. When the polycarbonate resin used in the present invention is produced, a suitable molecular weight regulator, a branching agent for improving viscoelasticity and a catalyst for accelerating reaction may optionally be used.

In the present invention, the polycarbonate resin may be in a content of from 0.1 to 50% by weight, preferably from 0.2 to 40% by weight, and more preferably from 0.5 to 30% by weight, based on the weight of the binder resin, and an additional resin used as the binder resin in combination with the polycarbonate resin may be in a content of from 50 to 99.9% by weight, preferably from 60 to 99.8% by weight, and more preferably from 70 to 99.5% by weight. In the toner, a high-molecular-weight resin or cross-linked resin having a peak molecular weight higher than 50,000 and a low-molecular-weight resin of about a peak molecular weight of from 1,000 to 50,000 may preferably be used in combination as binder resins so that the viscoelasticity of the toner can be designed so as to prevent low-temperature and high-temperature offset. If the polycarbonate resin in the binder resin is in a content more than 50% by weight, it may be difficult to produce the toner so designed, causing a problem. If on the other hand the polycarbonate resin in the binder resin is in a content less than 0.1% by weight, the superior running performance and transfer efficiency which should be achieved by the present invention can not be realized.

The additional resin used in the present invention in combination with the polycarbonate resin may include styrene-acrylic resins, polyester resins, styrene-butadiene resins and epoxy resins which are commonly used. In particular, styrene-acrylic resins and polyester resins and epoxy resins may preferably be used. These resins may be produced by any known methods. For example, styrene-acrylic resins can be obtained by polymerizing monomers for forming them. Specifically, preferably used are styrene monomers such as styrene, o-, m- or p-methylstyrene, and m- or p-ethylstyrene; acrylate or methacrylate monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and olefin monomers such as butadiene, isoprene, cyclohexene, acrylo- or methacrylonitrile and acrylic acid amide. Any of these may be used alone, or usually used in the form of an appropriate mixture of monomers so mixed that the theoretical glass transition temperature (Tg) as described in a publication POLYMER HANDBOOK, 2nd Edition III, pp.139–192 (John Wiley & Sons, Inc.) ranges from 40 to 75° C. If the theoretical glass transition temperature is lower than 40° C., problems may arise in respect of storage stability or running stability of the toner. If on the other hand it is higher than 75° C., the fixing point of the toner may become higher. Especially in the case of color toners used to form full-color images, the color mixing performance of the respective color toners at the time of fixing may lower, resulting in a poor color reproducibility, and also the transparency of OHP images may lower. Thus, such temperatures are not preferable.

In the present invention, the polycarbonate resin may preferably be present on the surfaces of toner particles because the toner can be more improved in running performance.

In the toner of the present invention, where the polycarbonate resin may preferably be present on the surfaces of toner particles, the presence of the polycarbonate resin on the surfaces of toner particles can be ascertained by varioud analytical means. For example, first, cross sections of toner particles are observed on a TEM (transmission electron microscope) to confirm whether or not the surface portions of the toner particles each form a contrast. When the polycarbonate resin is present on the surfaces, such portions form a contrast. Next, using photoacoustic spectroscopy (PAS), the composition of the resultant toner particle surfaces is analyzed by infrared absorption spectroscopy (IR)/PAS while changing the scanning speed of a movable mirror. When a continuous or discontinuous contrast is seen at the toner particle surfaces by the TEM observation and also the presence of polycarbonate resin is confirmed upon analysis by the IR/PAS, it can be judged that the polycarbonate resin is present on the toner particle surface. Besides the IR/PAS, various analytical means are available, e.g., compositional analysis of toner particle surfaces using Raman spectroscopy and the PAS in combination, elementary analysis of toner particle surfaces by ESCA (electron spectroscopy for chemical analysis), and elementary analysis of toner particle surfaces using an electron microscope provided with an energy dispersion type X-ray spectroscope or an electron ray energy analyzer. Any of these analytical means may be used alone, or in combination.

When the toner of the present invention is produced by a polymerization process described later, its polymer component may preferably have a main peak in the region of a molecular weight of from 5,000 to 100,000 and a ratio of a weight-average molecular weight (Mw) to a number-average molecular weight (Mn), Mw/Mn, of from 2 to 300, in molecular weight distribution as measured by GPC of THF-soluble matter.

The toner according to the present invention may preferably have the value of a shape factor SF-1 of from 100 to 160 and the value of a shape factor SF-2 of from 100 to 140 as measured with an image analyzer. It may more preferably have the value of the shape factor SF-1 of from 100 to 140 and the value of the shape factor SF-2 of from 100 to 120. In addition, it may particularly preferably have the value of (SF-2)/(SF-1) of 1.0 or less.

In the present invention, the SF-1 indicating a shape factor is a value obtained by taking at random 100 samples of toner particle images magnified 500 times by the use of, e.g., FE-SEM (S-800; a scanning electron microscope manufactured by Hitachi Ltd.), introducing their image information in an image analyzer (LUZEX-III; manufactured by Nikore Co.) through an interface to make analysis, and calculating the data according to the following expression. The value obtained is defined as shape factor SF-1.

$$\text{Shape factor } SF\text{-}1=(MXLNG)^2/AREA\times\pi/4\times100$$

wherein MXLNG represents an absolute maximum length of a toner particle, and AREA represents a projected area of a toner particle.

The shape factor SF-2 refers to a value obtained by calculation according to the following expression.

$$\text{Shape factor } SF\text{-}2=(PERI)^2/AREA\times1/4\pi\times100$$

wherein PERI represents a peripheral length of a toner particle, and AREA represents a projected area of a toner particle.

The shape factor SF-1 indicates the degree of sphericity of toner particles. SF-2 indicates the degree of irregularity of toner particles.

Hitherto, when the toner has small shape factors SF-1 and SF-2, faulty cleaning is liable to occur or any external additive tends to be embedded in toner particle surfaces during long-term service, causing the deterioration of image quality in many cases. However, in the present invention, since the binder resin holds the polycarbonate resin in an amount of from 0.1 to 50% by weight, the toner has a very good running performance, and can prevent the deterioration of image quality. If SF-1 is more than 160, the toner particles have an amorphous shape (shapeless), which is not preferable because the transfer efficiency of toner images tens to lower when toner images are transferred from the electrostatic latent image bearing member to the recording medium, from the electrostatic latent image bearing member to the intermediate transfer member and from the intermediate transfer member to the recording medium. If SF-2 is more than 140, the toner may have a broad charging distribution and also toner particle surfaces tend to be ground down in the developing assembly, causing image density fall and fog in some cases.

In order to enhance the transfer efficiency of toner images, it is preferred that the toner has the shape factor SF-2 of from 100 to 140 and the value of (SF-2)/(SF-1) of 1.0 or less. If the toner has a shape factor SF-2 of more than 140 and the value of (SF-2)/(SF-1) of more than 1.0, the toner particles have no smooth surfaces and have many irregularities, so that the transfer efficiency tends to lower when toner images are transferred from the electrostatic latent image bearing member to the intermediate transfer member and from the intermediate transfer member to the recording medium.

The above tendencies are remarkable especially when full-color copying machines are used in which a plurality of toner images are developed and transferred. More specifically, in the formation of full-color images, it is difficult for the four color toner images to be uniformly transferred. Moreover, when the intermediate transfer member is used, problems tend to occur in respect of color uniformity and color balance, making it difficult to stably form full-color images in a high image quality.

In addition, when usual amorphous (shapeless) toners are used, the melt-adhesion or filming of toners may occur on the surfaces of the photosensitive member and intermediate transfer member because of the shear force or rubbing force acting between the photosensitive member or intermediate transfer member and the cleaning member and/or between the photosensitive member and the intermediate transfer member, having difficulty in matching with image forming apparatus.

In the present invention, the intermediate transfer member may be provided so as to deal with various types of recording mediums. In this instance, the transfer step is substantially doubled. Hence, decrease in the transfer efficiency decreases the efficiency of utilizing toners, which is a problem. In digital full-color copying machines or printers, a color image original must be previously subjected to color resolution using a B (blue) filter, a G (green) filter and a R (red) filter and thereafter a 20 to 70 $\mu$m dot latent image must be formed on the photosensitive member so that a multicolor image faithful to the original can be reproduced by utilizing the action of subtractive mixture using a Y (yellow) toner, a M (magenta) toner, a C (cyan) toner and a B (black) toner. Here, the Y toner, M toner, C toner and B toner are superimposed on the photosensitive member or intermediate transfer member in a large quantity in accordance with the color information of the original or CRT, and hence the color toners used in the present invention are required to have a very high transfer performance. To meet such a requirement, the toner may preferably have toner particles whose shape factors SF-1 and SF-2 fulfill the conditions described above.

In order to faithfully develop minute latent image dots to make image quality higher, the toner may have a weight-average particle diameter of 2 to 10 μm, preferably from 2 μm to 9 μm, and more preferably from 4 μm to 8 μm, and a coefficient of variation (A) in number distribution of 35% or less. If the toner has a weight-average particle diameter smaller than 4 μm, the toner after transfer may remain on the photosensitive member or intermediate transfer member in a large quantity and also tends to cause fog and image non-uniformity due to faulty transfer. Thus, such a toner is not preferable as the toner used in the present invention. If the toner has a weight-average particle diameter larger than 10 μm, the toner tends to melt-adhere to the surfaces of members such as the photosensitive member and the intermediate transfer member. If the toner has a coefficient of variation (A) in number distribution above 35%, such tendency may become higher.

The particle size distribution of the toner can be measured by various methods. In the present invention, it is measured with a Coulter counter.

For example, Coulter counter Model TA-II (manufactured by Coulter Electronics, Inc.) is used as an apparatus for measurement. An interface (manufactured by Nikkaki K.K.) that outputs number distribution and volume distribution is connected with a personal computer. As an electrolytic solution, an aqueous 1% NaCl solution is prepared using first-grade sodium chloride. For example, ISOTON R-II (available from Coulter Scientific Japan Co.) may be used. Measurement is carried out by adding as a dispersant 0.1 to 5 ml of a surface active agent (preferably an alkylbenzenesulfonate) to 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. Particle size distribution of particles with particle diameters of from 2 to 40 μm on the basis of number is measured by means of the above Coulter Multisizer, using an aperture of, e.g., 100 μm as its aperture. Then the values according to the present invention are determined.

The coefficient of variation (A) in the number distribution of the toner is calculated according to the following expression.

$$\text{Coefficient of variation } A=[S/D_1]\times 100$$

wherein S represents a value of standard deviation in the number distribution of toner particles, and $D_1$ represents a number-average particle diameter (μm) of the toner particles.

The wax component used in the toner of the present invention may include paraffin wax and derivatives thereof, microcrystalline wax and derivatives thereof, Fischer-Tropsch wax and derivatives thereof, polyolefin wax and derivatives thereof, carnauba wax and derivatives thereof, higher fatty acids and metal salts thereof, higher aliphatic alcohols, higher aliphatic esters, aliphatic amide waxes, ketones, hardened a castor oil and derivatives thereof, vegetable waxes, animal waxes, mineral waxes and petrolatums. The derivatives include oxides, block copolymers with vinyl monomers, and graft modified products.

The wax component has a maximum endothermic peak within the temperature range of from 40 to 130° C., preferably from 50 to 100° C., at the time of temperature rise, in the DSC curve as measured with a differential scanning calorimeter. The component having a maximum endothermic peak within the above temperature range greatly contributes to low-temperature fixing and also effectively exhibits releasability. If the maximum endothermic peak is at a temperature lower than 40° C., the wax component may have a weak self-cohesive force, resulting in poor high-temperature anti-offset properties and also an excessively high gloss. If on the other hand the maximum endothermic peak is at a temperature higher than 130° C., fixing temperature may become higher and also it may be difficult to appropriately smoothen fixed-image surfaces. Hence, especially when used in color toners, this is not preferable because of a lowering of color mixing performance. Also, when the toner is directly obtained by carrying out granulation and polymerization in an aqueous medium, there is, for example, such a problem that the wax component may precipitate during granulation if the endothermic peak is at a high temperature.

The maximum endothermic peak temperature of the wax component is measured according to ASTM D3418-8. For the measurement, for example, DSC-7, manufactured by Perkin-Elmer Corporation, is used. The temperature at the detecting portion of the device is corrected on the basis of melting points of indium and zinc, and the calorie is corrected on the basis of heat of fusion of indium. The sample is put in a pan made of aluminum and an empty pan is set as a control, making measurement while raising temperature from 10° C. to 180° C. at a rate of temperature rise of 10° C./min.

In the present invention, there are no particular limitations on the amount of the wax component added. Usually, the wax component may preferably be in a content of from 0.1 to 50% by weight, and more preferably from 0.5 to 30% by weight, based on the weight of the toner. If the wax component is in a content less than 0.1% by weight, the offset may not be effectively prevented. If it is in a content more than 50% by weight, the long-term storage stability may lower and also other toner materials may not be sufficiently dispersed, causing a lowering of image quality in some cases.

The colorant used in the present invention may include yellow colorants, magenta colorants and cyan colorants shown below. As black colorants, carbon black, magnetic materials, or colorants adjusted to a black tone by mixing the yellow, magenta and cyan colorants shown below may be used.

As yellow colorants, compounds typified by condensation azo compounds, isoindolinone compounds, anthraquinone compounds, azo metal complexes, methine compounds and allylamide compounds are used. Stated Specifically, C.I. Pigment Yellow 12, 13, 14, 15, 17, 62, 74, 83, 93, 94, 95, 97, 109, 110, 111, 128, 129, 147, 168 and 180 are preferably used.

As magenta colorants, condensation azo compounds, diketopyrorolopyrr compounds, anthraquinone compounds, quinacridone compounds, basic dye lake compounds, naphthol compounds, benzimidazolone compounds, thioindigo compounds and perylene compounds are used. Specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 and 254 are particularly preferred.

As cyan colorants, copper phthalocyanine compounds and derivatives thereof, anthraquinone compounds and basic dye lake compounds may be used. Specifically, C.I. Pigment Blue 1, 7, 15:1, 15:2, 15:3, 15:4, 60, 62 and 66 may particularly preferably be used.

These colorants may be used alone, in the form of a mixture, or in the state of a solid solution. The colorants are selected taking account of hue, chroma, brightness, weatherability, OHP transparency and dispersibility in toner particles. The colorant may preferably be used in an an amount of from 1 to 20 parts by weight based on 100 parts by weight of the resin components.

The toner of the present invention may also make use of a magnetic material as a black colorant so that it can be used as a magnetic toner. Magnetic materials usable here may include iron oxides such as magnetite, hematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

The magnetic material used in the present invention may preferably be a surface-modified magnetic material. When used in the toner produced by polymerization, materials having been subjected to hydrophobic treatment with a surface modifier which is a substance having no polymerization inhibitory action are preferred. Such a surface modifier may include, e.g., silane coupling agents and titanium coupling agents.

These magnetic materials may preferably be those having an average particle diameter of 2 $\mu$m or smaller, and preferably from about 0.1 to 0.5 $\mu$m. The magnetic material may preferably be contained in the toner particles in an amount of from 20 to 200 parts by weight, and particularly preferably from 40 to 150 parts by weight, based on 100 parts by weight of the binder resin. The magnetic material may preferably be those having a coercive force (Hc) of from 20 to 300 oersteds, a saturation magnetization ($\sigma s$) of from 50 to 200 emu/g and a residual magnetization ($\sigma r$) of from 2 to 20 emu/g, as magnetic characteristics under the application of 10 K oersteds.

As charge control agents used in the present invention, known agents may be used. In particular, it is preferable to use charge control agents having a high charging speed and capable of stably maintaining a constant charge quantity. When toner particles are directly produced by polymerization, charge control agents having neither polymerization inhibitory action nor solubilizates in the aqueous phase are particularly preferred. As specific compounds, negative charge control agents may include metal compounds of aromatic carboxylic acids such as salicylic acid, naphthoic acid and dicarboxylic acids; metal salts or metal complexes of azo dyes or azo pigments; polymer type compounds having a sulfonic acid or carboxylic acid group in the side chain; boron compounds; urea compounds; silicon compounds; and carycsarene. Positive charge control agents may include quaternary ammonium salts, polymer type compounds having such a quaternary ammonium salt in the side chain, guanidine compounds and imidazole compounds. The charge control agent may preferably be contained in the toner in a amount of from 0.5 to 10 parts by weight based on 100 parts by weight of the binder resin. In the present invention, however, the addition of the charge control agent is not essential. When two-component development is employed, the triboelectric charging with a carrier may be utilized, and also when non-magnetic one-component blade coating development is employed, the triboelectric charging with a blade member or sleeve member may be intentionally utilized. Thus, the charge control agent need not necessarily be contained in toner particles.

Methods for producing the toner according to the present invention may include various methods. For example, whe produced by pulverization, the binder resin containing the polycarbonate resin, the wax component, the colorant and/or the magnetic material, the charge control agent and other additives are thoroughly dispersed by means of a mixing machine such as a Henschel mixer or a ball mill, the mixture obtained is melt-kneaded using a heat kneading machine such as a pressure kneader or an extruder, then the kneaded product is cooled, and the cooled product is collided against a target by a mechanical means or in a jet stream so as to be finely pulverized to have the desired toner particle diameter. Thereafter, the pulverized product is optionally treated to make toner particles smooth and spherical. Subsequently, the pulverized product is further brought to a classification step to make its particle size distribution sharp. The classified powder is further well mixed with a fluidity-providing agent such as fine silica particles by means of a mixing machine such as a Henschel mixer, thus the toner of the present invention can be obtained. When this pulverization method is employed, the polycarbonate resin and other resin may be dissolved (optionally with heating) in an organic solvent such as xylene to mix them uniformly, followed by removal of the solvent to obtain a binder resin mixture, and this mixture may be used as a material, whereby even the polycarbonate resin having a high glass transition temperature can be well dispersed in the toner. This is a particularly preferred production method.

As another method for producing the toner, a method is available in which an ultra-finely powdered polycarbonate resin may be added to the classified powder together with the fluidity-providing agent, which are then thoroughly mixed to cause the polycarbonate resin to fix to toner particle surfaces. In this instance, the polycarbonate resin may be contained in the binder resin in the classified powder, or may not be contained therein at all. After its fixing to toner particle surfaces, the toner particles may further be treated to make them smooth and spherical.

When the toner of the present invention is produced by polymerization, the polycarbonate resin may be added to the polymerization system so that the toner of the present invention can be obtained by the method as disclosed in Japanese Patent Publication No. 36-10231 and Japanese Patent Applications Laid-open No. 59-53856 and No. 59-61842, in which toners are directly produced by suspension polymerization; a dispersion polymerization method in which toners are directly produced using an aqueous organic solvent capable of dissolving polymerizable monomers and not capable of dissolving the resulting polymer; or an emulsion polymerization method as typified by soap-free polymerization in which toners are produced by directly polymerizing polymerizable monomers in the presence of a water-soluble polar polymerization initiator. It is also possible to employ a method in which polymer particles containing no polycarbonate resin are produced by polymerization and thereafter a fine-particle polycarbonate resin is allowed to adhere to the surfaces of the polymer particles by melt-spraying, optionally followed by treatment to make the particles smooth and spherical. Still another method is exemplified by such a method as disclosed in Japanese Patent Publication No. 56-13945, in which a toner material mixture containing the polycarbonate resin is atomized in the air by means of a disk or a multiple fluid nozzle to obtain spherical toner particles.

Of the toner production methods described above, the method using melt-spraying can control the value of SF-1, the shape factor of toner particles as measured with LUZEX, within the range of from 100 to 160, but the toner particles obtained tend to have a broad particle size distribution. As for the dispersion polymerization, the toner particles obtained show a very sharp particle size distribution, but materials used must be selected in a narrow range or the use of the organic solvent concerns the disposal of waste solvents or the flammability of solvents, from the viewpoint of which the production apparatus tends to be complicated and be troublesome for handling. The emulsion polymerization is advantageous in that the toner particles can have a relatively uniform particle size distribution, but in general, the particles formed are so fine that they are difficult to use as toner particles as they are. Moreover, water-soluble polymerization initiator terminals and emulsifying agents used may be present on the toner particle surfaces to make environmental properties poor in some cases. On the other hand, the production method using the treatment to make toner particles smooth and spherical and the production method using polymerization can easily control the value of shape factor SF-1 within the rage of from 100 to 160 and the value of shape factor SF-2 from 100 to 140, and can be said to be a preferred production method.

In particular, the production method using in combination the polymerization and the treatment to make toner particles smooth and spherical and the method of directly producing by polymerization the toner on the toner particle surfaces of which the polycarbonate resin is present can easily control the value of shape factor SF-1 within the rage of from 100 to 140, the value of shape factor SF-2 from 100 to 120 and the value of (SF-2)/(SF-1) 1.0 or below. In addition, when the cross-sections of the magnetic toner particles are observed with a transmission electron microscope (TEM), the polycarbonate resin is present on the surfaces of toner particles, the binder resin obtained from vinyl monomers and the wax component are present in their interiors, and the wax component is dispersed in the binder resin in the form of a substantially spherical and/or spindle-shaped island or islands. Hence, toners which may less cause variations of charging performance by environmental factors and have superior transfer performance, developing performance, low-temperature fixing performance and blocking resistance can be obtained. Thus, this is a more preferred production method. The method of directly producing by polymerization the toner on the toner particle surfaces of which the polycarbonate resin is present not only has the above advantages, but also is easy as a production method and also allows usable polycarbonate resins to be selected from a wide range. Thus, this is particularly preferred production method.

The polycarbonate resin contained in the toner of the present invention may be contained in toner particles in any shape and state, where it may stand dissolved together with other binder resin or may stand phase-separated. For example, when the polycarbonate resin and the additional resin are melt-kneaded in the pulverization process described above, the polycarbonate resin need not necessarily have been melted in this melt-kneading step, and may stand dispersed in the additional binder resin having been melted. In such an instance, the polycarbonate resin in the toner stands dispersed in the additional binder resin used in combination. When the polycarbonate resin and the additional binder resin are beforehand uniformly dissolved and mixed using an organic solvent such as xylene, there is no problem since the polycarbonate resin is finely dispersed in, or in some cases dissolved together with, the additional resin. When, however, without any such operation to make uniform, a polycarbonate resin powder and the additional binder resin are kneaded and are also kneaded at a temperature lower than the melt temperature of the polycarbonate resin, the polycarbonate resin powder can be dispersed in the toner. Hence, preferred is the use of a polycarbonate resin finely pulverized to 1 $\mu$m or smaller, and preferably 0.5 $\mu$m or smaller.

Figure 1B:
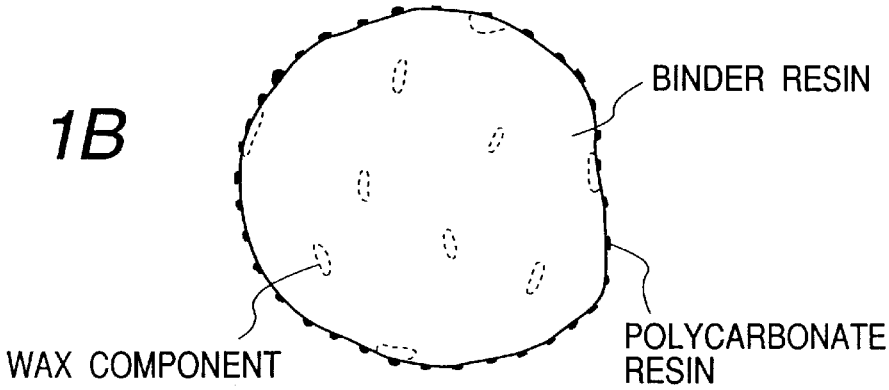
Figure 1C:
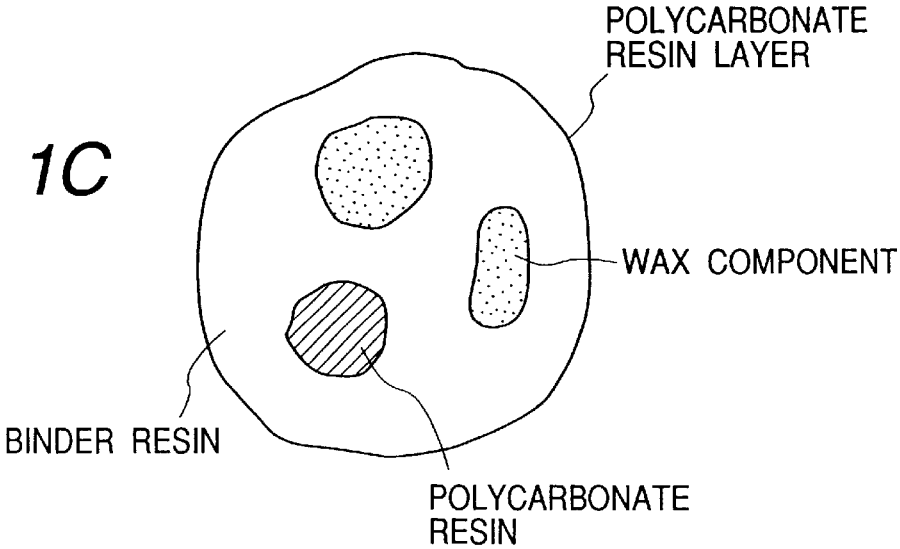

In the present invention, cross sections of the toner particles can be observed by, for example, a method in which toner particles are well dispersed in an epoxy resin curable at room temperature, followed by curing in an environment of temperature 40° C. for 2 days, and the cured product obtained is dyed with triruthenium tetraoxide, optionally in combination with triosmium tetraoxide, and thereafter samples are cut out in slices by means of a microtome having a diamond cutter to observe the cross-sectional forms of toner particles using a transmission electron microscope (TEM). In the present invention, it is preferable to use the triruthenium tetraoxide dyeing method in order to form a contrast between the materials by utilizing a difference in crystallinity between the wax component used and the resin constituting the shell. Typical examples are shown in FIGS. 1A to 1C.

Cross sections of toner particles (13), (15) and (17) obtained in Examples 12, 14 and 16 given later were observed with TEM. As a result, in the case of the toner particles (13), the polycarbonate resin was present on the surfaces of toner particles continuously (FIG. 1A). In the case of the toner particles (15), the polycarbonate resin was present on the surfaces of toner particles discontinuously (FIG. 1B). In the case of the toner particles (17), the polycarbonate resin was present on the surfaces of toner particles continuously and, in their interiors, the binder resin obtained from vinyl monomers, the polycarbonate resin and the wax component were present, where the wax component was seen to stand dispersed in the binder resin in the form of substantially spherical or spindle-shaped islands (FIG. 1C).

When the suspension polymerization is used as the method of producing the toner, the particle size distribution and particle diameter of the toner particles may be controlled by a method in which the types and amounts of a slightly water-soluble inorganic salt and a dispersant having the action of protective colloids are changed, or by controlling the mechanical conditions (e.g., the peripheral speed of a rotor, pass times, the shape of agitating blades and the shape of a reaction vessel) or the concentration of solid matter in the aqueous medium, whereby the desired toner particles can be obtained.

When the toner is directly produced by polymerization, the polymerization initiator used may include azo or diazo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide. The polymerization initiator may usually be used in an amount of from 0.5 to 20% by weight based on the weight of the polymerizable monomers, which varies depending on the intended degree of polymerization. The polymerization initiator may a little differ in its type depending on the methods for polymerization, and may be used alone or in the form of a mixture, taking into account its 10-hour half-life period temperature.

In order to control the degree of polymerization, any known cross-linking agent, chain transfer agent and polymerization inhibitor may further be added.

When the suspension polymerization making use of a dispersion stabilizer is used as the process for producing the toner, usable dispersion stabilizers may include, as inorganic compounds, tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina. As organic compounds, they may include polyvinyl alcohol, gelatin, methyl cellulose, methyl hydroxypropyl cellulose, ethyl cellulose, carboxymethyl cellulose sodium salt, polyacrylic acid and salts thereof, and starch. Any of these may be dispersed in an aqueous phase when used. These dispersion stabilizers may preferably be used in an amount of from 0.2 to 20 parts by weight based on 100 parts by weight of the polymerizable monomers.

When the inorganic compounds are used as the dispersion stabilizers, those commercially available may be used as they are. In order to obtain fine particles, however, fine particles of the inorganic compound may be formed in the dispersion medium. For example, in the case of tricalcium phosphate, an aqueous sodium phosphate solution and an aqueous calcium chloride solution may be mixed under high-speed agitation.

In order to finely dispersing these dispersion stabilizers, 0.001 to 0.1% by weight of a surface-active agent may be used in combination. This is to accelerate the intended action of the above dispersion stabilizers, and such active agent may include, e.g., sodium dodecylbenzenesulfate, sodium tetradecylsulfate, sodium pentadecylsulfate, sodium octylsulfate, sodium oleate, sodium laurate, potassium stearate and calcium oleate.

When the direct polymerization is used as a process for producing the toner used in the present invention, the following production process may be carried out.

A monomer composition containing polymerizable monomers and the wax component added therein, the colorant, the charge control agent, the polymerization initiator and other additives, having been uniformly dissolved or dispersed by means of a homogenizer or an ultrasonic dispersion machine, is dispersed in an aqueous medium containing the dispersion stabilizer, by means of a conventional stirrer, a homomixer, a homogenizer or the like. Granulation is carried out preferably while controlling the agitation speed and agitation time so that droplets of the monomer composition can have the desired toner particle size. After the granulation, agitation may be carried out to such an extent that the state of particles is maintained and the particles can be prevented from settling by the acton of the dispersion stabilizer. The polymerization may be carried out at a polymerization temperature set at 40° C. or above, usually from 50 to 90° C. At the latter half of the polymerization, the temperature may be raised, and also the aqueous medium may be removed in part from the reaction system at the latter half of the reaction or after the reaction has been completed, in order to remove unreacted polymerizable monomers, by-products and so forth so that the running performance can be improved in the image forming method of the present invention. After the reaction has been completed, the toner particles formed are collected by washing and filtration, followed by drying. In such suspension polymerization, water may usually be used as a dispersion medium preferably in an amount of from 300 to 3,000 parts by weight based on 100 parts by weight of the monomer composition.

It is essential for the toner of the present invention to contain the polycarbonate resin in an amount of from 0.1 to 50% by weight based on the weight of the binder resin. This polycarbonate resin can also be qualitatively and quantitatively analyzed by various methods. For example, the toner may be analyzed by spectroscopy such as nuclear magnetic resonance spectroscopy ($^{1}$H-NMR, $^{13}$C-NMR), infrared absorption spectroscopy (IR), Raman spectroscopy, ultraviolet absorption spectroscopy (UV) or mass spectroscopy (MS), elementary analysis, and other chemical analyses. When it is difficult for the toner to be analyzed by itself, the toner may be subjected to Soxhlet extraction with a solvent capable of dissolving binder resin, such as tetrahydrofuran or toluene, the filtrate obtained may be concentrated with an evaporator, and thereafter the above analysis may be carried out. Various analytical means may also be employed; e.g., a sample separated and collected by GPC or a sample extracted with a single or mixed solvent may be analyzed by the above method. Any of these analytical means may be used alone, or in combination.

In the toner of the present invention, in order to improve charge stability, developing performance, fluidity and running performance, an inorganic fine powder may preferably be used as an additive and mixed with the toner particles.

The inorganic fine powder used in the present invention may include fine silica powder, fine titanium powder and fine alumina powder. In particular, those having a specific surface area, as measured by the BET method using nitrogen gas absorption, of 30 $m^2/g$ or above (and particularly ranging from 50 to 400 $m^2/g$) can give good results. The inorganic fine powder may be used in an amount of from 0.01 to 8 parts by weight, and preferably from 0.1 to 5 parts by weight, based on 100 parts by weight the toner particles.

For the purposes of imparting hydrophobicity and controling chargeability, the inorganic fine powder used in the present invention may preferably be treated, if necessary, with a treating agent such as silicone varnish, various kinds of modified silicone varnish, silicone oil, various kinds of modified silicone oil, a silane coupling agent, a silane coupling agent having a functional group, or other organosilicon compounds.

Other additives may include lubricants such as Teflon, zinc stearate and polyvinylidene fluoride (in particular, polyvinylidene fluoride is preferred); abrasives such as cerium oxide, silicon carbide and strontium titanate (in particular, strontium titanate is preferred); anti-caking agents; conductivity-providing agents such as carbon black, zinc oxide, antimony oxide and tin oxide; and developing performance improvers such as white fine powder or black fine powder with a polarity reverse to that of toner particles.

In the present invention, in the case of the toner produced by stirring and mixing the inorganic fine powder and other additives, the various physical properties possessed by the toner particles may be measured using toner particles from which the inorganic fine powder and other additives have been removed. There are no particular limitations on how to remove the inorganic fine powder and other additives. For example, these may be removed by washing the toner with water in the following way.

In a water to which a surface-active agent such as sodium dodecylbenzenesulfonate has been added, the toner is added, which are then thoroughly stirred and mixed. Upon this operation, the inorganic fine powder and other additives which have relatively large particle diameters come apart from the toner particles and the inorganic fine powder and other additives are separately dispersed in water. Then, the toner particles are isolated from this mixed dispersion. As a method of isolation, for example, filtration may be carried out using a filter paper having appropriate seive opening, whereby the toner particles can be separated on the filter paper and the inorganic fine powder and other additives can be separated in the filtrate as an aqueous solution containing them. As another method of isolation, a method may also be employed in which the mixed dispersion is subjected to wet-process classification to isolate the toner particles.

In the present invention, the toner may be used as a one-component developer, or may be used in combination with a carrier so as to be used as a two-component developer. The carrier may include iron powder, magnetite powder, ferrite powder, glass beads and those obtained by dispersing magnetic powder in resin. These carriers may optionally be coated with a resin on their particle surfaces. The resin used here may include fluorine-containing resins, phenol resins, styrene resins, acrylic resins, styrene-acrylate copolymers, polyolefin resins and silicone resins. Any of these coating resins may be used alone or in combination. The toner and the carrier may be blended in such a proportion that the toner in the developer is in a concentration of from 1 to 15% by weight, and preferably from 2 to 13% by weight, to obtain good results.

The image forming method to which the toner of the present invention is applied will be described below with reference to the accompanying drawings.

Figure 2:
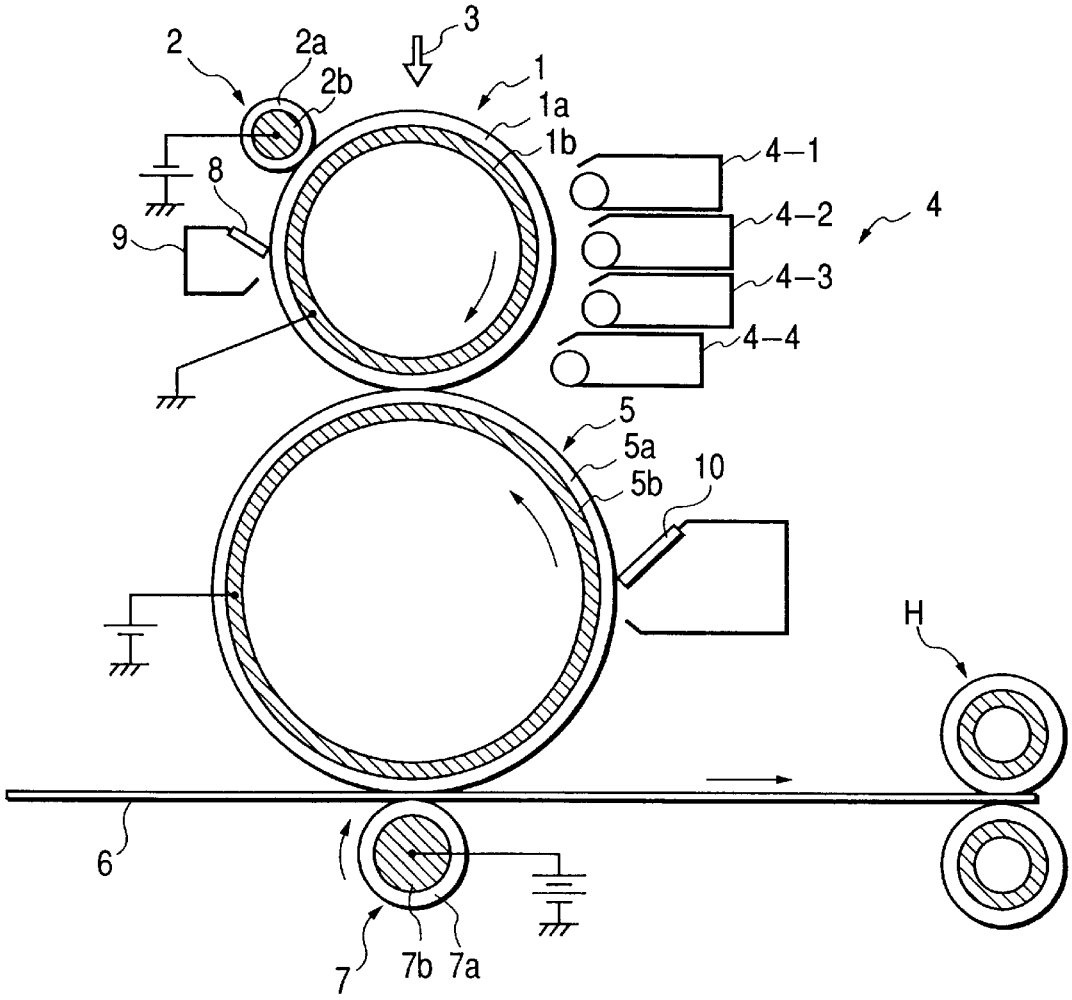
FIG. 2 is a schematic illustration of an image forming apparatus preferably used in the present invention.

In the apparatus system shown in FIG. 2, a developer having a cyan toner, a developer having a magenta toner, a developer having a yellow toner and a developer having a magnetic black toner are put into developing assemblies 4-1, 4-2, 4-3 and 4-4, respectively. Electrostatic latent images formed on an electrostatic latent image bearing member (e.g., photosensitive drum) 1 are developed by magnetic brush development or non-magnetic one-component development to form toner images of respective colors on the photosensitive drum 1.

Figure 3:
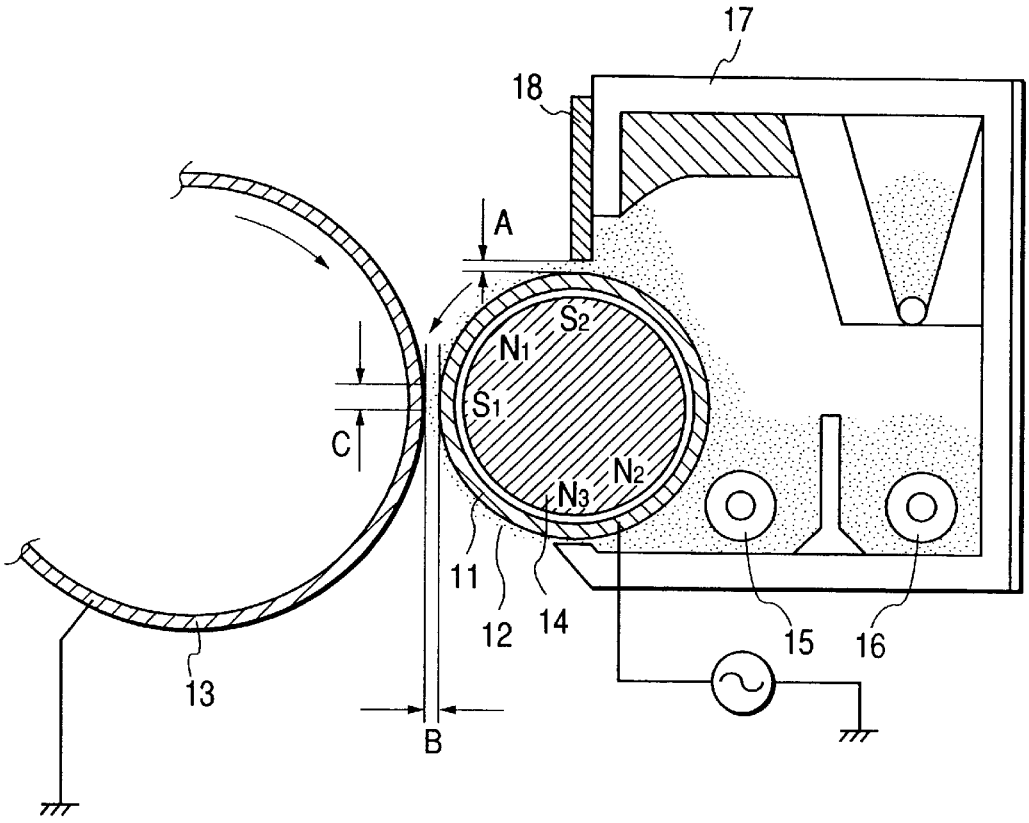
FIG. 3 is an enlarged cross section of the main part of a developing assembly for two-component development used in Examples of the present invention.

The toner of the present invention may be mixed with a magnetic carrier so that development can be made using, e.g., a developing means of a two-component development system as shown in FIG. 3. Specifically, the development may preferably be carried out while applying an alternating electric field and in such a state that a magnetic brush formed of the toner and the magnetic carrier comes into touch with a photosensitive drum 13. A distance B between a developer carrying member (developing sleeve) 11 and the photosensitive drum 13 (distance between S-D) may preferably be from 100 to 1,000 $\mu$m. This is desirable for preventing carrier adhesion and improving dot reproducibility. If it is smaller (i.e., the gap is narrower) than 100 $\mu$m, the developer tends to be insufficiently fed, resulting in a low image density. If it is larger than 1,000 $\mu$m, magnetic lines of force from the magnet S1 may expand to allow the magnetic brush to have a low density, resulting in poor dot reproducibility, or to weaken the force of binding the carrier, tending to cause carrier adhesion.

The alternating electric field may preferably be applied at a peak-to-peak voltage (Vpp) of from 500 to 5,000 V and a frequency (f) of from 500 to 10,000 Hz, and preferably from 500 to 3,000 Hz, which may each be applied to the process under appropriate selection. In this instance, the waveform used may be selected from triangular waveform, rectangular waveform, sinusoidal waveform, or waveform with a varied duty ratio. If the peak-to-peak voltage is lower than 500 V, a sufficient image density is difficult to attain, and fogging toner at non-image areas may not be well collected in some cases. If the peak-to-peak voltage is higher than 5,000 V, the electrostatic latent image may be disordered through the magnetic brush to cause a lowering of image quality.

If the frequency (f) is lower than 500 Hz, electric charges may be injected into the carrier, while relating to the process speed, so that carrier adhesion may occur or latent images may be disordered to cause a lowering of image quality. If the frequency (f) is higher than 10,000 Hz, the toner can not follow the electric field to tend to cause a lowering of image quality.

The use of a two-component developer having a toner well charged enables a fog take-off voltage (Vback) to be lowered, and enables the photosensitive member to be low charged in its primary charging, thus the photosensitive member can be made to have a longer lifetime. The Vback may preferably be 150 V or below, and more preferably 100 V or below, while depending upon the development system.

As contrast potential, a potential of from 200 V to 500 V may preferably be used so that a sufficient image density can be achieved.

In order to carry out development realizing a sufficient image density, achieving a superior dot reproducibility and free of carrier adhesion, the magnetic brush on the developing sleeve 11 may preferably be made to come into touch with the photosensitive drum 13 at a width (developing nip C) of from 3 to 8 mm. If the developing nip C is narrower than 3 mm, it may be difficult to realize sufficient image density and dot reproducibility. If it is broader than 8 mm, the developer may be packed into the nip to cause the machine to stop from operating, or it may be difficult to well prevent the carrier adhesion. As methods for adjusting the developing nip, the nip width may appropriately be adjusted by adjusting the distance A between a developer-regulating blade 18 and the developing sleeve 11, or by adjusting the distance B between the developing sleeve 11 and the photosensitive drum 13.

In the formation of full-color images which attaches importance to halftones, three or more developing assemblies for magenta, cyan and yellow may be used, and the developer and developing process making use of the toner of the present invention may be used, especially in combination with a development system in which digital latent images are formed. Thus, the latent images are not affected by the magnetic brush and are not disordered, and hence can be developed faithfully to the dot images. Also in the transfer step, the use of the toner of the present invention allows a high transfer efficiency to be achieved, and therefore enables a high image quality in both halftone areas and solid areas to be achieved.

In addition, concurrently with achievement of a high image quality at the initial stage, the use of the toner of the present invention can well bring out the effect of the present invention without any lowering of image quality even in many-sheet copying.

The toner of the present invention may preferably be used also in development means of a one-component development system. An example of an apparatus for developing electrostatic latent images formed on the electrostatic latent image bearing member by the use of a one-component developer is shown below. Examples are not necessarily limited to the following.

Figure 4:
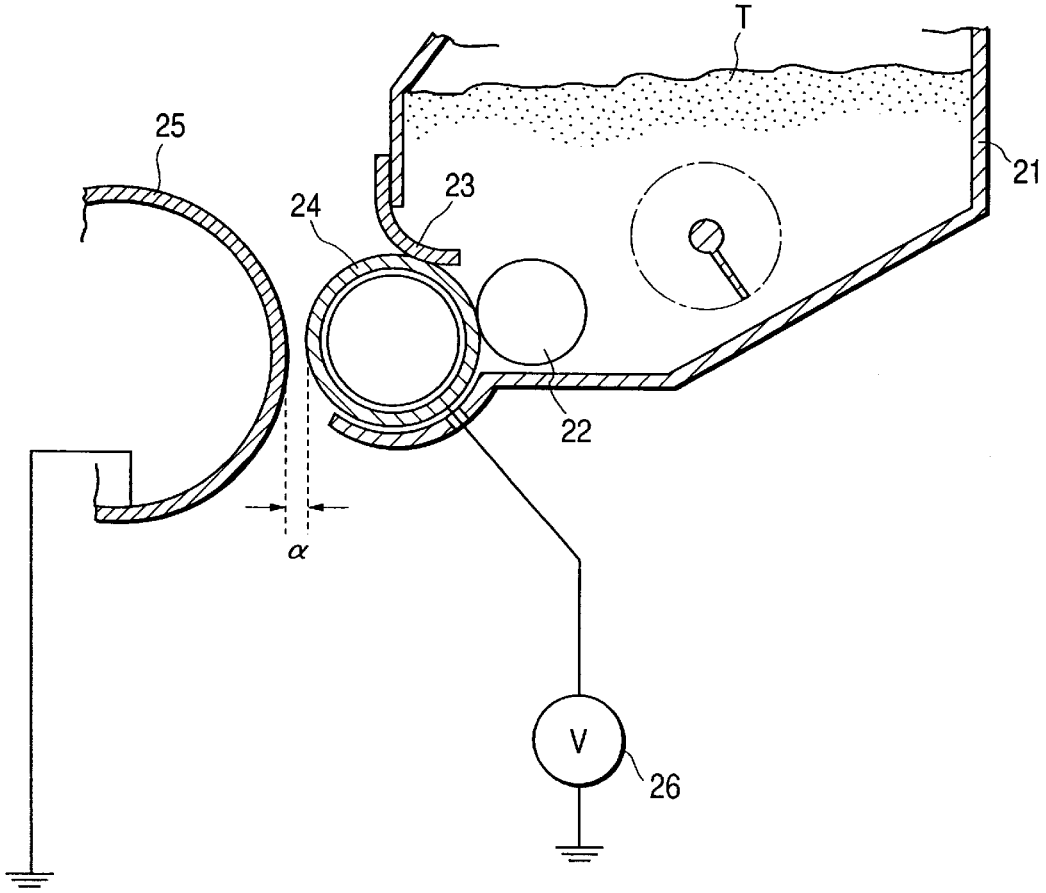
FIG. 4 is an enlarged cross section of the main part of a developing assembly for one-component development used in Examples of the present invention.

In FIG. 4, reference numeral 25 denotes an electrostatic latent image bearing member (photosensitive drum). Latent images are formed by electrophotographic processing means or electrostatic recording means. Reference numeral 24 denotes a toner carrying member (developing sleeve) formed out of a non-magnetic sleeve made of an aluminum or stainless steel sheet.

Substantially the right half of the periphery of the toner carrying member 24 always comes into contact with a toner reservoir inside a toner container 21, and the toner in the vicinity of the toner carrying member 24 is attracted and held on the toner carrying member surface by the aid of a magnetic force and/or electrostatic force produced by the magnetism generating means set in the toner carrying member.

In the present invention, the toner carrying member may preferably have a surface roughness Ra ($\mu$m) so set as to be not larger than 1.5, preferably not larger than 1.0, and more preferably not larger than 0.5.

When the surface roughness Ra is set not larger than 1.5, the toner particles transport performance the toner carrying member has, can be controlled, the toner layer formed on the toner carrying member can be made thinner and also the times the toner carrying member comes into contact with the toner increases, and hence the charging performance of the toner can also be improved to cooperatively bring about an improvement in image quality.

If the toner carrying member has a surface roughness Ra larger than 1.5, it is difficult that not only the toner layer on the toner carrying member can be made thin, but also the charging performance of the toner may lower, thus no improvement in image quality can be expected.

In the present invention, the surface roughness Ra of the toner carrying member corresponds to centerline average roughness measured using a surface roughness measuring device (SURFCOADER SE-30H, manufactured by K.K. Kosaka Kenkyusho) according to JIS surface roughness "JIS B-0601"). Stated specifically, a portion of 2.5 mm is drawn out of the roughness curve, setting a measurement length a in the direction of its centerline. When the centerline of this drawn-out portion is represented by X axis, the direction of lengthwise magnification by Y axis, and the roughness curve by y=f(x), the value determined according to the following expression and indicated in micrometer ($\mu$m) is the surface roughness Ra.

$$Ra = \frac{1}{a}\int_0^a |f(x)|dx$$

As the toner carrying member used in the present invention, a cylindrical or belt-like member made of, e.g., a non-magnetic metal such as stainless steel or aluminum may preferably be used. If necessary, a metal or resin coat may be provided on the substrate surface, or the substate surface may be coated with a resin in which fine particles of resin, metal, carbon black or charge control agent have been dispersed.

In the present invention, the speed of surface movement of the toner carrying member may be set 1.05 to 3.0 times the speed of surface movement of the electrostatic latent image bearing member, whereby the toner layer on the toner carrying member can have an appropriate agitation effect and hence the faithful reproduction of the electrostatic latent image can be more improved.

If the speed of surface movement of the toner carrying member is less than 1.05 times the speed of surface movement of the electrostatic latent image bearing member, the agitation effect on the toner layer may become insufficient, so that it may become difficult to form good images. Also, when images requiring a large quantity of toner over a wide area are developed as in the case of solid black images, the quantity of toner fed to the electrostatic latent image tends to become shortm, resulting in an insufficient image density. If the speed of surface movement of the toner carrying member is more than 3.0 times the speed of surface movement of the electrostatic latent image bearing member, not only various problems caused by excessive charging of toner as stated above but also the deterioration of toner due to mechanical stress or the sticking of toner to the toner carrying member tend to occur undesirably.

The toner, T, is stored in a hopper 21, and fed onto the developing sleeve 24 by means of a feed member 22. As the feed member, a feed roller comprised of a porous elastic material as exemplified by a foamed material such as soft polyurethane foam may preferably be used. The feed roller may be rotated at a relative speed that is not zero in the fair (or forward) direction or adverse (or backward) direction with respect to the developing sleeve so that the toner can be fed onto the developing sleeve and also the toner remaining on the developing sleeve (the toner not participating in development) can be stripped off. In this instance, taking into account the balance between the feeding and stripping of the toner, the feed roller may be brought into contact with the developing sleeve at a width (a nip) of from 2.0 to 10.0 mm, and more preferably from 4.0 to 6.0 mm. On the other hand, this inevitably imposes an excess stress to the toner to tend to cause an increase in agglomeration due to the deterioration of toner, or cause the melt-adhesion or sticking of toner to the developing sleeve and feed roller. However, since the toner used in the developing process of the present invention has excellent fluidity and releasability and has a running stability, the toner is preferably usable also in the developing system having such a feed member. A brush member made of resin fiber such as nylon or Rayon may also be used as the feed member. Such a feed member is very effective in a non-magnetic one-component development carried out using a non-magnetic one-component developer (non-magnetic toner), in which any magnetic binding force can not be utilized. It may also be used in a magnetic one-component development carried out using a magnetic one-component developer (magnetic toner).

The toner fed onto the developing sleeve is applied in a thin layer and uniformly by a regulation member. The regulation member for making thin toner layer is a doctor blade such as a metal blade or magnetic blade provided at a given interval with the developing sleeve. Alternatively, in place of the doctor blade, a rigid-material roller or sleeve made of metal, resin or ceramic may be used, and a magnetism generating means may be provided in the inside thereof.

An elastic member such as an elastic blade or an elastic roller for applying the toner under pressure contact may be used as the regulation member for making a thin toner layer. For example, as shown FIG. 4, an elastic blade 23 is, at its upper side base portion, fixed and held on the side of a hopper (developer container) 21 and is so provided that its blade inner face side (or its outer face side in the case of the adverse direction) is, at its lower side, brought into touch with the surface of the developing sleeve 24 under an appropriate elastic pressure in such a state that it is deflected against the elasticity of the blade in the fair direction or adverse direction of the rotation of the developing sleeve. According to such constitution, a toner layer can be formed which is stable even against environmental variations and is dense. The reason therefor is not necessarily clear, and it is presumed that the toner is forcibly brought into friction with the developing sleeve surface by the elastic member and hence the toner is charged always in the same state without regard to any changes in behavior caused by environmental changes of toner.

On the other hand, the toner tends to be so excessively charged that it tends to melt-adhere to the developing sleeve or elastic blade. However, the toner of the present invention can be preferably used because it has a superior releasability and has a stable triboelectric chargeability.

As the elastic blade, it is preferable to select a material of triboelectric series suitable for electrostatically charging the toner to the desired polarity, which includes rubber elastic materials such as silicone rubber, urethane rubber or NBR; synthetic resin elastic materials such as polyethylene terephthalate; and metal elastic materials such as stainless steel, steel and phosphor bronze, as well as composite materials thereof, any of which may be used.

In instances where the elastic member and the developing sleeve are required to have a durability, resin or rubber may preferably be stuck or applied to, the metal elastic material so as to touch the part coming into contact with the sleeve.

An organic or inorganic substance may be added to, may be melt-mixed in, or may be dispersed in, the elastic member. For example, any of metal oxides, metal powders, ceramics, carbon allotropes, whiskers, inorganic fibers, dyes, pigments and surface-active agents may be added so that the charging performance of the toner can be controlled. Especially when the elastic member is formed of of a molded product of rubber or resin, a fine metal oxide powder such as silica, alumina, titania, tin oxide, zirconium oxide or zinc oxide, carbon black, or a charge control agent commonly used in toners may preferably be incorporated therein.

A DC electric field and/or an AC electric field may also be applied to a developing blade serving as the regulation member, a feed roller as the feed member and a brush member, whereby the uniform thin-layer coating performance and uniform chargeability can be more improved at the regulated part on the developing sleeve because of the loosening action acting on the toner and the toner can be smoothly fed and stripped off, so that a sufficient image density can be achieved and images with a good quality can be formed.

It is effective for the elastic member to be brought into touch with the toner carrying member (developing sleeve) at a pressure of 0.1 kg/m or above, preferably from 0.3 to 25 kg/m, and more preferably from 0.5 to 12 kg/cm, as a linear pressure in the generatrix direction of the toner carrying member. This makes it possible to effectively loosen the agglomeration of toner and makes it possible to effect instantaneous rise of the charge quantity of toner. If the touch pressure is smaller than 0.1 kg/m, it is difficult to uniformly apply the toner, resulting in a broad charge quantity distribution of the toner to cause fog or black spots around line images. If the touch pressure is too large, a great pressure is applied to the toner to cause deterioration of the toner and occurrence of agglomerates of the toner, and also a great torque is required in order to drive the toner carrying member, undesirably.

The gap $\alpha$ between the electrostatic latent image bearing member and the toner carrying member may preferably be set to be from 50 to 500 $\mu$m, and the gap between the doctor blade and the toner carrying member may preferably be set to be from 50 to 400 $\mu$m.

The layer thickness of the toner layer formed on the toner carrying member may preferably be made smaller than the gap $\alpha$ between the electrostatic latent image bearing member and the toner carrying member. In some cases, the layer thickness of the toner layer may be regulated in such an extent that part of a large number of toner ears constituting the toner layer comes into contact with the surface of the electrostatic latent image bearing member.

An alternating electric field may be applied across the toner carrying member and the electrostatic latent image bearing member by a bias power source 26. This makes it easy for the toner to move from the toner carrying member to the electrostatic latent image bearing member and to form images with a much higher image quality. The alternating electric field may preferably be applied at Vpp of 100 V or above, preferably from 200 to 3,000 V, and more preferably from 300 to 2,000 V. It may also preferably be applied at a frequency (f) of from 500 to 5,000 Hz, more preferably from 1,000 to 3,000 Hz, and still more preferably from 1,500 to 3,000 Hz. As the waveform of this electric field, rectangular waveform, sine waveform, sawtooth waveform and triangle waveform may be used. An asymmetrical AC bias having different time for which regular/reverse voltages are applied may also be used. It is also preferable to use a bias formed by superimposing an AC bias to a DC bias.

In the apparatus shown in FIG. 2, the electrostatic latent image bearing member 1 is a photosensitive drum or photosensitive belt having a photoconductive insulating material layer formed of $\alpha$-Se, CdS, $ZnO_2$, OPC or a-Si. The electrostatic latent image bearing member 1 is rotated driven by means of a drive system (not shown) in the direction of an arrow.

As the electrostatic latent image bearing member 1, a photosensitive member having an amorphous silicon photosensitive layer or an organic photosensitive layer may preferably be used.

The organic photosensitive layer may be of a single-layer type in which the photosensitive layer contains a charge generating material and a charge transporting material in the same layer, or may be a function-separated photosensitive layer comprised of a charge transport layer and a charge generation layer. A multi-layer type photosensitive layer comprising a conductive substrate, and the charge generation layer and the charge transport layer superposed thereon in this order is one of preferred examples.

As binder resins for the organic photosensitive layer, polycarbonate resins, polyester resins or acrylic resins may preferably be used because they provide a good transfer performance and a good cleaning performance, and may hardly cause faulty cleaning, melt-adhesion of toner to the photosensitive member and filming of external additives.

The step of charging has a non-contact type charging system making use of a corona charging assembly and being in non-contact with the electrostatic latent image bearing member 1, or a contact type charging system making use of a contact charging member such as a charging roller being in contact with the electrostatic latent image bearing member 1. Either may be used. The contact charging system as shown in FIG. 2 may preferably be used so as to enable efficient and uniform charging, simplify the system and make ozone less occur.

A charging roller 2 is constituted basically of a mandrel 2*b* at the center and a conductive elastic layer 2*a* that forms the periphery of the former. The charging roller 2 is brought into pressure contact with the surface of the electrostatic latent image bearing member 1 and is rotated following the rotation of the electrostatic latent image bearing member 1.

When the charging roller is used, the charging process may preferably be performed under conditions of a roller contact pressure of 5 to 500 g/cm, and an AC voltage of 0.5 to 5 kVpp, an AC frequency of 50 Hz to 5 kHz and a DC voltage of ±0.2 to ±1.5 kV when a charging bias formed by superimposing an AC voltage on a DC voltage is applied, and a DC voltage of from ±0.2 to ±5 kV when only a DC voltage is applied as a charging bias.

As a charging means other than the charging roller, there are a method making use of a charging blade and a method making use of a conductive brush. These contact charging means have such effects that high voltage is not required and ozone generation is less.

The charging roller and charging blade as contact charging means may preferably be made of a conductive rubber, and a release coat may be provided on its surface. The release coat may be formed out of a nylon resin, PVDF (polyvinylidene fluoride) or PVDC (polyvinylidene chloride), any of which may be used.

The toner image on the electrostatic latent image bearing member is primarily transferred to an intermediate transfer member 5 to which a voltage (e.g., ±0.1 to ±5 kV) is applied. The surface of the electrostatic latent image bearing member is cleaned by a cleaning means 9 having a cleaning blade 8.

The intermediate transfer member 5 is comprised of a pipe-like conductive mandrel 5*b* and a medium-resistance elastic material layer 5*a* formed on its periphery. The mandrel 5*b* may comprise a plastic pipe provided thereon with a conductive coating.

The medium-resistance elastic material layer 5*a* is a solid or foamed-material layer made of an elastic material such as silicone rubber, Teflon rubber, chloroprene rubber, urethane rubber or EPDM (an ethylene-propylene-diene terpolymer) in which a conductivity-providing agent such as carbon black, zinc oxide, tin oxide or silicon carbide has been mixed and dispersed to adjust electrical resistance (volume resistivity) to a medium resistance of from $10^5$ to $10^{11}$ Ω·cm.

The intermediate transfer member 5 is provided in contact with the bottom part of the electrostatic latent image bearing member, being axially supported in parallel with the electrostatic latent image bearing member 1, and is rotated at the same peripheral speed as the electrostatic latent image bearing member 1 in the anti-clockwise direction as shown by an arrow.

The first-color toner image formed and held on the surface of the electrostatic latent image bearing member 1 is, while passing through the transfer nip portion where the electrostatic latent image bearing member 1 and the intermediate transfer member 5 come into contact, intermediately sequencially transferred to the periphery of the intermediate transfer member 5 by the aid of the electric filed formed at the transfer nip portion by a transfer bias applied to the intermediate transfer member 5.

If necessary, after the toner image has been transferred to the recording medium, the surface of the intermediate transfer member 5 may be cleaned by a detachable cleaning means 10. When the toner is present on the intermediate transfer member 5, the cleaning means 10 is detached from the surface of the intermediate transfer member so that the toner image is not disturbed.

A transfer means 7 is provided in contact with the bottom part of the intermediate transfer member 5, being axially supported in parallel with the intermediate transfer member 5. The transfer means 7 is, e.g., a transfer roller or a transfer belt, and is rotated at the same peripheral speed as the intermediate transfer member 5 in the clockwise direction as shown by an arrow. The transfer means 7 may be so provided that it comes into direct contact with the intermediate transfer member 5, or may be so disposed that a belt is brought into contact between the intermediate transfer member 5 and the transfer means 7.

In the case of the transfer roller, it is basically comprised of a mandrel 7*b* at the center and a conductive elastic layer 7*a* that forms the periphery of the former.

The intermediate transfer member and the transfer roller may be of made commonly available materials. The elastic layer of the transfer roller may be made to have a volume resistivity set smaller than the volume resistivity of the elastic layer of the intermediate transfer member, whereby the voltage applied to the transfer roller can be lessened, good toner images can be formed on the recording medium and also the recording medium can be prevented from being wound around the intermediate transfer member. In particular, the elastic layer of the intermediate transfer member may preferably have a volume resistivity at least 10 times the volume resistivity of the elastic layer of the transfer roller.

For example, a conductive elastic layer 7*b* of the transfer roller 7 is made of, e.g., an elastic material having a volume resistivity of $10^6$ to $10^{10}$ Ω·cm, such as polyurethane, or an ethylene-propylene-diene type terpolymer (EPDM), with a conductive material such as carbon dispersed therein. A bias is applied to the mandrel 7*a* by a constant voltage power source. As bias conditions, a voltage of from ±0.2 to ±10 kV is preferred.

Figure 6:
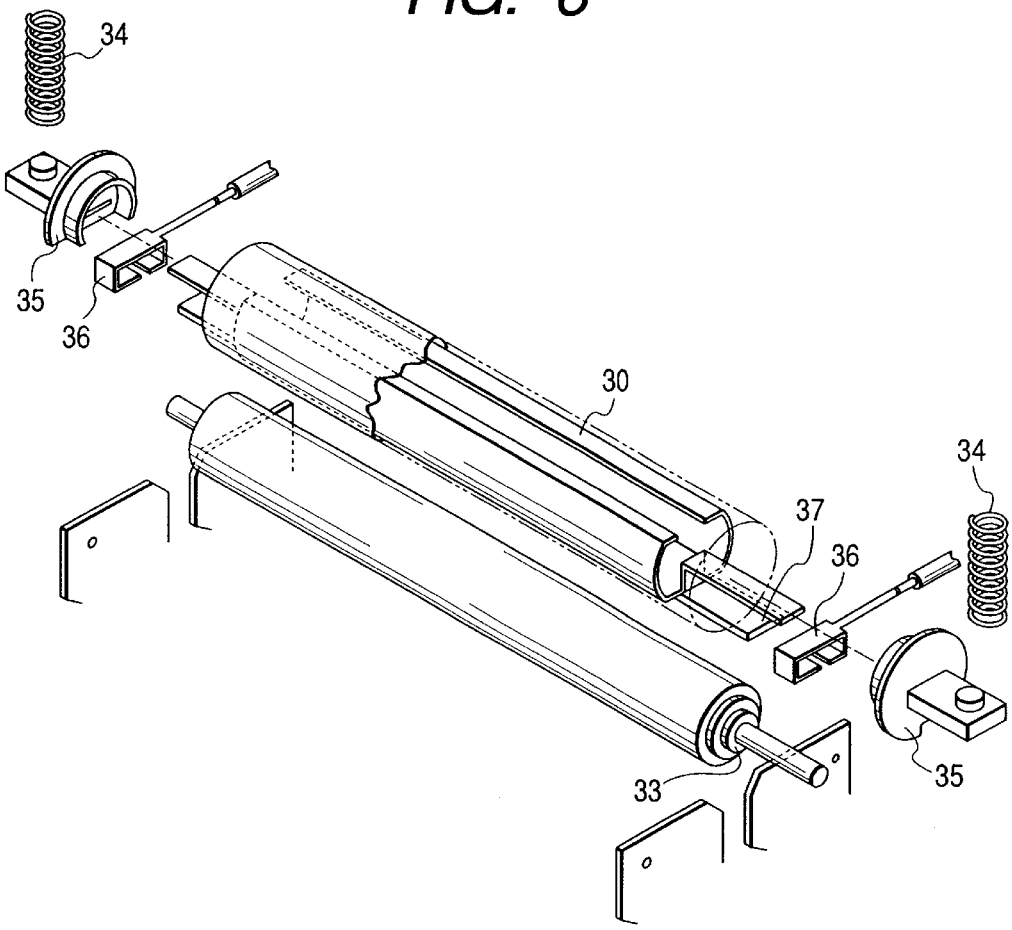
FIG. 6 is an exploded perspective view of the main part of a fixing assembly used in Examples of the present invention.
Figure 7:
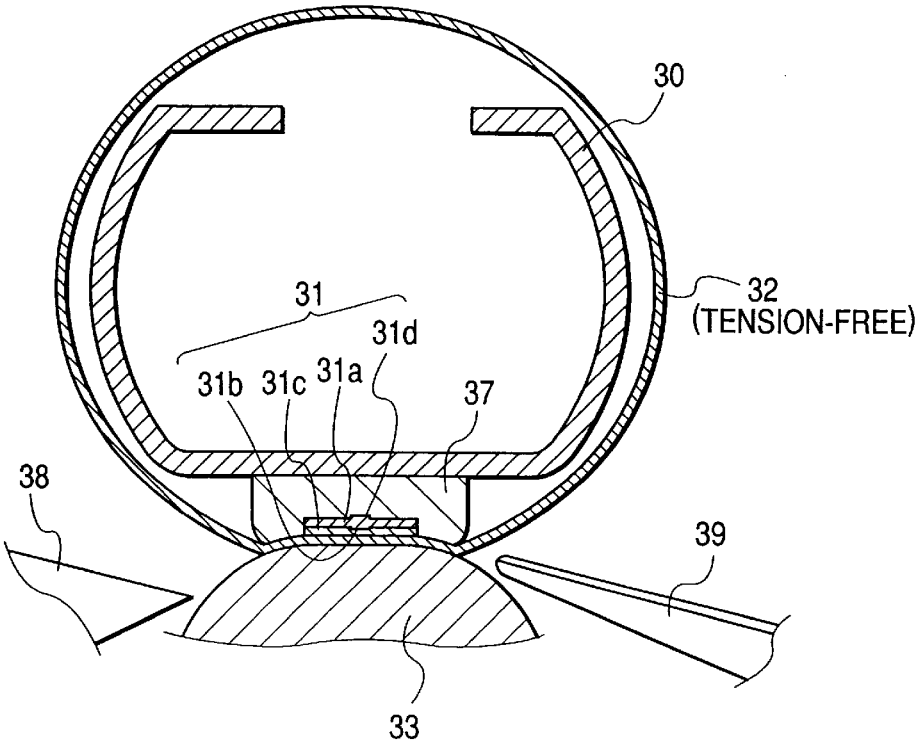
FIG. 7 is an enlarged transverse cross section showing a state of a film when a fixing assembly used in Examples of the present invention stands not driven.

The toner image on the recording medium 6 is fixed by means of a heat-and-pressure fixing means. The heat-and-pressure fixing means may include a heat roll system constituted basically of a heat roller internally provided with a heating element such as a halogen heater and an elastic-material pressure roller brought into contact therewith under pressure, and a system in which the toner image is fixed by heat and pressure by means of a heater through a film (FIGS. 6 and 7). The toner of the present invention can well match the above heat-and-pressure fixing means because of its superior fixing performance and anti-offset properties.

With the toner of the present invention, a transfer efficiency at the transfer step is high, the toner remaining after transfer is small and cleaning performance is superior, and hence the filming may hardly occur on the electrostatic latent image bearing member. Moreover, with the toner of the present invention, the external additive is less embedded in the toner particle surfaces, and hence a good image quality can be maintained over a long period of time. Accordingly, it can be used preferably in an image forming apparatus shown in FIG. 5, having what is called the reuse mechanism in which the toner remaining on the electrostatic latent image bearing member and intermediate transfer member after transfer is removed by a cleaning means such as a cleaning blade, collected and reused.

Figure 5:
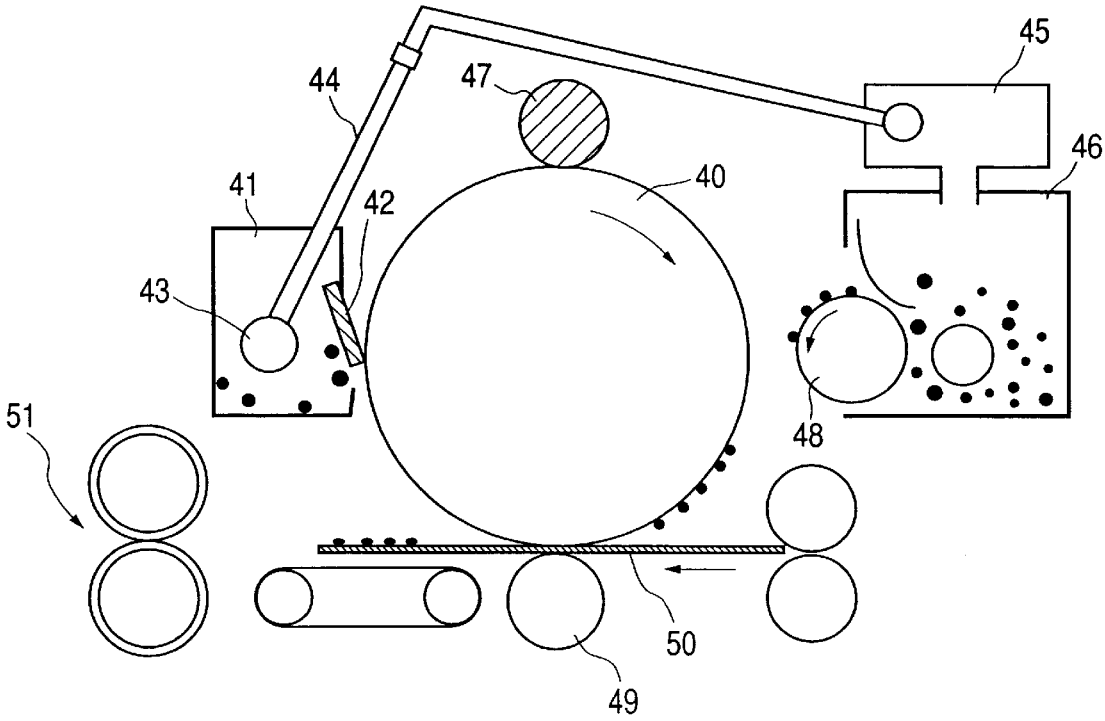
FIG. 5 is a schematic illustration of an image forming apparatus which reuses the toner remaining untransferred.

In FIG. 5, reference numeral 40 denotes a photosensitive drum serving as an electrostatic latent image bearing member; 49, a transfer roller as a transfer member with which the toner images formed on the surface of the photosensitive drum 40 are transferred to a recording medium 50; and 41, a cleaner with which the toner remaining on the surface of the photosensitive drum 40 after transfer is scraped off and collected with an elastic blade 42 serving as a cleaning blade. Reference numeral 43 denotes a cleaner screw with which the toner collected in the cleaner 41 is transported inside the cleaner 41; and 44, a feed pipe internally provided with a transport screw and through which the toner transported with the cleaner screw 43 is transported to a toner hopper 45. Reference numeral 46 denotes a developing assembly; and 48, a developing sleeve as a developer carrying member for carrying and transporting thereon the developer held in the developing assembly. Reference numeral 47 denotes a charging roller for primarily charging the photosensitive drum 40.

In this image forming appratus, the photosensitive drum 40 is primarily electrostatically charged with the primary charging roller 47, and an electrostatic latent image is formed by an exposure means (not shown). Thereafter, this electrostatic latent image is developed by the use of the developer having the toner and carried on the developing sleeve 48 of the developing assembly 46, to form a toner image. The toner image formed on the photosensitive drum 40 is transferred to the recording medium 50 by means of the transfer roller 49, and the toner image transferred to the recording medium 50 is fixed by heat and pressure to the recording medium 50 by means of a heat roller fixing assembly 51 serving as a heat-fixing device. Meanwhile, the transfer residual toner present on the surface of the photosensitive drum 40 after transfer is scraped off with the elastic blade 42, and is once collected in the cleaner 41, which is thereafter sent inside the cleaner 41, further transported with the cleaner screw 43, passes through the feed pipe 44 provided with a transport screw, and, through the hopper 45, returned to the developing assembly 46, where the toner is again used for the development of electrostatic latent images. The image forming apparatus shown in FIG. 5 reuses the toner as described above.

The toner of the present invention has an excellent running performance because of the specific polycarbonate resin contained in it, and hence can also be applied in an image forming method employing a contact development system which requires a high running performance of toner.

A monochromatic image forming method will be described with reference to FIG. 8 where the contact development system is used and also a cleanerless process is used.

Figure 8:
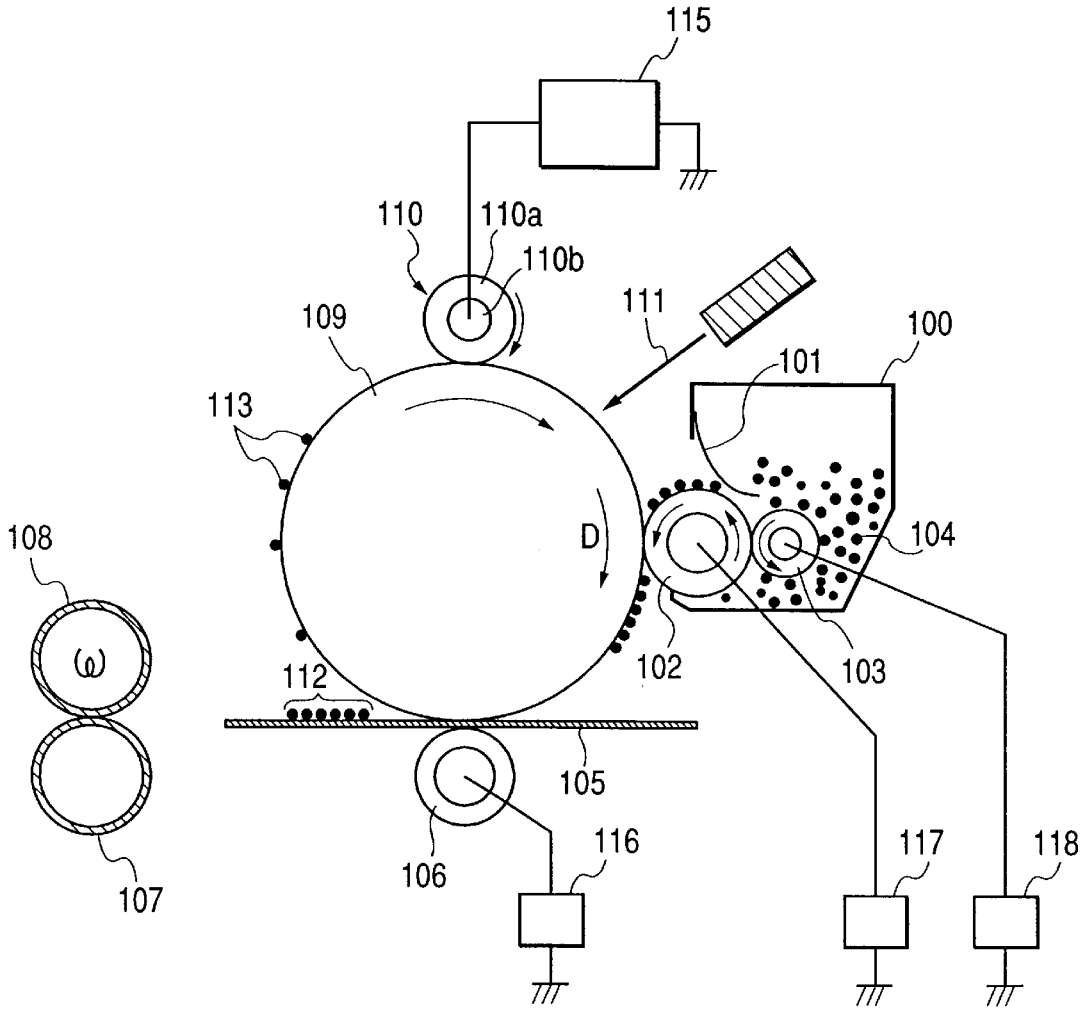
FIG. 8 is a schematic illustration of another one-component image forming apparatus preferably used in the present invention.

In FIG. 8, reference numeral 100 denotes a developing assembly; 109, a photosensitive member; 105, a recording medium such as paper; 106, a transfer member; 107, a fixing pressure roller; 108, a fixing heat roller; and 110, a primary charging member which directly charges the photosensitive member 109 in contact with it.

To the primary charging member 110, a bias power source 115 is connected so that the surface of the photosensitive member 109 is uniformly charged.

The developing assembly 100 holds a toner 104, and has a toner carrying member 102 which is rotated in the direction of an arrow in contact with the photosensitive member 109. It also has a developing blade 101 for regulating toner quantity and charging the toner, and a coating roller 103 which is rotated in the direction of an arrow in order to cause the toner 104 to adhere to the toner carrying member 102 and also charge the toner by friction with the toner carrying member 102. To the toner carrying member 102, a development bias power source 117 is connected. A bias power source 118 is also connected to the coating roller 103, where a voltage is set on the negative side with respect to the development bias when a negatively chargeable toner is used and on the positive side with respect to the development bias when a positively chargeable toner is used.

A power source 116 for transfer bias with a polarity reverse to that of the photosensitive member 109 is connected to the transfer member 106. Here, the length of rotational direction, what is called development nip width, at the contact area between the photosensitive member 109 and the toner carrying member 102 may preferably be 0.2 mm or larger and 8.0 mm or smaller. If it is smaller than 0.2 mm, the amount of development may be too insufficient to attain a satisfactory image density and also the transfer residual toner may not be well collected. If it is larger than 8.0 mm, the toner may be fed in an excessively large quantity to tend to cause fog and also to adversely affect the wear of the photosensitive member.

As the toner carrying member, an elastic roller having an elastic layer on its surface may preferably be used. As materials for the elastic layer used, those having a hardness of from 20 to 65 degrees (JIS A) may preferably be used. The toner carrying member may preferably have a resistance within the range of approximately from $10^2$ to $10^9$ Ω·cm as volume resistivity. If it has a volume resistivity lower than $10^2$ Ω·cm, there is a possibility that excess electric current flows when, e.g., the photosensitive member 109 has pinholes on its surface. If on the other hand it has a volume resistivity higher than $10^9$ Ω·cm, the toner is liable to cause charge-up due to triboelectric charging, tending to cause a decrease in image density.

The toner may preferably be applied on the toner carrying member in a quantity of from 0.1 mg/cm$^2$ to 1.5 mg/cm$^2$. If applied in a quantity less than 0.1 mg/cm$^2$, it is difficult to obtain a sufficient image density, and, in a quantity larger than 1.5 mg/cm$^2$, it is difficult to uniformly triboelectrically charge all the individual toner particles, causing poor restraint of fog. It may more preferably be applied in a quantity of from 0.2 mg/cm$^2$ to 0.9 mg/cm$^2$.

The toner coat quantity is controlled by the developing blade 101. This developing blade 101 comes into contact with the toner carrying member 102 through the toner layer at a contact pressure of from 5 g/cm to 50 g/cm as a preferable range. If the contact pressure is lower than 5 g/cm, it may be difficult not only to control the toner coat quantity but also to effect uniform triboelectric charging, causing fog to occur. If the contact pressure is higher than 50 g/cm, the toner particles may undergo an excess load to tend to cause deformation of particles or the melt-adhesion of toner to the developing blade or toner carrying member.

As a toner coat quantity regulation member, a metal blade or roller may also be used besides the elastic blade for applying the toner in pressure contact.

As the elastic regulation member, it is preferable to select a material of triboelectric series suitable for electrostatically charging the toner to the desired polarity, which includes rubber elastic materials such as silicone rubber, urethane rubber or NBR; synthetic resin elastic materials such as polyethylene terephthalate; and metal elastic materials such as stainless steel, steel and phosphor bronze, as well as composite materials thereof, any of which may be used.

In instances where the elastic regulation member and the toner carrying member are required to have a durability, resin or rubber may preferably be stuck or applied to the metal elastic material so as to touch the part coming into contact with the sleeve.

An organic or inorganic substance may be added to, may be melt-mixed in, or may be dispersed in, the elastic regulation member. For example, any of metal oxides, metal powders, ceramics, carbon allotropes, whiskers, inorganic fibers, dyes, pigments and surface-active agents may be added so that the charging performance of the toner can be controlled. Especially when the elastic member is formed of a molded product of rubber or resin, a fine metal oxide powder such as silica, alumina, titania, tin oxide, zirconium oxide or zinc oxide, carbon black, or a charge control agent commonly used in toners may preferably be incorporated therein.

A DC electric field and/or an AC electric field may also be applied to the regulation member, whereby the uniform thin-layer coating performance and uniform chargeability can be more improved because of the loosening action acting on the toner, so that a sufficient image density can be achieved and images with a good quality can be formed.

In the apparatus shown in FIG. 8, the primary charging member 110 uniformly electrostatically charges the photosensitive member 109 rotating in the direction of an arrow. The primary charging member 110 used here is a charging roller constituted basically of a mandrel 110*b* at the center and a conductive elastic layer 110*a* that forms the periphery of the former. The charging roller 110 is brought into pressure contact with the surface of the photosensitive member 109 and is rotated followingly as the photosensitive member 109 is rotated.

When the charging roller is used, the charging process may preferably be performed under the conditions of a roller contact pressure of 5 to 500 g/cm. A charging bias formed of DC voltage alone or a charging bias formed by superimposing an AC voltage on a DC voltage may be used as an applied voltage. In the present invention, though not particularly limited, the charging bias formed of DC voltage alone may preferably be used. In such an instance, the voltage may be applied at a value of from ±0.2 to ±5 kV.

As a charging means other than the charging roller, there are a method making use of a charging blade and a method making use of a conductive brush. These contact charging means have the effect of, e.g., making high voltage unnecessary and allowing ozone to less occur, compared with non-contact corona charging. The charging roller and charging blade as contact charging means may preferably be made of a conductive rubber, and a release coat may be provided on its surface. The release coat may be formed out of a nylon resin, PVDF (polyvinylidene fluoride) or PVDC (polyvinylidene chloride), any of which may be used.

Subsequently to the primary charging step, an electrostatic latent image corresponding to information signals is formed on the electrostatic latent image bearing member 109 by exposure 111 from a light-emitting device, and the electrostatic latent image is developed into a visible image by the use of the toner at the region coming into contact with the toner carrying member 102. Also, in the image forming method of the present invention, especially a development system of forming a digital latent image on the photosensitive member may be used in combination. This enables development faithful to a dot latent image because the latent image is not disordered. Next, the visible image is transferred to the recording medium 105 by means of the transfer member 106. The transferred toner image 112 is, together with the recording medium 105, further passed between the heat roller 108 and the pressure roller 107, and is fixed there, obtaining a permanent image. As the heat-and-pressure fixing means, a heat roll system constituted basically of a heat roller internally provided with a heating element such as a halogen heater and an elastic-material pressure roller brought into contact therewith under pressure, may be used, and in addition, a system in which the toner image is fixed by heat and pressure by means of a heater through a film may also be used.

In the imageforming apparatus described above, a transfer part in the transfer step and a charging part in the carging step are arranged in the named order in the moving direction of the photosensitive member 109 as an electrostatic latent image bearing member, and no cleaning member coming into contact with the surface of said electrostatic latyent image bearing member to remove the toner remaining on the surface after transfer is present between the transfer part and charging part and between the charging part and developing part.

Therefore, the transfer residual toner 113 not transferred and remaining on the photosensitive member 109 is passed between the photosensitive member 109 and the primary charging member 110, and again reaches the development nip portion, where it is collected in the developing assembly 100 by means of the toner carrying member 102.

A full-color image forming method of a contact development system making use of an intermediate transfer member will be described below.

As the whole constitution of a full-color image forming apparatus, the apparatus system shown in FIG. 2, previously described, is used.

Figure 9:
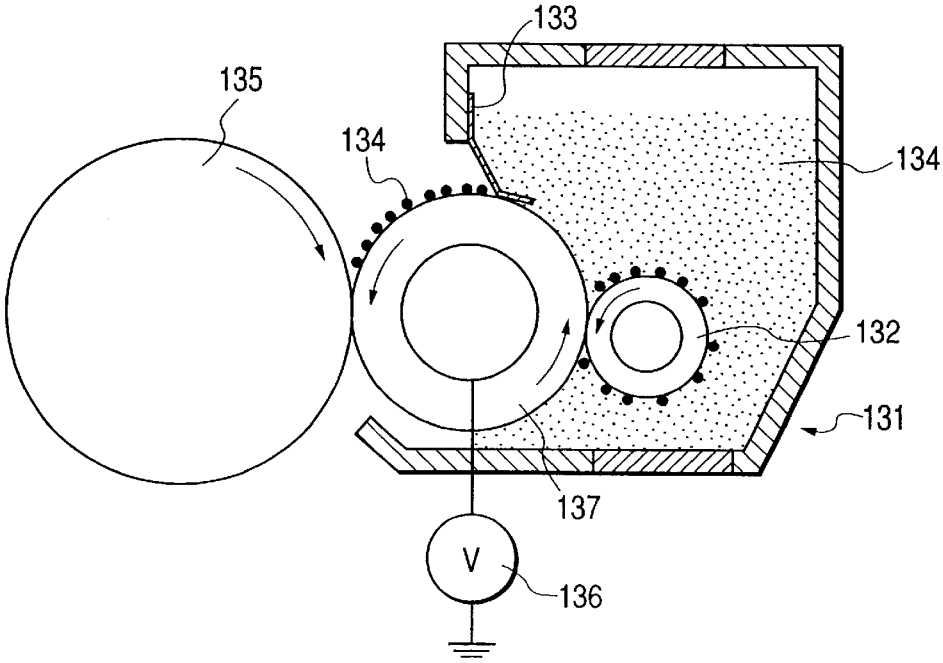
FIG. 9 is a schematic illustration of another developing assembly preferably used in the present invention.

As a developing means, development may be effected by a developing means having, e.g., a developing apparatus 131 as shown in FIG. 9. Stated specifically, the development is made in such a state that a toner 134 used as a one-component developer, fed through a coating roller 132 and whose coat layer is regulated with a developing blade 133 comes into contact with a photosensitive member 135 while a DC or alternating electric field is applied to a developer carrying member 137 from a power source 136. When the alternating electric field is applied, any of triangular waveform, rectangular waveform, sinusoidal waveform, waveform with a varied duty ratio and periodic alternating waveform may be used under appropriate selection. In the present invention, however, a DC electric filed is preferably used because the load of voltage on the photosensitive member is less, and the applied voltage is set at a suitable value between the dark potential (potential immediately after charging) and the light potential (potential after charging) on the photosensitive member.

In the developing step, the toner carrying member may be rotated in the same direction as the rotation of the photosensitive member or may be rotated in the reverse direction. When the toner carrying member is rotated in the same direction, as shown in FIG. 9, its peripheral speed may preferably be set from 1.05 to 3.0 times the peripheral speed of the photosensitive member.

If the peripheral speed is less than 1.05 times the peripheral speed of the photosensitive member, the agitation effect the toner layer undergoes may become insufficient to make it difficult to achieve a good image quality and also, when images requiring the toner in a large quantity over a wide area as in the case of solid black images are developed, the quantity of the toner fed to electrostatic latent images may become insufficient, tending to cause a decrease in image density. The higher the peripheral speed ratio is, the larger the quantity of the toner fed to the development zone is and the more frequently the toner is attached onto and detached from the latent images. Thus, the toner at the unnecessary areas is scraped off and the toner is imparted to the necessary areas; this is repeated, whereupon images faithful to the latent images are formed. From the viewpoint of the cleaning-at-development, the effect obtainable by utilizing the difference in peripheral speed to physically take the photosensitive member surface off the part to which the toner has adhered and by utilizing an electric field to collect the toner can be expected when the transfer residual toner is present on the photosensitive member in close adhesion. Accordingly, the higher the peripheral speed ratio is, the more advantageous it is for the transfer residual toner to be collected. However, if on the other hand the peripheral speed ratio is greater than 3.0, not only the various problems caused by excessive charging of toner as stated previously but also the deterioration of toner due to mechanical stress and the adhesion of toner to the toner carrying member may occur accelaratingly.

As the photosensitive member, a photosensitive drum or photosensitive belt having a photoconductive insulating material layer formed of $\alpha$-Se, CdS, $ZnO_2$, OPC or a-Si may preferably be used.

As binder resins for the organic photosensitive layer in the OPC photosensitive member, polycarbonate resins, polyester resins and acrylic resins may preferably be used because they provide a good transfer performance and a good cleaning performance, and may hardly cause faulty cleaning, melt-adhesion of toner to the photosensitive member and filming of external additives.

The toner image on the photosensitive member (electrostatic latent image bearing member) 135 is primarily transferred to the intermediate transfer member as described previously, and subsequently the image is formed in such a manner as described with reference to FIG. 2.

As conditions for the above contact developing step, it is essential that the toner layer on the toner carrying member comes into contact with the photosensitive member surface and it is preferable to use a reverse development system. Also, its use in combination with the cleanerless process in which the cleaning means such as a cleaning blade is not additionally provided and the developing assembly itself collects the transfer residual toner remaining on the photosensitive member can greatly miniaturize the apparatus. Here, at the time of development or at the blank time before and after development, a bias having a DC or AC component is applied so that the potential is controlled to enable development and collection of the toner remaining on the photosensitive member. Here, the DC component is positioned between the light-area potential and the dark-area potential.

As the toner carrying member, an elastic roller may be used and a method may be used in which the toner is applied on the elastic roller surface and the coated toner is brought into contact with the photosensitive member surface. In this instance, in the cleanerless process, the electric field acting between the photosensitive member and the elastic roller facing the photosensitive member surface through the toner is utilized to remove the transfer residual toner by cleaning in the developing step. Hence, it is necessary for the elastic roller surface or the vicinity thereof to have a potential so that an electric field is formed at a narrow gap between the photosensitive member surface and the toner carrying member surface. Accordingly, a method may also be used in which the elastic rubber of the elastic roller is controlled to have a resistance in the medium-resistance region to keep the electric field while preventing its conduction to the photosensitive member surface, or a thin-layer insulating layer is provided on the surface layer of a conductive layer. It is also possible to use a conductive resin sleeve comprising a conductive roller coated thereon with an insulating substance on its side facing the photosensitive member surface, or an insulating sleeve provided with a conductive layer on its side not facing the photosensitive member. It is still also possible to use a rigid-material roller as the toner carrying member and use a flexible member such as a belt as the photosensitive member. The developing roller as the toner carrying member may preferably have a volume resistivity in the range of from $10^2$ to $10^9$ Ω·cm.

When the contact development system described above is used and the contact charging method where the charging member is brought into contact with the photosensitive member is used as a charging means for primarily charging the photosensitive member when the cleaning-at-development is carried out, the toner remaining after cleaning may adhere to the charging member in the post-step contact charging to cause faulty charging, if usual toners are used. Accordingly, the quantity of the transfer residual toner must be made smaller than that in the corona discharging or the like where the charging means does not come into contact with the photosensitive member. Hence, in the contact charging method, it is preferable to use the toner whose SF-1, SF-2 and (SF-2)/(SF-1) have been strictly defined in the ranges previously described.

The toner according to the present invention, because of the controlling of the surface shape of toner particles, is so high in transfer efficiency in the transfer step as to leave less transfer residue, and hence has a superior cleaning performance at the time of cleaning-at-development in the developing assembly. In addition, since it contains the tough polycarbonate resin, it may hardly cause the filming on the contact charging member, photosensitive drum and intermediate transfer member. Moreover, in the toner of the present invention, even when tested on many-sheet running, the external additives are less embedded in the toner particle surfaces than conventional toners are used, and hence a good image quality can be maintained over a long period of time.

As described above, according to the present invention, the toner having a good running performance and a good transfer efficiency can be obtained by specifying the binder components in the toner composition. Moreover, the toner can be transferred at a high transfer efficiency without causing the melt-adhesion of toner particles to the contact charging member, photosensitive drum and intermediate transfer member, and can also preferably match image forming apparatus.

EXAMPLES

The present invention will be described below by giving specific examples. The present invention is by no means limited to these.

Resin (1) Production Example

Into a reaction vessel, 200 parts by weight of xylene was put, and the temperature was raised to reflux temperature. To this xylene, a mixture solution of 85 parts by weight of styrene, 15 parts by weight of n-butyl acrylate and 2 parts by weight di-tert-butyl peroxide was dropwise added. Thereafter, solution polymerization was carried out under reflux of xylene and was completed in 7 hours to obtain a low-molecular-weight resin solution.

Meanwhile, 70 parts by weight of styrene, 25 parts by weight of butyl acrylate, 5 parts by weight of monobutyl maleate, 0.2 part by weight of polyvinyl alcohol, 200 parts by weight of deaerated water and 0.1 part by weight of benzoyl peroxide were mixed and dispersed to obtain a suspension. The suspension thus obtained was heated, and was maintained at 85° C. for 24 hours in an atmosphere of nitrogen, where the polymerization was completed to obtain a high-molecular-weight resin.

30 parts by weight of the high-molecular-weight resin was put into the solution formed upon completion of the solution polymerization which contained 70 parts by weight of the above low-molecular-weight resin, and these were completely dissolved in a solvent to mix them. Thereafter, the solvent was evaporated off to obtain resin (1).

The resin (1) was analyzed to reveal that, in its molecular weight distribution as measured by GPC, it had a low-molecular-weight side peak molecular weight of 10,000, a high-molecular-weight side peak molecular weight of 750,000, a weight-average molecular weight (Mw) of 360,000, a number-average molecular weight (Mn) of 6,000 and a Mw/Mn ratio of 60, and also had a glass transition temperature (Tg) of 60° C.

Resin (2) Production Example 83 parts by weight of styrene, 17 parts by weight of butyl acrylate, 0.2 part by weight of polyvinyl alcohol, 200 parts by weight of deaerated water and 3.0 parts by weight of AIBN were mixed and dispersed to obtain a suspension. The suspension thus obtained was heated, and was maintained at 85° C. for 24 hours in an atmosphere of nitrogen, where the polymerization was completed to obtain resin (2).

The resin (2) was analyzed to reveal that, in its molecular weight distribution as measured by GPC, it had a peak molecular weight of 40,000, a weight-average molecular weight (Mw) of 42,000, a number-average molecular weight (Mn) of 12,000 and a Mw/Mn ratio of 3.5, and also had a glass transition temperature (Tg) of 60° C.

| Example 1 | (by weight) |
|---|---|
| Resin (1) | 100 parts |
| 1,1-Bis(4-hydroxyphenyl)cyclohexane polycarbonate (peak molecular weight: 5,000; Mw: 6,000; Mn: 1,700) | 10 parts |
| Carbon black (BET specific surface area: 85 $m^2/g$) | 10 parts |
| Negative charge control agent (a salicylic acid iron complex) | 2 parts |
| Low-molecular-weight polyethylene with a maximum endothermic peak at 107° C. | 5 parts |

The above materials were uniformly dispersed and mixed, and thereafter the mixture obtained was melt-kneaded. The kneaded product obtained was finely pulverized, and the resultant particles were further treated to make surface modification to make them smooth and spherical.

Subsequently, the particles thus obtained were classified to prepare toner particles (1). Then, 100 parts by weight of the toner particles (1) and 2 parts by weight of a hydrophobic fine silica powder (BET specific surface area: 200 $m^2/g$) were dry-process mixed by means of a Henschel mixer to obtain toner (1). Then, 6 parts by weight of the toner (1) thus obtained and 94 parts by weight of a resin-coated magnetic ferrite carrier (average particle diameter: 50 $\mu$m) were blended to produce two-component developer (1) for magnetic brush development.

The toner particles (1) had, as shown in Table 1, the value of SF-1 of 135, the value of SF-2 of 118, the value of (SF-2)/(SF-1) of 0.87, a weight-average particle diameter of 7.3 $\mu$m, a high-molecular-weight side peak molecular weight of 650,000 and a low-molecular-weight side peak molecular weight of 10,000.

With regard to the toner (1), components having molecular weight of 1,000 or less, in its molecular weight distribution as measured by GPC of THF-soluble matter, were separated and collected by GPC and they were analyzed by $^1$H-NMR, $^{13}$C-NMR and IR. As a result, as shown in Table 1, a component having in its structure a repeating unit of the polycarbonate resin, contained in the components having molecular weight of 1,000 or less, was contained in an amount of 1.0% by weight based on the weight of the toner.

The 1,1-bis(4-hydroxyphenyl)cyclohexane polycarbonate used in the production of the toner particles (1) is purified by repeating its reprecipitation using methylene chloride and isopropanol to reduce lower molecular weight components and impurities.

On the toner particles (1), their storage stability was evaluated in the following way. As a result, as shown in Table 1, good results were obtained without any damage of the fluidity of toner particles.

Evaluation of storage stability:

5.0 g of the toner particles (1) were put into a 50 ml cup made of plastic, and these were allowed to stand in a hot-air dryer set at 50.0° C. Three days later, these were taken out and left to cool to room temperature. Evaluation was visually made according to the following criteria.

A: Fluidity is not damaged.

B: Fluidity is low, but the original fluidity is restored upon rotation of the cup.

C: The toner particles are seen to have agglomerated or become coarse.

D: Caking.

Example 2

Toner particles (2), toner (2) and developer (2) were produced in the same manner as in Example 1 except that as the polycarbonate resin the 1,1-bis(4-hydroxyphenyl) cyclohexane polycarbonate was replaced with 1-phenyl-1, 1-bis(4-hydroxyphenyl)ethane polycarbonate (peak molecular weight: 4,500; Mw: 5,000; Mn: 1,500). Analysis and evaluation on the toner particles (2) and toner (2) were made similarly to obtain the results as shown in Table 1.

The 1-phenyl-1,1-bis(4-hydroxyphenyl)ethane polycarbonate used in the production of the toner particles (2) is purified by repeating its reprecipitation using methylene chloride and isopropanol to reduce lower molecular weight components and impurities.

Example 3

Toner particles (3), toner (3) and developer (3) were produced in the same manner as in Example 1 except that as the polycarbonate resin the 1,1-bis(4-hydroxyphenyl) cyclohexane polycarbonate was replaced with 2,2-bis(3-methyl-4-hydroxyphenyl)propane polycarbonate (peak molecular weight: 4,000; Mw: 4,500; Mn: 1,200). Analysis and evaluation on the toner particles (3) and toner (3) were made similarly to obtain the results as shown in Table 1.

The 2,2-bis(3-methyl-4-hydroxyphenyl)propane polycarbonate used in the production of the toner particles (3) is purified by repeating its reprecipitation using methylene chloride and isopropanol to reduce lower molecular weight components and impurities.

Examples 4 and 5

Toner particles (4) and (5), toners (4) and (5) and developers (4) and (5) were produced in the same manner as in Example 1 except that conditions for the surface modification treatment were changed. Analysis and evaluation on the toner particles (4) and (5) and toners (4) and (5) were made similarly to obtain the results as shown in Table 1.

Reference Example 6

Toner particles (6), toner (6) and developer (6) were produced in the same manner as in Example 1 except that the surface modification treatment was not made. Analysis and evaluation on the toner particles (6) and toner (6) were made similarly to obtain the results as shown in Table 1.

Example 7

Toner particles (7), toner (7) and developer (7) were produced in the same manner as in Example 1 except that the resin (1) was replaced with the resin (2). Analysis and evaluation on the toner particles (7) and toner (7) were made similarly to obtain the results as shown in Table 1.

Example 8

Toner particles (8), toner (8) and developer (8) were produced in the same manner as in Example 1 except that the salicylic acid iron complex was replaced with a compound formed of a monoazo dye and iron. Analysis and evaluation on the toner particles (8) and toner (8) were made similarly to obtain the results as shown in Table 1.

Comparative Example 1

Toner particles (9) for comparison, toner (9) for comparison and developer (9) for comparison were produced in the same manner as in Example 1 except that the polycarbonate resin was not used. Analysis and evaluation on the toner particles (9) for comparison and toner (9) for comparison were made similarly to obtain the results as shown in Table 1.

Comparative Example 2

Toner particles (10) for comparison, toner (10) for comparison and developer (10) for comparison were produced in the same manner as in Example 1 except that 25 parts by weight of a compound formed by ester linkage of p-tert-butyl phenol and 1,1-bis(4-hydroxyphenyl)cyclohexane through carbon was further added. Analysis and evaluation on the toner particles (10) for comparison and toner (10) for comparison were made similarly to obtain the results as shown in Table 1.

| Comparative Example 3 | |
|---|---|
| Bisphenol A/biphenol/diethylene glycol copolymer polycarbonate (peak molecular weight: 12,000; Mw:13,000; Mn: 4,000; Tg: 50° C.) | 100 parts |
| Carbon black (BET specific surface area: 85 $m^2/g$) | 10 parts |
| Negative charge control agent (a salicylic acid iron complex) | 2 parts |
| Low-molecular-weight polyethylene with a maximum endothermic peak at 107° C. | 5 parts |

The above materials were uniformly mixed, and thereafter the mixture obtained was melt-kneaded, followed by fine pulverization. Then, the subsequent procedure of Example 1 was repeated to obtain toner particles (11) for comparison, toner (11) for comparison and developer (11) for comparison. Analysis and evaluation on the toner particles (11) for comparison and toner (11) for comparison were made similarly to obtain the results as shown in Table 1.

The bisphenol A/biphenol/diethylene glycol copolymer polycarbonate used in the production of the toner particles (11) is not subjected to purification by reprecipitation.

| Comparative Example 4 | (by weight) |
|---|---|
| Resin (1) | 50 parts |
| 1,1-Bis(4-hydroxyphenyl)cyclohexane polycarbonate (peak molecular weight: 3,000; Mw: 3,500; Mn: 1,000) | 50 parts |
| Carbon black (BET specific surface area: 85 $m^2/g$) | 10 parts |
| Negative charge control agent (a salicylic acid iron complex) | 2 parts |
| Low-molecular-weight polyethylene with a maximum endothermic peak at 107° C. | 5 parts |

The above materials were uniformly dispersed and mixed, and thereafter the mixture obtained was melt-kneaded. The kneaded product obtained was finely pulverized, and the resultant particles were further treated to make surface modification to make them smooth and spherical.

Subsequently, the particles thus obtained were classified to prepare toner particles (12) for comparison. Then, 100 parts by weight of the toner particles (12) for comparison and 2 parts by weight of a hydrophobic fine silica powder (BET specific surface area: 200 $m^2/g$) were dry-process mixed by means of a Henschel mixer to obtain toner (12) for comparison. Then, 6 parts by weight of the toner (12) for comparison thus obtained and 94 parts by weight of a resin-coated magnetic ferrite carrier (average particle diameter: 50 $\mu$m) were blended to produce two-component developer (12) for comparison. The 1,1-bis(4-hydroxyphenyl) cyclohexane polycarbonate used in the production of toner particles (12) is not subjected to purification by reprecipitation.

TABLE 1

| | Toner | Toner particles | Content * of 1,000 or less molecular weight polycarbonate component (wt. %) | SF-1 | SF-2 | SF-2/SF-1 | (1) ($\mu$m) | (2) |
|---|---|---|---|---|---|---|---|---|
| Example: | | | | | | | | |
| 1 | (1) | (1) | 1.0 | 135 | 118 | 0.87 | 7.3 | A |
| 2 | (2) | (2) | 2.0 | 137 | 119 | 0.87 | 7.2 | A |
| 3 | (3) | (3) | 1.5 | 136 | 118 | 0.87 | 7.3 | A |
| 4 | (4) | (4) | 1.0 | 143 | 118 | 0.83 | 7.1 | A |
| 5 | (5) | (5) | 1.0 | 155 | 135 | 0.87 | 7.2 | A |
| 6 | (6) | (6) | 1.0 | 175 | 161 | 0.92 | 7.5 | A |
| 7 | (7) | (7) | 1.0 | 134 | 118 | 0.88 | 6.9 | B |
| 8 | (8) | (8) | 1.0 | 133 | 119 | 0.89 | 7.3 | A |
| Comparative Example: | | | | | | | | |
| 1 | (9) | (9) | 0.0 | 134 | 117 | 0.87 | 7.4 | B |
| 2 | (10) | (10) | 17.0 | 135 | 116 | 0.86 | 7.1 | B |
| 3 | (11) | (11) | 6.2 | 168 | 158 | 0.94 | 7.0 | D |
| 4 | (12) | (12) | 16.0 | 136 | 119 | 0.88 | 7.7 | D |

(1)Weight-average particle diameter
(2)Storage stability
*Content of the component having in its structure a repeating unit of the polycarbonate resin, contained in components having molecular weight of 1,000 or less, in molecular weight distribution as measured by GPC of THF-soluble matter of the toner.

Using the developers (1) to (5) and (7) – (8) and the developers (6), and (9) to (12) for comparison, having the toners (1) to (5), (7) and (8) and the toners (6) and (9) to (12) for comparison, produced in Examples 1 to 8 and Comparative Examples 1 to 4, respectively, evaluation was made in the following way.

An image forming apparatus used in the present Examples will be described. FIG. 2 schematically illustrates a cross section of an image forming apparatus used in the present Examples. FIG. 3 illustrates a developing system of the image forming apparatus.

The photosensitive drum 1 comprises a substrate 1*a* and provided thereon a photosensitive layer 1*b* having an organic photo-semiconductor, and is rotated in the direction of an arrow. By means of the charging roller 2 (the conductive elastic layer 2*a* and the mandrel 2*b*) facing the photosensitive drum and rotating in contact with it, the surface of the photosensitive drum 1 is electrostatically charged to have a surface potential of about −600 V. Exposure 3 is carried out using a polygon mirror by on-off control on the photosensitive drum 1 in accordance with digital image information, whereby an electrostatic latent image with an exposed-area potential of −100 V and a dark-area potential of −600 V is formed. Using the developing assembly 4-1 among a plurality of developing assemblies, the black toner was imparted to the surface of the photosensitive drum 1 to form toner images by reverse development. The toner images are transferred to the intermediate transfer member 5. The toner remaining on the photosensitive drum 1 after transfer is collected in a residual toner container 9 by means of a cleaning member 8.

The intermediate transfer member 5 is comprised of the pipe-like mandrel 5*b* and the elastic layer 5*a* provided thereon by coating, formed of nitrile-butadiene rubber (NBR) in which a conductivity-providing agent of carbon black has been well dispersed. The coat layer 5*a* thus formed has a hardness according to JIS K-6301, of 30 degrees and a volume resistivity of $_{10}^{9}$ Ω·cm. Transfer electric current necessary for the transfer from the photosensitive drum 1 to the intermediate transfer member 5 is about 5 μA, which can be obtained by applying a voltage of +500 V to the mandrel 5*b* from a power source.

The transfer roller 7 has an external diameter of 20 mm. The transfer roller 7 has an elastic layer 7*a* formed by coating on a mandrel 7*b* of 10 mm diameter, a foamable material of an ethylene-propylene-diene terpolymer (EPDM) in which carbon, a conductivity-providing agent has been well dispersed. As the elastic layer 7*a*, the one showing a volume resistivity of $10^6$ Ω·cm and a hardness according to JIS K-6301, of 35 degrees was used. A voltage was applied to the transfer roller to flow a transfer current of 15 μA.

As the heat fixing assembly H, a fixing assembly of a hot-roll type having no function of oil application was used. Here, as both the upper roller and the lower roller, those having surface layers of fluorine resin were used, having roller diameter of 50 mm. The fixing temperature was set at 180° C., and the nip width at 7 mm.

Under the above conditions, a 100-sheet printing test was made in an environment of normal temperature and normal humidity (N/N: 25° C., 60%RH) at a printing rate of 8 sheets (A4-size)/minute in a monochromatic continuous mode (i.e., a mode in which the consumption of the toner was accelerated without a pause of the developing assembly) while successively supplying each of the developers (1) to (8) and the developers (9) to (12) for comparison. Next, in an environment of low temperature and low humidity (L/L: 15° C., 10%RH), a 5,000-sheet image printing test was made in the same printing mode. Then, evaluation on printed images thus obtained was made in respect of the items shown later.

After the printing tests were completed, the matching of the above developers to the image forming apparatus simultaneously used was also evaluated.

The results of the above evaluation are summarized in Tables 2 and 3.

TABLE 2

| | Printed-Image Evaluation Results | | | | | |
|---|---|---|---|---|---|---|
| | Developer | N/N image density | L/L image density | Change in image density | Fog | Blank areas |
| Example: | | | | | | |
| 1 | (1) | A | A | A | A | A |
| 2 | (2) | A | A | A | A | A |
| 3 | (3) | A | A | A | A | A |
| 4 | (4) | A | A | A | A | B |
| 5 | (5) | A | A | B | A | B–C |
| 6 | (6) | C | C | B | B | C |
| 7 | (7) | A | A | B | A | A |
| 8 | (8) | A | A | A | A | A |
| Comparative Example: | | | | | | |
| 1 | (9) | D | D | C | C | C |
| 2 | (10) | D | D | D | D | D |
| 3 | (11) | C | C | D | B | D |
| 4 | (12) | D | D | D | D | B |

TABLE 3

| | Evaluation Results of Matching to Image Forming Apparatus | | | | |
|---|---|---|---|---|---|
| | Developer | Developing sleeve | Photosensitive drum | Intermediate transfer member | Fixing assembly |
| Example: | | | | | |
| 1 | (1) | A | A | A | A |
| 2 | (2) | A | A | A | A |
| 3 | (3) | A | A | A | A |
| 4 | (4) | B | B | A | A |
| 5 | (5) | B | B | B | B |
| 6 | (6) | B | C | C | C |
| 7 | (7) | B | B | A | C |
| 8 | (8) | A | A | A | A |
| Comparative Example: | | | | | |
| 1 | (9) | D | C | D | D |
| 2 | (10) | D | D | D | C |
| 3 | (11) | D | D | D | D |
| 4 | (12) | C | C | C | D |

Examples 9 & Comparative Example 5

Evaluation was made in the same manner as in Example 1 except that the developing assembly of the image forming apparatus, shown in FIG. 3, was replaced with the one shown in FIG. 4, the movement speed of the toner carrying member surface was so set as to be 3.0 times the movement speed of the electrostatic latent image bearing member surface, and the printing test was made in a monochromatic intermittent mode (i.e., a mode in which the developing assembly was made to pause for 10 seconds every time the images were printed on one sheet and the deterioration of the toner was accelerated by preliminary operation of the developing assembly when again driven) while successively supplying each of the toner (1) produced in Example 1 and the toner (9) for comparison produced in Comparative Example 1.

The toner carrying member used here had a surface roughness Ra of 1.5, and the toner regulation blade used was the one comprising a phosphor bronze base plate to which urethane rubber was bonded and the side coming into contact with the toner carrying member of which was coated with nylon.

The results of evaluation are summarized in Tables 4 and 5.

TABLE 4

| | Printed-Image Evaluation Results | | | | | |
|---|---|---|---|---|---|---|
| | Toner | N/N image density | L/L image density | Change in image density | Fog | Blank areas |
| Example: | | | | | | |
| 9 | (1) | A | A | A | A | A |
| Comparative Example: | | | | | | |
| 5 | (9) | D | D | C | C | C |

TABLE 5

| | Evaluation Results of Matching to Image Forming Apparatus | | | | |
|---|---|---|---|---|---|
| | Toner | Developing sleeve | Photosensitive drum | Intermediate transfer member | Fixing assembly |
| Example: | | | | | |
| 9 | (1) | A | A | A | A |
| Comparative Example: | | | | | |
| 5 | (9) | D | D | D | D |

Example 10 & Comparative Example 6

In the present Example, a reuse mechanism was attached to a commercially available laser beam printer LBP-EX (manufactured by CANON INC.) to remodel the printer, which was again set up and used. More specifically, as shown in FIG. 5, a system was attached in which the transfer residual toner present on the surface of the photosensitive drum 40 was scraped off with the elastic blade 42 of the cleaner 41, coming into touch with the photosensitive drum, which was thereafter sent inside the cleaner by means of a cleaner roller, further passed through the cleaner screw 43, passed through the feed pipe 44 provided with a transport screw, and, through the hopper 45, returned to the developing assembly 46, where the collected toner was again used. As the primary charging roller 47, used was a rubber roller (diameter: 12 mm; contact pressure: 50 g/cm) in which conductive carbon was dispersed, and covered with a nylon resin. On the photosensitive drum (electrostatic latent image bearing member), a dark-area potential $V_D$ of −700 V and a light-area potential $V_L$ of −200 V were formed by laser exposure (600 dpi). As the toner carrying member, a developing sleeve 48 whose surface was coated with a resin having carbon black dispersed therein and had a surface roughness Ra of 1.1 was used, where its surface movement speed was so set as to be 1.1 times the movement speed of the photosensitive drum surface, and then the gap (S-D distance) between the photosensitive drum and the developing sleeve was set at 270 $\mu$m. As the toner regulation member, a blade made of urethane rubber was used in contact with the developing sleeve. As the development bias, a bias formed by superimposing an AC bias component on a DC bias component was used.

As the heat fixing assembly H, a fixing assembly shown in FIGS. 6 and 7 was used. The surface temperature of a temperature detector 31*d* of a heating element 31 was set at 170° C., the total pressure between the heating element 31 and a spongy pressure roller 33 having a foam of silicon rubber in its lower layer was set to be 8 kg, and the nip between the pressure roller and a fixing film 32 was set to be 6 mm. As the fixing film 32, a 60 $\mu$m thick heat-resistant polyimide film was used which had on its side coming into contact with the recording medium a low-resistance release layer formed of PTEF (of a high-molecular-weight type) having a conductive material dispersed therein.

Under the above conditions, a 100-sheet printing test was made in an environment of normal temperature and normal humidity (N/N: 25° C., 60%RH) at a printing rate of 6 sheets (A4-size)/minute in an intermittent mode (i.e., a mode in which the developing assembly was made to pause for 10 seconds every time the images were printed on one sheet and the deterioration of the toner was accelerated by preliminary operation of the developing assembly when again driven) while successively supplying each of the toner (1) produced in Example 1 and the toner (10) for comparison produced in Comparative Example 2. Thereafter, in an environment of low temperature and low humidity (L/L: 15° C., 10%RH), a 5,000-sheet image printing test was made in the same printing mode. Then, evaluation on the printed images thus obtained was made in respect of the items shown later.

The matching of the above toners to the image forming apparatus simultaneously used was also evaluated.

The results of the above evaluation are summarized in Tables 6 and 7.

TABLE 6

| | Printed-Image Evaluation Results | | | | | |
|---|---|---|---|---|---|---|
| | Toner | N/N image density | L/L image density | Change in image density | Fog | Blank areas |
| Example: | | | | | | |
| 10 | (1) | A | A | A | A | A |
| Comparative Example: | | | | | | |
| 6 | (10) | D | D | D | D | C |

TABLE 7

| | Evaluation Results of Matching to Image Forming Apparatus | | | |
|---|---|---|---|---|
| | Toner | Developing sleeve | Photosensitive drum | Fixing assembly |
| Example: | | | | |
| 10 | (1) | A | A | A |
| Comparative Example: | | | | |
| 6 | (10) | D | D | D |

Example 11

A printing test was made in the same manner as in Example 10 except that the toner reuse mechanism of FIG. 5 was detached and images were printed in a continuous mode (i.e., a mode in which the consumption of the toner was accelerated without a pause of the developing assembly) while supplying the toner (2) produced in Example 2.

Evaluation on the printed images thus obtained was made in respect of the items shown later, and also the matching of the toner to the image forming apparatus used was evaluated. As the result, good results were obtained on all items.

The evaluation items stated in Examples and Comparative Examples and their evaluation criteria are as described below.

Printed-Image Evaluation (1) Image Density:

Image density of images printed on the 100th sheet was evaluated. The image density was measured with MACBETH REFLECTION DENSITOMETER (manufactured by Macbeth Co.), as relative density with respect to an image printed on a white ground area with a density of 0.00 of an original.

A: 1.40 or more.
B: From 1.35 to less than 1.40.
C: From 1.00 to less than 1.35.
D: less than 1.00.

(2) Change in Image Density:

The image density of images printed on the 100th sheet and 5,000th sheet in the environment of low temperature and low humidity was measured, and any change in image density was calculated according to the following expression. The image density was measured with MACBETH REFLECTION DENSITOMETER (manufactured by Macbeth Co.), as relative density with respect to an image printed on a white ground area with a density of 0.00 of an original.

Change in image density=(density on 100th sheet)−(density on 5,000th sheet)

A: Less than 0.05.
B: From 0.05 to less than 0.10.
C: From 0.10 to less than 0.15.
D: More than 0.15.

(3) Image Fog:

Fog density (%) was calculated from a difference between the whiteness at a white background area of images printed on the 100th sheet in the environment of normal temperature and normal humidity and the whiteness of the recording medium to make evaluation on image fog. The fog density was measured with REFLECTOMETER (manufactured by Tokyo Denshoku Co., Ltd.).
A: Less than 1.5%.
B: From 1.5% to less than 2.5%.
C: From 2.5% to less than 4.0%.
D: More than 4.0%.

Figure 10A:
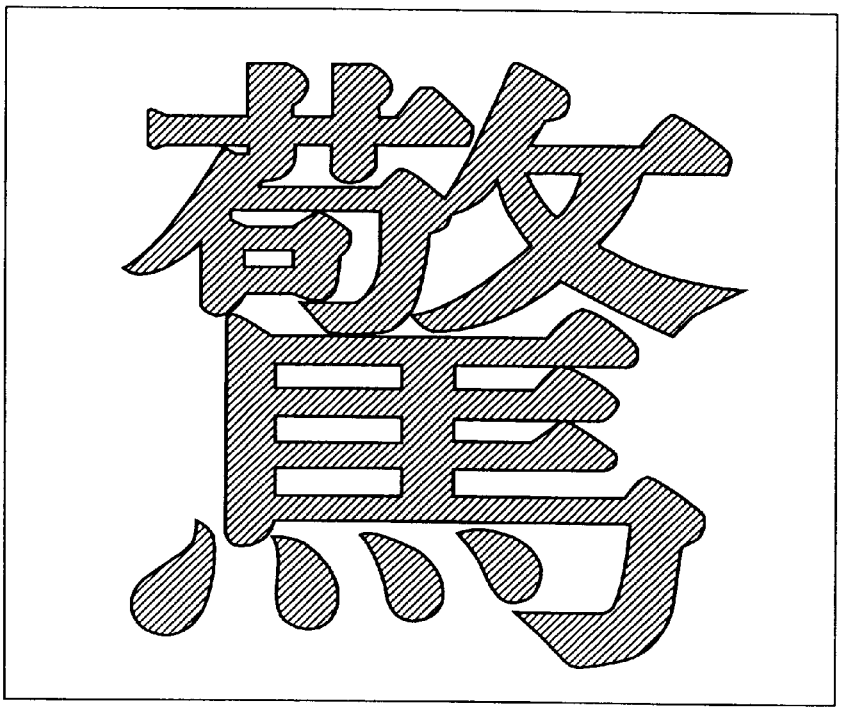
FIGS. 10A and 10B diagrammatic illustrating how blank areas caused by poor transfer are present in a character image.
Figure 10B:
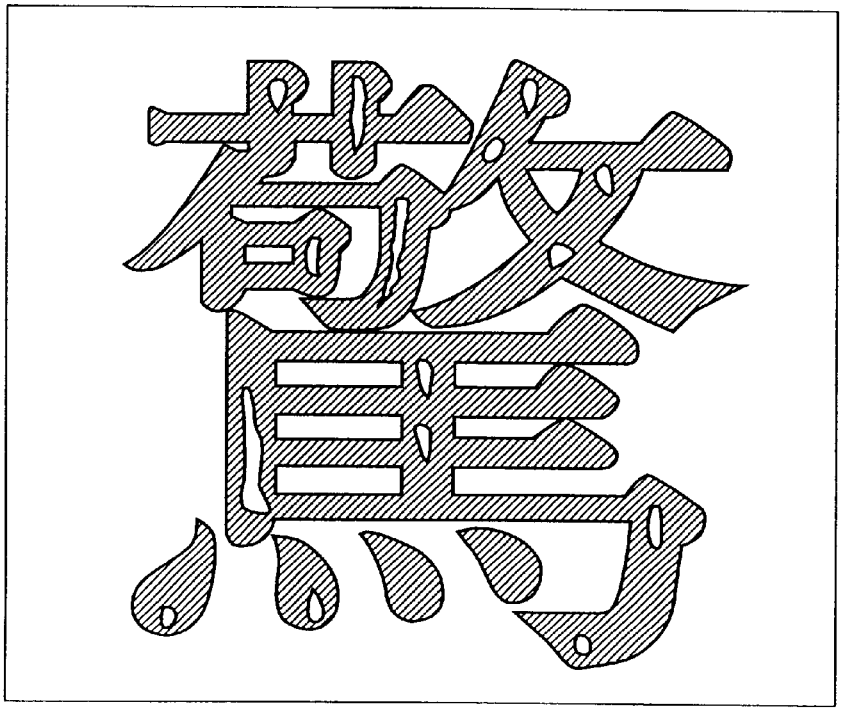

(4) Blank Areas Caused by Poor Transfer:

In images printed on the 100th sheet in the environment of normal temperature and normal humidity, evaluation was visually made on characters with a pattern as shown in FIG. 10A, to examine any blank areas (the state shown in FIG. 10B) caused by poor transfer.
A: Little occur.
B: Slight blank areas are seen.
C: Blank areas are a little seen.
D: Conspicuous blank areas are seen.

Evaluation on Matching to Image Forming Apparatus (1) Matching to Developing Sleeve:

After the printing test was finished, evaluation was visually made by examining any sticking of the toner remaining on the developing sleeve surface.
A: No sticking occurs.
B: Almost no sticking occurs.
C: Sticking is a little seen.
D: Sticking is greatly seen.

(2) Matching to Photosensitive Drum:

After the printing test was finished, evaluation was visually made by examining any scratches on the photosensitive drum surface and any sticking of the toner remaining thereon.
A: None of them occurs.
B: Scratches are seen to slightly occur.
C: Sticking and scratches are seen.
D: Sticking is greatly seen.

(3) Matching to Intermediate Transfer Member:

After the printing test was finished, evaluation was visually made by examining any scratches on the intermediate transfer member surface and any sticking of the toner remaining thereon.
A: None of them occurs.
B: Residual toner is seen to present on the surface.
C: Sticking and scratches are seen.
D: Sticking is greatly seen.

(4) Matching to Fixing Assembly:

After the printing test was finished, evaluation was visually made by examining any scratches on the fixing film surface and any sticking of the toner remaining thereon.
A: None of them occurs.
B: Sticking is slightly seen.
C: Sticking and scratches are seen.
D: Sticking is greatly seen.

| Example 12 | (by weight) |
|---|---|
| Resin (1) | 100 parts |
| Carbon black (BET specific surface area: 104 $m^2/g$) | 10 parts |
| Negative charge control agent (a salicylic acid iron complex) | 2 parts |
| Low-molecular-weight polyethylene with a maximum endothermic peak at 107° C. | 5 parts |

The above materials were mixed using a blender, and the mixture obtained was melt-kneaded by means of a twin-screw extruder heated to 130° C. The resultant kneaded product, having been cooled, was crushed with a hammer mill. Thereafter, the crushed product was finely pulverized using a jet mill.

Next, 100 parts by weight of particles thus obtained by pulverization and 20 parts by weight of 1,1-bis(4-hydroxyphenyl)cyclohexane polycarbonate (peak molecular weight: 5,000; Mw: 5,600; Mn: 1,600) were dry-process mixed using a Henschel mixer, followed by anchoring treatment at 40° C. to obtain fine pulverization particles to the surfaces of which fine powder of the 1,1-bis(4-hydroxyphenyl)cyclohexane polycarbonate adhered. The particles thus obtained were treated to make surface modification to make them spherical, by means of an apparatus comprising a rotor rotated to impart a mechanical impact force. Subsequently, the particles thus obtained were classified to prepare toner particles (13).

As a result of TEM observation of cross-sections of the toner particles (13), continuous contrasts were seen on the toner particle surfaces. Also, using PAS, the composition of the resultant toner particle surfaces was analyzed by FT-IR/PAS while changing the scanning speed of a movable mirror. As a result, a spectrum originating from the 1,1-bis(4-hydroxyphenyl)cyclohexane polycarbonate was obtained, and it was confirmed that the polycarbonate resin was continuously present on the toner particle surfaces.

Next, 100 parts by weight of the toner particles (13) and 2 parts by weight of a hydrophobic fine silica powder (BET specific surface area: 200 $m^2/g$) were dry-process mixed by means of a Henschel mixer to obtain toner (13). Thereafter, 6 parts by weight of the toner (13) thus obtained and 94 parts by weight of a resin-coated magnetic ferrite carrier (average particle diameter: 50 $\mu$m) were blended to produce two-component developer (13) for magnetic brush development.

The toner particles (13) had the value of SF-1 of 145, the value of SF-2 of 130, the value of (SF-2)/(SF-1) of 0.90, a weigh-average particle diameter of 6.9 um, a high-molecular-weight side peak molecular weight of 700,000 and a low-molecular-weight side peak molecular weight of 10,000.

In the molecular weight distribution as measured by GPC of THF-soluble matter of the toner (13), components having molecular weight of 1,000 or less were separated and collected by GPC and they were analyzed by $^1$H-NMR, $^{13}$C-NMR and IR. As a result, a component having in its structure a repeating unit of the polycarbonate resin, contained in the components having molecular weight of 1,000 or less, was contained in an amount of 1.2% by weight based on the weight of the toner. The 1,1-bis(4-hydroxyphenyl) cyclohexane polycarbonate used in the production of toner (13) is purified by repeating its reprecipitation using dichloromethane and isopropanol to reduce lower molecular weight components and impurities.

On the toner particles (13), their storage stability was also evaluated in the same manner as in Example 1. As a result, good results were obtained without any damage of the fluidity of toner particles. Analysis and evaluation on the toner particles (13) and toner (13) were made similarly to obtain the results as shown in Table 8.

Example 13

Toner particles (14), toner (14) and developer (14) were produced in the same manner as in Example 12 except that as the polycarbonate resin the 1,1-bis(4-hydroxyphenyl) cyclohexane polycarbonate was replaced with 20 parts by weight of a bisphenol A/biphenol/hexamethylene glycol copolymer polycarbonate (peak molecular weight: 30,000; Mw: 32,000; Mn: 10,000; Tg: 60° C.). The bisphenol A/biphenol/hexamethylene glycol copolymer polycarbonate used in the production of toner (14) is purified by repeating its reprecipitation using dichloromethane and isopropanol to reduce lower molecular weight components and impurities. Analysis and evaluation on the toner particles (14) and toner (14) were made similarly to obtain the results as shown in Table 8.

| Example 14 | (by weight) |
|---|---|
| Resin (1) | 100 parts |
| Carbon black (BET specific surface area: 104 $m^2/g$) | 10 parts |
| Negative charge control agent (a salicylic acid iron complex) | 2 parts |
| Low-molecular-weight polyethylene with a maximum endothermic peak at 107° C. | 5 parts |

The above materials were mixed using a blender, and the mixture obtained was melt-kneaded by means of a twin-screw extruder heated to 130° C. The resultant kneaded product, having been cooled, was crushed with a hammer mill. Thereafter, the crushed product was finely pulverized using a jet mill.

Next, the particles thus obtained were treated to make surface modification to make them spherical, by means of an apparatus comprising a rotor rotated to impart a mechanical impact force, followed by classification. Then, 100 parts by weight of the classified particles obtained and 5 parts by weight of a finely powdered bisphenol A polycarbonate (peak molecular weight: 5,000; Mw: 5,600; Mn: 1,600) were dry-process mixed using a Henschel mixer, followed by anchoring treatment at 40° C. to obtain fine pulverization particles, toner particles (15), to the surfaces of which fine powder of the bisphenol A polycarbonate adhered.

As a result of TEM observation of cross-sections of the toner particles (15), discontinuous contrasts were seen on the toner particle surfaces. Also, using PAS, the composition of the resultant toner particle surfaces was analyzed by FT-IR/PAS while changing the scanning speed of a movable mirror. As a result, a spectrum originating from the bisphenol A polycarbonate was obtained, and it was confirmed that the polycarbonate resin was discontinuously present on the toner particle surfaces.

Next, 100 parts by weight of the toner particles (15) and 2 parts by weight of a hydrophobic fine silica powder (BET specific surface area: 200 $m^2/g$) were dry-process mixed by means of a Henschel mixer to obtain toner (15). Thereafter, 6 parts by weight of the toner (15) thus obtained and 94 parts by weight of a resin-coated magnetic ferrite carrier (average particle diameter: 50 $\mu$m) were blended to produce two-component developer (15) for magnetic brush development.

The bisphenol A polycarbonate used in the production of toner (15) is purified by repeating its reprecipitation using dichloromethane and isopropanol to reduce lower molecular weight components and impurities.

Analysis and evaluation on the toner particles (15) and toner (15) were made similarly to obtain the results as shown in Table 8.

Example 15

Toner particles (16), toner (16) and developer (16) were produced in the same manner as in Example 14 except that as the polycarbonate resin the bisphenol A polycarbonate was replaced with 2,2-bis(3-methyl-4-hydroxyphenyl) propane polycarbonate (peak molecular weight: 4,000; Mw: 4,500; Mn: 1,200). The 2,2-bis(3-methyl-4-hydroxyphenyl) propane polycarbonate used in the production of toner (16) is purified by repeating its reprecipitation using dichloromethane and isopropanol to reduce lower molecular weight components and impurities. Analysis and evaluation on the toner particles (16) and toner (16) were made similarly to obtain the results as shown in Table 8.

Example 16

Into a 2-liter four-necked separable flask having a high-speed stirrer TK-type homomixer (manufactured by Tokushu Kika Kogyo), 650 g of ion-exchanged water, 500 g of an aqueous 0.1 mol/liter $Na_3PO_4$ solution were introduced, and the mixture was heated to 70° C. with stirring at a number of revolution adjusted to 12,000 rpm. Then, 70 g of an aqueous 0.1 mol/liter $CaCl_2$ solution was added thereto little by little to prepare an aqueous continuous phase containing fine-particle slightly water-soluble dispersion stabilizer $Ca_3(PO_4)$.

Meanwhile, as a disperse phase (dispersoid), the following was prepared.

| | (by weight) |
|---|---|
| Styrene | 83 parts |
| n-Butyl acrylate | 17 parts |
| Divinylbenzene (purity: 55%) | 0.3 part |
| Carbon black (BET specific surface area: 104 $m^2/g$) | 10 parts |
| Negative charge control agent (a salicylic acid iron complex) | 2 parts |
| A mixture of the above materials was dispersed for 3 hours by means of an attritor (manufactured by Mitsui Miike engineering Corporation). To the dispersion obtained; | |
| 1,1-bis(4-hydroxyphenyl)cyclohexane polycarbonate (peak molecular weight: 8,000; Mw: 8,600; Mn: 2,800 | 5 parts |
| Paraffin wax with a maximum endothermic peak at 70° C. | 5 parts |
| 2,2'-azobis(2,4-dimethylvaleronitrile) | 5 parts |

were added, followed by heating to 70° C. to prepare a polymerizable monomer composition.

Next, the polymerizable monomer composition was introduced into the above aqueous dispersion medium to granulate the polymerizable monomer composition in an atmosphere of nitrogen at a liquid temperature of 70° C. with stirring for 15 minutes while maintaining the number of revolution of the high-speed stirrer at 12,000 rpm.

Thereafter, the stirrer was changed to a stirrer having propeller stirring blades and the system was kept at 70° C. for 10 hours with stirring at 50 rpm to obtain a suspension.

Thereafter, the suspension was cooled, and diluted hydrochloric acid was added to remove the dispersion stabilizer. Washing with water was further repeated several times, followed by drying to obtain polymerization particles, which were designated as toner particles (17).

The toner particles (17) had the value of SF-1 of 127, the value of SF-2 of 106, the value of (SF-2)/(SF-1) of 0.83, a weight-average particle diameter of 6.2 $\mu$m, a peak molecular weight of 20,000.

The toner particles (17) were precisely weighed out in an amount of 1.0 g, which was then loaded into a cylindrical filter paper and was subjected to Soxhlet extraction with 200 ml of tetrahydrofuran (THF) for 20 hours. The resultant filter paper was vacuum-dried at 40° C. for 12 hours, and the weight of the residue was measured to calculate the THF-insoluble matter. As a result, it was 40% by weight based on the weight of the polymerization particles.

Next, 100 parts by weight of the above toner particles (17) and 2 parts by weight of a hydrophobic fine silica powder (BET specific surface area: 200 $m^2/g$) were dry-process mixed by means of a Henschel mixer to obtain toner (17). Thereafter, 6 parts by weight of the toner (17) thus obtained and 94 parts by weight of a resin-coated magnetic ferrite carrier (average particle diameter: 50 $\mu$m) were blended to produce two-component developer (17) for magnetic brush development.

In the molecular weight distribution as measured by GPC of THF-soluble matter of the toner (17), components having molecular weight of 1,000 or less were separated and collected by GPC and they were analyzed by $^1$H-NMR, $^{13}$C-NMR and IR. As a result, a component having in its structure a repeating unit of the polycarbonate resin, contained in the components having molecular weight of 1,000 or less, was contained in an amount of 0.5% by weight based on the weight of the toner. The 1,1-bis(4-hydroxyphenyl) cyclohexane polycarbonate used in the production of toner (17) is purified by repeating its reprecipitation using dichloromethane and isopropanol to reduce lower molecular weight components and impurities. Analysis and evaluation on the toner particles (17) and toner (17) were made similarly to obtain the results as shown in Table 8.

Example 17

Toner particles (18), toner (18) and developer (18) were produced in the same manner as in Example 16 except that 1 part by weight of an unsaturated polyester (polyester obtained by condensation of propoxylated bisphenol A with fumaric acid; peak molecular weight: 10,000) was further added in the polymerizable monomer composition. Analysis and evaluation on the toner particles (18) and toner (18) were made similarly to obtain the results as shown in Table 8.

Example 18

Toner particles (19), toner (19) and developer (19) were produced in the same manner as in Example 16 except that as the polycarbonate resin the 1,1-bis(4-hydroxyphenyl) cyclohexane polycarbonate was replaced with 1-phenyl-1, 1-bis(4-hydroxyphenyl)ethane polycarbonate (peak molecular weight: 20,000; Mw: 26,000; Mn: 6,500). The 1-phenyl-1,1-bis (4-hydroxyphenyl)ethane polycarbonate used in the production of toner (19) is purified by repeating its reprecipitation using dichloromethane and isopropanol to reduce lower molecular weight components and impurities. Analysis and evaluation on the toner particles (19) and toner (19) were made similarly to obtain the results as shown in Table 8.

Example 19

Toner particles (20), toner (20) and developer (20) were produced in the same manner as in Example 16 except that as the polycarbonate resin the 1,1-bis(4-hydroxyphenyl) cyclohexane polycarbonate was replaced with 2,2-bis(3-methyl-4-hydroxyphenyl)propane polycarbonate (peak molecular weight: 8,000; Mw: 7,800; Mn: 2,500). The 2,2-bis(3-methyl-4-hydroxyphenyl) propane polycarbonate used in the production of toner (20) is purified by repeating its reprecipitation using dichloromethane and isopropanol to reduce lower molecular weight components and impurities. Analysis and evaluation on the toner particles (20) and toner (20) were made similarly to obtain the results as shown in Table 8.

Example 20

Toner particles (21), toner (21) and developer (21) were produced in the same manner as in Example 12 except that the resin (1) was replaced with resin (2). Analysis and evaluation on the toner particles (21) and toner (21) were made similarly to obtain the results as shown in Table 8.

Example 21

Toner particles (22), toner (22) and developer (22) were produced in the same manner as in Example 16 except that the salicylic acid iron complex was replaced with a compound formed of a monoazo dye and iron. Analysis and evaluation on the toner particles (22) and toner (22) were made similarly to obtain the results as shown in Table 8.

Comparative Example 7

Toner particles (23) for comparison, toner (23) for comparison and developer (23) for comparison were produced in the same manner as in Example 12 except that the polycarbonate resin was not used. Analysis and evaluation on the toner particles (23) for comparison and toner (23) for comparison were made similarly to obtain the results as shown in Table 8.

Comparative Example 8

Toner particles (24) for comparison, toner (24) for comparison and developer (24) for comparison were produced in the same manner as in Example 16 except that the polycarbonate resin was not used. Analysis and evaluation on the toner particles (24) for comparison and toner (24) for comparison were made similarly to obtain the results as shown in Table 8.

| Comparative Example 9 | (by weight) |
|---|---|
| Bisphenol A/biphenol/diethylene glycol copolymer polycarbonate (peak molecular weight: 12,000; Mw: 13,000; Mn: 4,100; Tg: 50° C.) | 100 parts |
| Carbon black (BET specific surface area: 85 $m^2/g$) | 10 parts |
| Negative charge control agent ( a salicylic acid iron complex) | 2 parts |
| Low-molecular-weight polyethylene with a maximum endothermic peak at 107° C. | 5 parts |

The above materials were uniformly mixed, and thereafter the mixture obtained was melt-kneaded, followed by fine pulverization. Then, the subsequent procedure of Example 1 was repeated to obtain toner particles (25) for comparison, toner (25) for comparison and developer (25) for comparison. The bisphenol A/biphenol/diethylene glycol copolymer polycarbonate used in the production of toner (25) for comparison is not subjected to purification by reprecipitation. Analysis and evaluation on the toner particles (25) for comparison and toner (25) for comparison were made similarly to obtain the results as shown in Table 8.

TABLE 8

| | Toner | Toner particles | Content*1 of ≦1,000 molecular weight polycarbonate component (wt. %) | SF-1 | SF-2 | SF-2/SF-1 | Weight average particle diam. (μm) | Peak molecular weight | Storage stability | TEM*2 observation of surface contrst | Polycarbonate*3 resin on the surface |
|---|---|---|---|---|---|---|---|---|---|---|---|
| Example: | | | | | | | | | | | |
| 12 | (13) | (13) | 1.8 | 145 | 130 | 0.90 | 6.9 | 700,000/10,000 | A | Continuous | Present |
| 13 | (14) | (14) | 1.7 | 151 | 132 | 0.87 | 6.7 | 700,000/10,000 | A | Continuous | Present |
| 14 | (15) | (15) | 0.5 | 144 | 134 | 0.93 | 6.6 | 700,000/10,000 | A | Discontinuous | Present |
| 15 | (16) | (16) | 0.5 | 143 | 128 | 0.90 | 6.8 | 700,000/10,000 | A | Discontinuous | Present |
| 16 | (17) | (17) | 0.4 | 127 | 106 | 0.83 | 6.2 | 20,000 | A | Continuous | Present |
| 17 | (18) | (18) | 0.4 | 135 | 111 | 0.82 | 6.4 | 21,000 | A | Continuous | Present |
| 18 | (19) | (19) | 0.4 | 125 | 115 | 0.92 | 6.1 | 19,000 | A | Continuous | Present |
| 19 | (20) | (20) | 0.4 | 126 | 110 | 0.87 | 6.3 | 21,000 | A | Continuous | Present |
| 20 | (21) | (21) | 1.9 | 125 | 112 | 0.91 | 6.4 | 40,000 | A | Continuous | Present |
| 21 | (22) | (22) | 0.4 | 125 | 110 | 0.87 | 6.4 | 20,000 | A | Continuous | Present |
| Comparative Example: | | | | | | | | | | | |
| 7 | (23) | (23) | 0.0 | 147 | 129 | 0.88 | 6.8 | 700,000/10,000 | C | No contrast | Absent |
| 8 | (24) | (24) | 0.0 | 130 | 110 | 0.85 | 6.1 | 20,000 | B | No contrast | Absent |
| 9 | (25) | (25) | 30.00 | 145 | 130 | 0.90 | 6.5 | 12,000 | D | No contrast | Present |

*1In molecular weight distribution as mesured by GPC of THF-soluble matter of the toner, the component having in its structure a repeating unit of the polycarbonate resin, contained in components having molecular weight of 1,000 or less.
*2TEM examination on the presence of any continuous or discontinuous contrasts on toner particle surfaces.
*3IR/PAS examination on the presence of polycarbonate resin on toner particle surfaces.

Using the developers (13) to (22) and the developers (23) to (25) for comparison, having the toners (13) to (22) and the toners (23) to (25) for comparison, produced in Examples 12 to 22 and Comparative Examples 7 to 9, respectively, evaluation was made in the same way using the same image forming apparatus as used in Examples 1 to 8 and Comparative Examples 1 to 4, except that only the printing tests were changed as shown below.

To make the printing tests, after each developer was left for a week in an environment of normal temperature and normal humidity (N/N: 25° C., 60%RH), a 1,000-sheet printing test was made at a printing rate of 8 sheets (A4-size)/minute in a monochromatic continuous mode (i.e., a mode in which the consumption of the toner was accelerated without a pause of the developing assembly) while successively supplying each of the developers (13) to (22) and the developers (23) to (25) for comparison. Next, after each developer was left for a week in an environment of high temperature and high humidity (H/H: 30° C., 80%RH), a 1,000-sheet image printing test was made in the same manner as the above. Then, evaluation on printed images thus obtained was made in respect of the items shown later.

The results of evaluation are shown in Tables 9 and 10.

TABLE 9

Printed-Image Evaluation Results

| | Developer | Image density | Change in image density | Fog | Blank areas |
|---|---|---|---|---|---|
| Example: | | | | | |
| 12 | (13) | A | A | A | B |
| 13 | (14) | A | A | A | B |

TABLE 9-continued

Printed-Image Evaluation Results

| | Developer | Image density | Change in image density | Fog | Blank areas |
|---|---|---|---|---|---|
| 14 | (15) | B | B | A | B |
| 15 | (16) | A | B | A | B |
| 16 | (17) | A | A | A | A |
| 17 | (18) | A | B | B | A |
| 18 | (19) | A | A | A | A |
| 19 | (20) | A | B | A | A |
| 20 | (21) | A | B | A | A |
| 21 | (22) | A | A | A | A |
| Comparative Example: | | | | | |
| 7 | (23) | D | D | D | D |
| 8 | (24) | D | D | D | D |
| 9 | (25) | C | D | C | D |

TABLE 10

Evaluation Results of Matching to Image Forming Apparatus

| | Developer | Developing sleeve | Photosensitive drum | Intermediate transfer member | Fixing assembly |
|---|---|---|---|---|---|
| Example: | | | | | |
| 12 | (13) | A | B | A | A |
| 13 | (14) | A | B | A | A |
| 14 | (15) | A | A | B | B |
| 15 | (16) | B | B | A | A |
| 16 | (17) | A | A | A | A |

TABLE 10-continued

| | Evaluation Results of Matching to Image Forming Apparatus | | | | |
|---|---|---|---|---|---|
| | Developer | Developing sleeve | Photosensitive drum | Intermediate transfer member | Fixing assembly |
| 17 | (18) | B | A | A | A |
| 18 | (19) | A | A | A | A |
| 19 | (20) | A | A | A | B |
| 20 | (21) | A | A | B | C |
| 21 | (22) | A | A | A | A |
| Comparative Example: | | | | | |
| 7 | (23) | D | C | D | D |
| 8 | (24) | D | D | D | C |
| 9 | (25) | D | D | D | D |

Examples 22 & Comparative Example 10

Evaluation was made in the same manner as in Example 1 except that the developing assembly of the image forming apparatus, shown in FIG. 3, was replaced with the one shown in FIG. 4, the movement speed of the toner carrying member surface was so set as to be 3.0 times the movement speed of the electrostatic latent image bearing member surface, and the printing test was made in a monochromatic intermittent mode (i.e., a mode in which the developing assembly was made to pause for 10 seconds every time the images were printed on one sheet and the deterioration of the toner was accelerated by preliminary operation of the developing assembly when again driven) while successively supplying each of the toner (13) produced in Example 11 and the toner (23) for comparison produced in Comparative Example 7.

The toner carrying member used here had a surface roughness Ra of 1.5, and the toner regulation blade used was the one comprising a phosphor bronze base plate to which urethane rubber was bonded and the side coming into contact with the toner carrying member of which was coated with nylon.

The results of evaluation are summarized in Tables 11 and 12.

TABLE 11

| | Printed-Image Evaluation Results | | | |
|---|---|---|---|---|
| | Toner | Image density | Change in image density | Fog |
| Example: | | | | |
| 22 | (13) | A | A | A |
| Comparative Example: | | | | |
| 10 | (23) | C | D | D |

TABLE 12

| | Evaluation Results of Matching to Image Forming Apparatus | | | | |
|---|---|---|---|---|---|
| | Toner | Developing sleeve | Photosensitive drum | Intermediate transfer member | Fixing assembly |
| Example: | | | | | |
| 22 | (13) | A | A | A | A |
| Comparative Example: | | | | | |
| 10 | (23) | D | D | D | D |

Example 23 & Comparative Example 11

In the present Example, a reuse mechanism was attached to a commercially available laser beam printer LBP-EX (manufactured by CANON INC.) to remodel the printer, which was again set up and used. More specifically, as shown in FIG. 5, a system was attached in which the transfer residual toner present on the surface of the photosensitive drum 40 was scraped off with the elastic blade 42 of the cleaner 41, coming into touch with the photosensitive drum, which was thereafter sent inside the cleaner by means of a cleaner roller, further passed through the cleaner screw 43, passed through the feed pipe 44 provided with a transport screw, and, through the hopper 45, returned to the developing assembly 46, where the collected toner was again used. As the primary charging roller 47, used was a rubber roller (diameter: 12 mm; contact pressure: 50 g/cm) in which conductive carbon was dispersed, and covered with a nylon resin. On the photosensitive drum (electrostatic latent image bearing member), a dark-area potential $V_D$ of −700 V and a light-area potential $V_L$ of −200 V were formed by laser exposure (600 dpi). As the toner carrying member, a developing sleeve 48 whose surface was coated with a resin having carbon black dispersed therein and had a surface roughness Ra of 1.1 was used, where its surface movement speed was so set as to be 1.1 times the movement speed of the photosensitive drum surface, and then the gap (S-D distance) between the photosensitive drum and the developing sleeve was set at 270 $\mu$m. As the toner regulation member, a blade made of urethane rubber was used in contact with the developing sleeve. As the development bias, a bias formed by superimposing an AC bias component on a DC bias component was used.

In the heat fixing assembly H, a fixing assembly shown in FIGS. 6 and 7 was used. The surface temperature of a temperature detector 31*d* of a heating element 31 was set at 170° C., the total pressure between the heating element 31 and a spongy pressure roller 33 having a foam of silicone rubber in its lower layer was set to be 8 kg, and the nip between the pressure roller and a fixing film 32 was set to be 6 mm. As the fixing film 32, a 60 $\mu$m thick heat-resistant polyimide film was used which had on its side coming into contact with the recording medium a low-resistance release layer formed of PTEF (of a high-molecular-weight type) having a conductive material dispersed therein.

Under the above conditions, after each developer was left for a week in an environment of normal temperature and normal humidity (N/N: 25° C., 60%RH) a 1,000-sheet printing test was made at a printing rate of 4 sheets (A4-size)/minute in an intermittent mode (i.e., a mode in which the developing assembly was made to pause for 10 seconds every time the images were printed on one sheet and the deterioration of the toner was accelerated by preliminary operation of the developing assembly when again driven) while successively supplying each of the toner (18) produced in Example 16 and the toner (24) for comparison produced in Comparative Example 8. Subsequently, after each developer was left for a week in an environment of high temperature and high humidity (H/H: 30° C., 80%RH), a 1,000-sheet image printing test was made in the same manner as the above. Then, evaluation on the printed images thus obtained was made in respect of the items shown later.

The matching of the above toners to the image forming apparatus simultaneously used was also evaluated.

The results of the above evaluation are summarized in Tables 13 and 14.

TABLE 13

Printed-Image Evaluation Results

| | Toner | Image density | Change in image density | Fog |
|---|---|---|---|---|
| Example: | | | | |
| 23 | (13) | A | A | A |
| Comparative Example: | | | | |
| 11 | (23) | C | D | D |

TABLE 14

Evaluation Results of Matching to Image Forming Apparatus

| | Toner | Developing sleeve | Photosensitive drum | Fixing assembly |
|---|---|---|---|---|
| Example: | | | | |
| 23 | (13) | A | A | A |
| Comparative Example: | | | | |
| 11 | (23) | D | D | D |

Example 24

A printing test was made in the same manner as in Example 23 except that the toner reuse mechanism of FIG. 5 was detached and images were printed in a continuous mode (i.e., a mode in which the consumption of the toner was accelerated without a pause of the developing assembly) while supplying the toner (17) produced in Example 16.

Evaluation on the printed images thus obtained was made in respect of the items shown later, and also the matching of the toner to the image forming apparatus used was evaluated. As the result, good results were obtained on all items.

The evaluation items stated in Examples and Comparative Examples and their evaluation criteria are as described below.

Printed-image Evaluation (1) Image Density:

Images were printed on 1,000 sheets of usual plain paper (75 g/m$^2$) for copying machines in the environment of normal temperature and normal humidity, and the image density of images printed on the 1,000th sheet was evaluated. The image density was measured with MACBETH REFLECTION DENSITOMETER (manufactured by Macbeth Co.), as relative density with respect to an image printed on a white ground area with a density of 0.00 of an original.

A: 1.40 or more.
B: From 1.35 to less than 1.40.
C: From 1.00 to less than 1.35.
D: less than 1.00.

(2) Change in Image Density:

Images were printed on 1,000 sheets of usual plain paper (75 g/m$^2$) for copying machines in the environment of normal temperature and normal humidity and then in the environment of high temperature and high humidity. The image density of images printed on the 1,000th sheet in each environment was measured, and any change in image density was calculated according to the following expression. The image density was measured with MACBETH REFLECTION DENSITOMETER (manufactured by Macbeth Co.), as relative density with respect to an image printed on a white ground area with a density of 0.00 of an original.

Change in image density=density at normal temperature and normal humidity−density on 5,000th sheet A: Less than 0.05.
B: From 0.05 to less than 0.10.
C: From 0.10 to less than 0.15.
D: Not less than 0.15.

(3) Image Fog:

Images were printed on 1,000 sheets of usual plain paper (75 g/m$^2$) for copying machines in the environment of normal temperature and normal humidity. Fog density (%) was calculated from a difference between the whiteness at a white background area of images printed on the 1,000th sheet and the whiteness of the recording medium to make evaluation on image fog, which was measured with REFLECTOMETER (manufactured by Tokyo Denshoku Co., Ltd.).

A: Less than 1.5%.
B: From 1.5% to less than 2.5%.
C: From 2.5% to less than 4.0%.
D: Not less than 4.0%.

(4) Blank Areas Caused by Poor Transfer:

In images printed in the environment of normal temperature and normal humidity, evaluation was visually made on characters with a pattern as shown in FIG. 10A, to examine any blank areas (the state shown in FIG. 10B) caused by poor transfer.

A: Little occur.
B: Slight blank areas are seen.
C: Blank areas are a little seen.
D: Conspicuous blank areas are seen.

Evaluation on Matching to Image Forming Apparatus (1) Matching to Developing Sleeve:

After the printing test was finished, evaluation was visually made by examining any sticking of the toner remaining on the developing sleeve surface.

A: No sticking occurs.
B: Almost no sticking occurs.
C: Sticking is a little seen.
D: Sticking is greatly seen.

(2) Matching to Photosensitive Drum:

After the printing test was finished, evaluation was visually made by examining any scratches on the photosensitive drum surface and any sticking of the toner remaining thereon.

A: None of them occurs.
B: Scratches are seen to slightly occur.
C: Sticking and scratches are seen.
D: Sticking is greatly seen.

(3) Matching to Intermediate Transfer Member:

After the printing test was finished, evaluation was visually made by examining any scratches on the intermediate transfer member surface and any sticking of the toner remaining thereon.

A: None of them occurs.
B: Residual toner is seen to present on the surface.
C: Sticking and scratches are seen.
D: Sticking is greatly seen.

(4) Matching to Fixing Assembly:

After the printing test was finished, evaluation was visually made by examining any scratches on the fixing film surface and any sticking of the toner remaining thereon.

A: None of them occurs.
B: Sticking is slightly seen.
C: Sticking and scratches are seen.
D: Sticking is greatly seen.

| Reference Example 25 | (by weight) |
|---|---|
| Resin (1) | 100 parts |
| 1,1-Bis(4-hydroxyphenyl)cyclohexane polycarbonate (peak molecular weight: 5,000; Mw: 6,000; Mn: 2,500) | 10 parts |
| Carbon black (colorant) | 5 parts |
| Negative charge control agent (compound of a monoazo dye with iron) | 2 parts |
| Low-molecular-weight polyethylene (DSC peak: 107° C.) | 5 parts |

The above materials were premixed, and the mixture obtained was melt-kneaded at 130° C. by means of a twin-screw extruder. The resulting melt-kneaded product was crushed using a hammer mill to obtain a 1 mm mesh-pass crushed toner product. This crushed toner product was further pulverized using an impact mill utilizing a jet stream, followed by air classification to obtain black powder, toner particles (27), with a weight-average particle diameter of 9.3 μm. To 100 parts by weight of the toner particles (27) thus obtained, 1.0 part by weight of hydrophobic silica whose parent silica particles having a specific surface area of 200 $m^2/g$ as measured by the BET method had been surface-treated with a silane coupling agent and silicone oil to have a specific surface area of 120 $m^2/g$ was externally added to obtain pulverization toner (27).

Physical properties of the toner particles and toner thus obtained are shown in Table 15.

With regard to the toner (27), in its molecular weight distribution as measured by GPC of THF-soluble matter, the component having molecular weight of 1,000 or less was separated and collected and this was analysed by $^1$H-NMR, $^{13}$C-NMR and IR. As a result, as shown in Table 15, the component having in its structure a repeating unit of the polycarbonate resin, contained in components having molecular weight of 1,000 or less, was contained in an amount of 1.0% by weight based on the weight of the toner.

1,1-Bis(4-hydroxyphenyl)cyclohexane polycarbonate used in the preparation of the toner (27) was purified by repeating reprecipitation with dichloromethan and isopropanol so as to reduce low-molecular-weight component and impurity.

TEM observation also made on the cross sections of toner particles of this toner revealed that islandwise dispersed polycarbonate resin and low-molecular-weight polyethylene (wax component), not dissolving in each other, were dispersed in the whole toner particles.

Example 26

The toner particles (27) obtained in Example 25 were added in an aqueous solution containing a surface-active agent, and then surface-treated at 85° C. for 2 hours with stirring at a high speed, followed by filtration, washing with water and drying to obtain black powder, toner particles (28), with a weight-average particle diameter of 9.6 μm. To 100 parts by weight of the toner particles (28) thus obtained, 1.0 part by weight of the same hydrophobic silica as the one used in Example 25 was externally added to obtain spherical toner (28).

Physical properties of the toner particles and toner thus obtained are shown in Table 15.

Comparative Example 12

Toner particles (29) and spherical toner (29) were obtained in the same manner as in Example 26 but not using the low-molecular-weight polyethylene.

Physical properties of the toner particles and toner thus obtained are shown in Table 15.

Comparative Example 13

Toner particles (30) and spherical toner (30) were obtained in the same manner as in Example 26 except that the polycarbonate resin 1,1-bis(4-hydroxyphenyl) cyclohexane polycarbonate was not used.

Physical properties of the toner particles and toner thus obtained are shown in Table 15.

Example 27

Toner particles (31) and spherical toner (31) were obtained in the same manner as in Example 26 except that the polycarbonate resin 1,1-bis(4-hydroxyphenyl) cyclohexane polycarbonate was used in an amount of 45 parts by weight.

Physical properties of the toner particles and toner thus obtained are shown in Table 15.

Example 29

Black classified powder was obtained in the same manner as in Example 25 except that the resin (1) was replaced with a styrene-butadiene copolymer (Mw: 163,000, Mn: 18,300, Mw/Mn: 8.9). The black classified powder thus obtained was added in an aqueous solution containing a surface-active agent, and then surface-treated at 90° C. for 2 hours with stirring at a high speed, followed by filtration, washing with water and drying to obtain toner particles (33) with a weight-average particle diameter of 10.5 μm. To 100 parts by weight of the toner particles (33) thus obtained, 1.0 part by weight of the same hydrophobic silica as the one used in Example 25 was externally added to obtain spherical toner (33).

Physical properties of the toner particles and toner thus obtained are shown in Table 15.

| Example 30 | (by weight) |
|---|---|
| Resin (1) | 100 parts |
| Carbon black (colorant) | 5 parts |
| Negative charge control agent (compound of a monoazo dye with iron) | 2 parts |
| Low-molecular-weight polyethylene (DSC peak: 107° C.) | 5 parts |

Using the above materials, black powder was obtained in the same manner as in Example 26. Then, 100 parts by weight of the black powder thus obtained and 10 parts by weight of finely powdery 1,1-bis(4-hydroxyphenyl) cyclohexane polycarbonate were dry-process mixed by means of a Henschel mixer, followed by surface modification using a hybridizer manufactured by Nara Kikai K.K. to obtain toner particles (34), which were used as spherical toner (34). 1,1-Bis(4-hydroxyphenyl)cyclohexane polycarbonate used in the preparation of the toner (34) was purified by repeating reprecipitation with dichloromethan and isopropanol so as to reduce low-molecular-weight component and impurity.

TEM observation made on the cross sections of toner particles of this toner revealed that layers considered to be formed of the polycarbonate resin were seen on the particle surfaces and islandwise dispersed matter considered to be the low-molecular-weight polyethylene (wax component), not dissolving in each other, was dispersed inside the toner particles.

Physical properties of the toner particles and toner thus obtained are shown in Table 15.

Example 31

Into 710 g of ion-exchanged water held in a 2-liter four-necked flask, 560 g of an aqueous 0.1M-$Na_3PO_4$ solution was introduced, and the mixture was heated to 60° C., followed by stirring at 12,000 rpm using a high-speed stirrer TK-type homomixer (manufactured by Tokushu Kika Kogyo Co., Ltd.). Then, 85 g of an aqueous 1.0M-$CaCl_2$ solution was added thereto little by little to obtain an aqueous dispersion medium containing a fine-particle, sparingly water-soluble dispersion stabilizer.

Meanwhile, as a disperse phase (dispersoid), the following was prepared.

| | (by weight) |
|---|---|
| Styrene | 80 parts |
| n-Butyl acrylate | 20 parts |
| Carbon black (colorant) | 5 parts |
| 1,1-Bis(4-hydroxyphenyl)cyclohexane polycarbonate (peak molecular weight: 5,000; Mw: 6,000; Mn: 2,600) | 5 parts |
| Carbon black | 5 parts |
| Negative charge control agent (compound of a monoazo dye with iron) | 2 parts |
| Ester wax (DSC peak: 70° C.) | 5 parts |

Of the above formulation, using only the colorant, the monoazo dye Fe compound and the styrene, a master batch of carbon black was produced by means of an attritor (manufactured by Mitsui Mining and Smelting Co., Ltd.). Next, this master batch and the remaining materials of the above formulation were heated to 60° C. to dissolve and disperse them to form a monomer mixture. To the monomer mixture, 10 g of a polymerization initiator 2,2'-azobis(2,4-dimethylvaleronitrile) was added and dissolved while maintaining the mixture at 60° C. Thus, a monomer composition was prepared.

The above monomer composition was introduced into the above aqueous medium prepared in the 2-liter flask in the homomixer, followed by stirring at 10,000 rpm for 20 minutes at 60° C. by means of a TK-type homomixer made to have an atmosphere of nitrogen, to carry out granulation of the monomer composition. Thereafter, the reaction was carried out at 60° C. for 6 hours while stirring the composition with paddle stirring blades, and thereafter the polymerization was carried out at 80° C. for 10 hours.

After the polymerization reaction was completed, the reaction product was cooled, and hydrochloric acid was added to dissolve away $Ca_3(PO_4)_2$, followed by filtration, washing with water and drying to obtain black suspension particles, toner particles (35), having a weight average particle diameter of about 7.1 $\mu$m.

To 100 parts by weight of the toner particles (35) thus obtained, 1.5 parts by weight of the same hydrophobic silica as the one used in toner synthetic Example 1 was externally added to obtain polymerization toner (35). 1,1-Bis(4-hydroxyphenyl)cyclohexane polycarbonate used in the preparation of the toner (35) was purified by repeating reprecipitation with dichloromethan and isopropanol so as to reduce low-molecular-weight component and impurity.

TEM observation made on the cross sections of toner particles of this toner revealed that layers formed of the polycarbonate resin were seen on the particle surfaces and spherical dispersed matter comprised of the low-molecular-weight polyethylene (wax component) was dispersed inside the toner particles.

Physical properties of the toner particles (35) and polymerization toner (35) thus obtained are shown in Table 15.

Example 32

Toner particles (36) and polymerization toner (36) were obtained in the same manner as in Example 30 except that the ester wax was used in an amount of 50 parts by weight.

Physical properties of the toner particles (36) and polymerization toner (36) thus obtained are shown in Table 15.

Comparative Example 14

Toner particles (37) and polymerization toner (37) were obtained in the same manner as in Example 30 except that the polycarbonate resin 1,1-bis(4-hydroxyphenyl) cyclohexane polycarbonate was not used.

Physical properties of the toner particles (37) and polymerization toner (37) thus obtained are shown in Table 15.

Example 33

Into 710 g of ion-exchanged water held in a 2-liter four-necked flask, 560 g of an aqueous 0.1M-$Na_3PO_4$ solution was introduced, and the mixture was heated to 60° C., followed by stirring at 12,000 rpm using a high-speed stirrer TK-type homomixer (manufactured by Tokushu Kika Kogyo Co., Ltd.). Then, 85 g of an aqueous 1.0M-$CaCl_2$ solution was added thereto little by little to obtain an aqueous dispersion medium containing a fine-particle, sparingly water-soluble dispersion stabilizer.

Meanwhile, as a disperse phase (dispersoid), the following was prepared.

| | (by weight) |
|---|---|
| Styrene | 80 parts |
| n-Butyl acrylate | 20 parts |
| Bisphenol A/biphenol/hexamethylene glycol copolymer polycarbonate (peak molecular weight: 30,000; Mw: 42,000; Mn: 16,000) | 5 parts |
| C. I. Pigment Blue 15:3 (colorant) | 5 parts |
| Charge control agent (Al compound of 2,5-di-tert-butylsalicylic acid) | 2 parts |
| Ester wax (DSC peak: 70° C.) | 5 parts |

Of the above formulation, only the colorant, the Al compound of 2,5-di-tert-butylsalicylic acid and the styrene were premixed by means of EBARA MILDER (manufactured by Ebara Seisakusho). Next, all the above materials were heated to 60° C. to dissolve and disperse them to form a monomer mixture. To the monomer mixture, 10 g of a polymerization initiator 2,2'-azobis(2,4-dimethylvaleronitrile) was further added and dissolved while maintaining the mixture at 60° C. Thus, a monomer composition was prepared.

The above monomer composition was introduced into the above aqueous medium prepared in the 2-liter flask in the homomixer, followed by stirring at 10,000 rpm for 20 minutes at 60° C. by means of a TK-type homomixer made to have an atmosphere of nitrogen, to carry out granulation of the monomer composition. Thereafter, the reaction was carried out at 60° C. for 6 hours while stirring the composition with paddle stirring blades, and thereafter the polymerization was carried out at 80° C. for 10 hours.

After the polymerization reaction was completed, the reaction product was cooled, and hydrochloric acid was added to dissolve away $Ca_3(PO_4)_2$, followed by filtration, washing with water and drying to obtain colored suspension particles, toner particles (38), having a weight average particle diameter of about 6.9 $\mu$m.

To 100 parts by weight of the toner particles (38) thus obtained, 1.5 parts by weight of the same hydrophobic silica as the one used in Example 25 was externally added to obtain polymerization toner (38). Bisphenol A/biphenol/hexamethylene glycol copolymer polycarbonate used in the preparation of the toner (38) was purified by repeating reprecipitation with dichloromethan and isopropanol so as to reduce low-molecular-weight component and impurity.

Physical properties of the toner particles (38) and polymerization toner (38) thus obtained are shown in Table 15.

Example 34

Into 710 g of ion-exchanged water held in a 2-liter four-necked flask, 520 g of an aqueous 0.1M-$Na_3PO_4$ solution was introduced, and the mixture was heated to 60° C., followed by stirring at 12,000 rpm using a high-speed stirrer TK-type homomixer (manufactured by Tokushu Kika Kogyo Co., Ltd.). Then, 85 g of an aqueous 1.0M-$CaCl_2$ solution was added thereto little by little to obtain an aqueous dispersion medium containing a fine-particle, sparingly water-soluble dispersion stabilizer.

Meanwhile, as a disperse phase (dispersoid), the following was prepared.

| | (by weight) |
|---|---|
| Styrene | 80 parts |
| n-Butyl acrylate | 20 parts |
| 1-Phenyl-1,1-bis(4-hydroxyphenyl)ethane polycarbonate (peak molecular weight: 20,000; Mw: 32,000; Mn: 10,000) | 5 parts |
| C. I. Pigment Red 202 (colorant) | 5 parts |
| Charge control agent (Al compound of 2,5-di-tert-butylsalicylic acid) | 2 parts |
| Ester wax (DSC peak: 70° C.) | 5 parts |

Of the above formulation, only the colorant, the Al compound of 2,5-di-tert-butylsalicylic acid and the styrene were premixed by means of EBARA MILDER (manufactured by Ebara Seisakusho). Next, all the above materials were heated to 60° C. to dissolve and disperse them to form a monomer mixture. To the monomer mixture, 10 g of a polymerization initiator 2,2'-azobis(2,4-dimethylvaleronitrile) was further added and dissolved while maintaining the mixture at 60° C. Thus, a monomer composition was prepared.

The above monomer composition was introduced into the above aqueous medium prepared in the 2-liter flask in the homomixer, followed by stirring at 10,000 rpm for 20 minutes at 60° C. by means of a TK-type homomixer made to have an atmosphere of nitrogen, to carry out granulation of the monomer composition. Thereafter, the reaction was carried out at 60° C. for 6 hours while stirring the composition with paddle stirring blades, and thereafter the polymerization was carried out at 80° C. for 10 hours.

After the polymerization reaction was completed, the reaction product was cooled, and hydrochloric acid was added to dissolve away $Ca_3(PO_4)_2$, followed by filtration, washing with water and drying to obtain colored suspension particles, toner particles (39), having a weight average particle diameter of about 7.1 $\mu$m.

To 100 parts by weight of the toner particles (39) thus obtained, 1.5 parts by weight of the same hydrophobic silica as the one used in Example 25 was externally added to obtain polymerization toner (39).

1-Phenyl-1,1-bis(4-hydroxyphenyl)ethane polycarbonate used in the preparation of the toner (39) was purified by repeating reprecipitation with dichloromethan and isopropanol so as to reduce low-molecular-weight component and impurity.

Physical properties of the toner particles (39) and polymerization toner (39) thus obtained are shown in Table 15.

Example 35

As a disperse phase (dispersoid), the following was prepared.

| | (by weight) |
|---|---|
| Styrene | 80 parts |
| n-Butyl acrylate | 20 parts |
| 2,2-Bis(3-methyl-4-hydroxyphenyl)propane polycarbonate (peak molecular weight: 8,000; Mw: 12,000; Mn: 4,000) | 5 parts |
| C.I. Pigment Yellow 17 (colorant) | 5 parts |
| Charge control agent (Al compound of 2,5-di-tert-butylsalicylic acid) | 2 parts |
| Ester wax (DSC peak: 70° C.) | 5 parts |

Under the above formulation, toner particles (40) were produced in the same manner as in Example 33, and the subsequent procedure was also repeated to obtain polymerization toner (40) having a weight average particle diameter of about 7.0 $\mu$m.

2,2-Bis(3-methyl-4-hydroxyphenyl)propane polycarbonate used in the preparation of the toner (40) was purified by repeating reprecipitation with dichloromethan and isopropanol so as to reduce low-molecular-weight component and impurity.

Physical properties of the toner particles (40) and polymerization toner (40) thus obtained are shown in Table 15.

| Comparative Example 15 | (by weight) |
|---|---|
| Resin (1) | 50 parts |
| 1,1-Bis(4-hydroxyphenyl)cyclohexane polycarbonate (peak molecular weight: 3,000; Mw: 3,500; Mn: 1,000) | 50 parts |

-continued

| Comparative Example 15 | (by weight) |
|---|---|
| Carbon black (colorant) | 5 parts |
| Negative charge control agent (compound of a monoazo dye with iron) | 2 parts |
| Low molecular-weight polyethylene (DSC peak: 107° C.) | 5 parts |

The above materials were premixed, and the mixture obtained was melt-kneaded at 130° C. by means of a twin-screw extruder. The resulting melt-kneaded product was crushed using a hammer mill to obtain a 1 mm mesh-pass crushed toner product. This crushed toner product was further pulverized using an impact mill utilizing a jet stream, followed by air classification to obtain black powder, comparative toner particles (41), with a weight-average particle diameter of 9.3 μm. To 100 parts by weight of the comparative toner particles (41) thus obtained, 1.0 part by weight of hydrophobic silica whose parent silica particles having a specific surface area of 200 $m^2/g$ as measured by the BET method had been surface-treated with a silane coupling agent and silicone oil to have a specific surface area of 120 $m^2/g$ was externally added to obtain comparative pulverization toner (41).

Physical properties of the comparative toner particles and comparative toner thus obtained are shown in Table 15.

1,1-Bis(4-hydroxyphenyl)cyclohexane polycarbonate used in the preparation of the comparative toner (41) was not purified by reprecipitation.

Evaluation Method

As an electrophotographic apparatus, a 600 dpi laser beam printer (LBP-860, manufactured by CANON INC.) was used. This was remodeled to have a process speed of 60 mm/s. A cleaning rubber blade was detached from a process cartridge of this apparatus to change the charging system of this apparatus to direct charging carried out by bringing a rubber roller into contact. A voltage of a DC component (−1,200 V) was applied.

Next, the developing part of the process cartridge was altered. In place of 1 stainless steel sleeve which was a toner feeding member, a medium-resistance rubber roller (diameter: 16 mm; hardness: ASKER C 45 degrees; resistance: $10^5$ Ω·cm)comprised of silicone rubber having carbon black dispersed therein was used as the toner carrying member, and was brought into contact with the photosensitive member. Here, the development nip width was so set as to be about 3 mm. The toner carrying member was so driven as to be rotated in the same direction as the photosensitive member at the former's part coming into contact with the latter and at a peripheral speed of 150% with respect to the rotational peripheral speed of the photosensitive member.

As a photosensitive member used here, an aluminum cylinder of 30 mm diameter and 254 mm long was used as a substrate, and layers constituted as shown below were successively formed thereon in layers by dip coating to produced the photosensitive member.

(1) Conductive coating layer: Mainly composed of powders of tin oxide and titanium oxide dispersed in phenol resin. Layer thickness: 15 μm.

(2) Subbing layer: Mainly composed of a modified nylon and a copolymer nylon. Layer thickness: 0.6 μm.

(3) Charge generation layer: Mainly composed of a titanyl phthalocyanine pigment having absorption in long wavelength range, dispersed in butyral resin. Layer thickness: 0.6 μm.

(4) Charge transport layer: Mainly composed of a hole-transporting triphenylamine compound dissolved in a polycarbonate resin (molecular weight: 20,000 as measured by Ostwald viscometry) in weight ratio of 8:10. Layer thickness: 20 μm.

As a means for coating the toner on the toner carrying member, a coating roller comprised of foamed urethane rubber was provided in the developing assembly and was brought into contact with the toner carrying member. A voltage of about −550 V was applied to the coating roller. Also, for the purpose of coat layer control of the toner on the toner carrying member, a resin-coated blade made of stainless steel was so attached as to come into contact with the toner carrying member at a linear pressure of about 20 g/cm. (This is schematically shown in FIG. 8). The voltage applied at the time of development was only a DC component (−450 V).

To make adaptation to the process cartridge as altered as described above, the electrophotographic apparatus was remodeled and its process conditioned were set as described below.

The remodeled apparatus has a process comprising uniformly charging the image bearing member by means of a roller charging assembly (only a DC current is applied), subsequently to the charging, exposing image areas to laser light to form an electrostatic latent image, forming the latent image into a visible image (toner image) by the use of the toner, and thereafter transferring the toner image to a recording medium by the aid of a roller to which a voltage is applied. This is schematically shown in FIG. 8.

The photosensitive member was set to have a dark-area potential of −600 V and a light-area potential of −150 V. Paper of 75 $g/m^2$ in basis weight was used as transfer mediums.

Using the above image forming apparatus, a running test was made in an environment of 10° C. temperature and 10% relative humidity by the use of the pulverization toners (27) and (41), spherical toners (28) to (34) and polymerization toners (35) to (40).

To evaluate running performance, character images were printed at a print area percentage of 3% to make evaluation on the following points.

Charging roller contamination by toner was judged by the ordinal number of sheet on which faulty charging due to charging member contamination occurred on halftone images.

Melt-adhesion of toner to photosensitive member and melt-adhesion to developing sleeve were examined on the presence or absence of melt-adhesion by observing the photosensitive member surface and developing sleeve surface at the stage where white spots appeared on solid black images. When no melt-adhesion was seen to occur, the evaluation of running performance was continued.

When none of the charging roller contamination, melt-adhesion to photosensitive member and melt-adhesion to developing sleeve occurred, the printing of images was continued up to 1,500 sheets. It means that, the greater the ordinal number of sheet on which they occurred was, the better running performance the toner had.

To evaluate transfer performance at the initial stage of running, the toner remaining on the photosensitive member after transfer at the time of development of solid black images was taken off by taping with Mylar tape, and the tape with toner was stuck on white paper. From the Macbeth density measured thereon, the Macbeth density measured on tape alone (without toner) stuck on white paper was subtracted to obtain numerical values, according to which evaluation was made. Thus, the smaller the value is, the better the transfer performance is.

Resolution at the initial stage of running was evaluated by examining the reproducibility of small-diameter isolated individual dots at 600 dpi, which tend to form closed electric fields on account of latent-image electric fields and are difficult to reproduce.

A (Very good): Missing dots are 5 or less per 100 dots.

B (Good): Missing dots are 6 to 10 per 100 dots.

C (Average): Missing dots are 11 to 20 per 100 dots.

D (Not good): Missing dots are 20 or more per 100 dots.

To evaluate anti-offset properties, any stains occurring on the back of image samples at the stages of from initial to 100-sheet running were observed to count the number of sheets stained.

Fog was measured by measuring it with REFLECTOMETER MODEL TC-6DS, manufactured by Tokyo Denshoku Co., Ltd. As filters, an amber light filter was used for the polymerization toner (38), a blue filter for the polymerization toner (40), and green filters for the other toners. The fog was calculated according to the following expression. The smaller the value is, the less the fog is.

Fog (reflectance) (%)=[reflectance (%) of standard paper]−[reflectance (%) of non-image area of sample]

Results obtained are shown in Table 16.

Examples 36 & Comparative Example 17

Under test conditions as shown below, running performance was evaluated on full-color images.

FIG. 1 schematically illustrates a cross section of an image forming apparatus used in the present Example 36 and Comparative Example 17. FIG. 9 illustrates a developing system of the image forming apparatus.

The photosensitive drum 1 comprises a substrate 1*a* and provided thereon a photosensitive layer 1*b* having an organic photo-semiconductor, and is rotated in the direction of an arrow. By means of the charging roller 2 (the conductive elastic layer 2*a* and the mandrel 2*b*) facing the photosensitive drum and rotating in contact with it, the surface of the photosensitive drum 1 is electrostatically charged to have a surface potential of about −600 V. Exposure is carried out using a polygon mirror by on-off control on the photosensitive drum 1 in accordance with digital image information, whereby an electrostatic latent image with an exposed-area potential of −100 V and a dark-area potential of −600 V is formed. The polymerization toners (38), (39) and (40) and the polymerization toner (35) (Example 36) or (37) (Comparative Example 17) are put into developing assemblies 4-1, 4-2, 4-3 and 4-4, respectively. An electrostatic latent image formed on the photosensitive member is reverse-developed by a non-magnetic one-component development system, so that toner images of respective color are formed on the photosensitive member 1. The toner images are successively transferred to the intermediate transfer member 5, and are finally transferred at one time to the recording medium 6. Here, the toner not transferred to and remaining on the photosensitive member 1 is removed by cleaning with a cleaner member 8, and the toner remaining on the intermediate transfer member 5 is removed by cleaning with a cleaner member 9.

The intermediate transfer member 5 is comprised of the pipe-like mandrel 5*b* and the elastic layer 5*a* provided thereon by coating, formed of nitrile-butadiene rubber (NBR) in which carbon black conductivity-providing agent has been well dispersed. The coat layer 5*a* thus formed has a hardness according to JIS K-6301, of 20 degrees and a volume resistivity of $10^9$ Ω·cm. Transfer electric current necessary for the transfer from the photosensitive drum 1 to the intermediate transfer member 5 is about 5 μA, which can be obtained by applying a voltage of +1,000 V to the mandrel 5*b* from a power source.

The transfer roller 7 has an external diameter of 20 mm. The transfer roller 7 has an elastic layer 7*a* formed by coating on a mandrel 7*b* of 10 mm diameter, a foamable material of an ethylene-propylene-diene terpolymer (EPDM) in which carbon conductivity-providing agent has been well dispersed. As the elastic layer 7*a*, the one showing a volume resistivity of $10^6$ Ω·cm and a hardness according to JIS K-6301, of 35 degrees was used. A voltage was applied to the transfer roller to flow a transfer current of 15 μA.

In the heat fixing assembly H, a fixing assembly of a hot-roll type having no function of oil application was used.

Under the above conditions, a running test was continuously made on 1,500 sheets at maximum in an environment of 30° C. temperature and 80% relative humidity by printing images with a image area percentage of 10%, at a paper feed rate of 8 sheets (A4-size)/minute to make evaluation.

Evaluation on the melt-adhesion of toner to photosensitive member and melt-adhesion to developing sleeve was made in the same manner as in Examples 25 to 35. Melt-adhesion of toner to intermediate transfer member was examined on the presence or absence of melt-adhesion by observing the intermediate transfer member surface at the stage where white spots appeared on solid black images. When no melt-adhesion was seen to occur, the evaluation of running performance was continued.

When none of the charging roller contamination, melt-adhesion to photosensitive member and melt-adhesion to developing sleeve occurred, the printing of images was continued up to 1,500 sheets. It means that, the greater the ordinal number of sheet on which they occurred was, the better running performance the toner had.

Results of the above evaluation are summarized in Table 17.

TABLE 15

| | Toner | Wax | Polycarbonate content (pbw) | Content*1 of 1,000 or less molecular weigt component (pbw) | SF-1 | SF-2 | SF-2/SF-1 | Toner average particle diam. (μm) | TEM observation of polycarboate resin |
|---|---|---|---|---|---|---|---|---|---|
| Example: | | | | | | | | | |
| 25 | Pul.toner (27) | L-Mw PE (5 pbw) | 10 | 1.0 | 165 | 176 | 1.07 | 9.3 | Wholly dispersed |
| 26 | Sph.toner (28) | L-Mw PE (5 pbw) | 10 | 1.0 | 147 | 136 | 0.92 | 9.6 | Wholly dispersed |

TABLE 15-continued

| | Toner | Wax | Polycarbonate content (pbw) | Content*1 of 1,000 or less molecular weigt component (pbw) | SF-1 | SF-2 | SF-2/SF-1 | Toner average particle diam. (μm) | TEM observation of polycarboate resin |
|---|---|---|---|---|---|---|---|---|---|
| Comparative Example: | | | | | | | | | |
| 12 | Sph.toner (29) | — | 10 | 1.0 | 154 | 130 | 0.84 | 9.7 | Wholly dispersed |
| 13 | Sph.toner (30) | L-Mw PE (5 pbw) | — | — | 146 | 128 | 0.88 | 9.4 | None |
| Example: | | | | | | | | | |
| 27 | Sph.toner (31) | L-Mw PE (5 pbw) | 45 | 4.5 | 141 | 133 | 0.94 | 9.9 | Wholly dispersed |
| 29 | Sph.toner (33) | L-Mw PE (5 pbw) | 10 | 1.0 | 158 | 140 | 0.89 | 10.5 | Wholly dispersed |
| 30 | Sph.toner (34) | L-Mw PE (5 pbw) | 10 | 1.0 | 138 | 130 | 0.94 | 9.8 | Discontinuously present*2 |
| 31 | Pol.toner (35) | Est.wax (10 pbw) | 5 | 0.5 | 110 | 109 | 0.99 | 7.1 | Continuously present*2 |
| 32 | Pol.toner (36) | Est.wax (50 pbw) | 5 | 0.5 | 121 | 120 | 0.99 | 7.2 | Continuously present*2 |
| Comparative Example: | | | | | | | | | |
| 14 | Pol.toner (37) | Est.wax (10 pbw) | — | — | 126 | 121 | 0.96 | 7.2 | None |
| Example: | | | | | | | | | |
| 33 | Pol.toner (38) | Est.wax (10 pbw) | 5 | 0.4 | 118 | 116 | 0.98 | 6.9 | Continuously present*2 |
| 34 | Pol.toner (39) | Est.wax (10 pbw) | 5 | 0.4 | 117 | 115 | 0.98 | 7.1 | Continuously present*2 |
| 35 | Pol.toner (40) | Est.wax (10 pbw) | 5 | 0.5 | 109 | 108 | 0.99 | 7.0 | Continuously present*2 |
| Comparative Example | | | | | | | | | |
| 15 | Pol.toner (41) | L-Mw PE (5 pbw) | 50 | 18 | 166 | 176 | 1.07 | 9.4 | Wholly dispersed |

*1In molecular weight distribution as mesured by GPC of THF-soluble matter of the toner, the component having in its structure a repeating unit of the polycarbonate resin, contained in components having molecular weight of 1,000 or less.
*2on the surface
Pul.toner: Pulverization toner;
Sph.toner: Spherical toner;
Pol.toner: Polymerization toner
L-Mw PE: Low-molecular-weight polyethylene;
Est.wax: Ester wax

TABLE 16

| | Toner | Macbeth initial image density | Initial fog | Uneven charging occurred on: (sheet) | Melt-adhestion to: Photo-sensitive member occurred on: (sheet) | Developing sleeve occurred on: (sheet) | Back staining due to offset (sheets) | Initial transfer perform-ance | Initial resolution |
|---|---|---|---|---|---|---|---|---|---|
| Example: | | | | | | | | | |
| 25 | Pul.toner (27) | 1.42 | 1.9 | 1,100th (slight) | 1,200th (slight) | 1,100th (slight) | 3 in 100 | 0.14 | C |
| 26 | Sph.toner (28) | 1.45 | 1.5 | 1,300th (slight) | 1,400th (slight) | 1,400th (slight) | 3 in 100 | 0.10 | B |
| Comparative Example: | | | | | | | | | |
| 13 | Sph.toner (29) | 1.48 | 1.0 | [1] | [1] | [1] | 19 in 100 | 0.09 | B |
| 14 | Sph.toner (30) | 1.35 | 1.6 | [2] | 300th | 400th | 11 in 100 | 0.10 | C |

TABLE 16-continued

| | Toner | Macbeth initial image density | Initial fog | Uneven charging occurred on: (sheet) | Melt-adhestion to: Photo-sensitive member occurred on: (sheet) | Developing sleeve occurred on: (sheet) | Back staining due to offset (sheets) | Initial transfer perform-ance | Initial resolution |
|---|---|---|---|---|---|---|---|---|---|
| Example: | | | | | | | | | |
| 27 | Sph.toner (31) | 1.40 | 1.3 | 1,300th (slight) | None | None | 6 in 100 | 0.12 | B |
| 29 | Sph.toner (33) | 1.40 | 1.9 | 1,300th (slight) | 1,300th (slight) | 1,300th (slight) | 4 in 100 | 0.11 | C |
| 30 | Sph.toner (34) | 1.49 | 1.0 | 1,300th (slight) | None | None | 1 in 100 | 0.09 | B |
| 31 | Pol.toner (35) | 1.54 | 0.6 | None | None | None | None | 0.02 | A |
| 32 | Pol.toner (36) | 1.56 | 1.0 | 1,400th (slight) | 1,400th (slight) | 1,400th (slight) | None | 0.08 | B |
| Comparative Example: | | | | | | | | | |
| 15 | Pol.toner (37) | 1.38 | 0.8 | [2] | 600th | 800th | 7 in 100 | 0.04 | A |
| Example: | | | | | | | | | |
| 33 | Pol.toner (38) | 1.52 | 0.5 | None | None | None | None | 0.04 | A |
| 34 | Pol.toner (39) | 1.53 | 0.6 | None | None | None | None | 0.04 | A |
| 35 | Pol.toner (40) | 1.55 | 0.4 | None | None | None | None | 0.02 | A |
| Comparative Example: | | | | | | | | | |
| 16 | Pol.toner (41) | 1.25 | 2.1 | 200th | 200th | 300th | 2 in 100 | 0.18 | C |

Pol.toner: Polymerization toner;
Sph.toner: Spherical toner;
Pol.toner: Polymerization toner
[1]Offset occurred too seriously to continue the running test.
[2]Melt-adhesion occurred too seriously to continue the running test.

TABLE 17

| Development position (see FIG. 2) | Toner | Melt-adhesion to: Photosensitive member occurred on: | Developing sleeve occurred on: | Intermediate transfer member occurred on: |
|---|---|---|---|---|
| Example 36: | | | | |
| 4-1 | Polymerization toner (38) | None | None | None |
| 4-2 | Polymerization toner (39) | " | " | " |
| 4-3 | Polymerization toner (40) | " | " | " |
| 4-4 | Polymerization toner (35) | " | " | " |
| Comparative Example 17: | | | | |
| 4-1 | Polymerization toner (38) | 600th sheet | 800th sheet | 700th sheet |
| 4-2 | Polymerization toner (39) | " | " | " |
| 4-3 | Polymerization toner (40) | " | " | " |
| 4-4 | Polymerization toner (37) | " | " | " |

What is claimed is:

1. A toner comprising (i) toner particles having a binder resin, a colorant and a wax, and (ii) inorganic fine powder selected from the group consisting of fine silica powder, fine titanium powder and fine alumina powder wherein;

said binder resin has a polycarbonate resin in an amount of from 0.1% by weight to 50.0% by weight and a resin other than the polycarbonate resin in an amount of from 50.0% by weight to 99.9% by weight, based on the weight of the binder resin, wherein said polycarbonate resin is continuously present on the surfaces of said toner particles;

in molecular weight distribution as measured by gel permeation chromatography of tetrahydrofuran-soluble matter, said toner contains 5.0% by weight or less based on the weight of the toner particles of a component having in its structure a repeating unit of the polycarbonate resin, contained in components having molecular weight of 1,000 or less;

the polycarbonate resin has a peak molecular weight in the region of molecular weight from 1,000 to 500,000 and a number-average molecular weight (Mn) of 1,600 to 16,000; and said toner particles have a shape factor SF-1 of from 100 to 160 and a shape factor SF-2 of from 100 to 140 as measured by an image analyzer.

2. The toner according to claim 1, wherein, in molecular weight distribution as measured by gel permeation chromatography of tetrahydrofuran-soluble matter, said polycarbonate resin has a peak molecular weight in the region of molecular weight of from 2,000 to 100,000.

3. The toner according to claim 1, wherein said resin other than the polycarbonate resin comprises at least one resin selected from the group consisting of a styrene-acrylic resin, a polyester resin and an epoxy resin.

4. The toner according to claim 1, wherein the toner particles have a shape factor SF-1 of from 100 to 140 and a shape factor SF-2 of from 100 to 120 as measured by an image analyzer.

5. The toner according to claim 1, wherein the toner particles have a ratio of shape factor SF-1 to shape factor SF-2, (SF-2)/(SF-1), of 1.0 or less.

6. The toner according to claim 1, wherein the toner particles have a weight-average particle diameter of from 2 μm to 10 μm.

7. The toner according to claim 1, wherein the toner particles have a weight-average particle diameter of from 4 μm to 8 μm.

8. The toner according to claim 1, which has a coefficient of variation (A) of 35% or less in the number distribution of the toner particles as calculated according to the following expression:

$$\text{Coefficient of variation } A=[S/D_1]\times 100$$

wherein S represents a value of standard deviation in the number distribution of toner particles, and $D_1$ represents number-average particle diameter (μm) of the toner particles.

9. The toner according to claim 1, which contains said wax in an amount of from 0.1% by weight to 50% by weight based on the weight of the toner particles.

10. The toner according to claim 1, which contains said wax in an amount of from 0.5% by weight to 30% by weight based on the weight of the toner particles.

11. The toner according to claim 1, wherein said wax has a maximum endothermic peak within the temperature range of from 40° C. to 130° C. at the time of temperature rise, in the DSC curve as measured with a differential scanning calorimeter.

12. The toner according to claim 1, wherein said wax has a maximum endothermic peak within the temperature range of from 50° C. to 100° C. at the time of temperature rise, in the DSC curve as measured with a differential scanning calorimeter.

13. The toner according to claim 1, wherein said wax is dispersed in the toner particles.

14. The toner according to claim 1, which comprises polymerization toner particles produced by polymerizing in an aqueous medium a polymerizable monomer composition containing at least a polymerization monomer, the colorant, the wax and the polycarbonate resin.

15. An image forming method comprising:

(I) a charging step of externally applying a voltage to a charging member to electrostatically charge an electrostatic latent image bearing member;

(II) a latent-image forming step of forming an electrostatic latent image on the electrostatic latent image bearing member thus charged;

(III) a developing step of developing the electrostatic latent image formed on the electrostatic latent image bearing member, by the use of a toner to form a toner image;

(IV) a transfer step of transferring the toner image formed on the electrostatic latent image bearing member to a recording medium via, or not via, an intermediate transfer member; and (V) a fixing step of heat-fixing to the recording medium the toner image transferred to the recording medium;

said toner comprising (i) toner particles having a binder resin, a colorant and a wax, and (ii) inorganic fine powder selected from the group consisting of fine silica powder, fine titanium powder and fine alumina powder wherein;

said binder resin has a polycarbonate resin in an amount of from 0.1% by weight to 50.0% by weight and a resin other than the polycarbonate resin in an amount of from 50.0% by weight to 99.9% by weight, based on the weight of the binder resin, wherein said polycarbonate resin is continuously present on the surfaces of said toner particles;

in molecular weight distribution as measured by gel permeation chromatography of tetrahydrofuran-soluble matter, said toner contains 5.0% by weight based or less on the weight of the toner particles of a component having in its structure a repeating unit of the polycarbonate resin, contained in components having molecular weight of 1,000 or less; the polycarbonate resin has a peak molecular weight in the region of molecular weight from 1,000 to 500,000 and a number-average molecular weight (Mn) of 1,600 to 16,000; and said toner particles have a shape factor SF-1 of from 100 to 160 and a shape factor SF-2 of from 100 to 140 as measured by an image analyzer.

16. The image forming method according to claim 15, wherein, in molecular weight distribution as measured by gel permeation chromatography of tetrahydrofuran-soluble matter, said polycarbonate resin has a peak molecular weight in the region of molecular weight of from 2,000 to 100,000.

17. The image forming method according to claim 15, wherein said resin other than the polycarbonate resin comprises at least one resin selected from the group consisting of a styrene-acrylic resin, a polyester resin and an epoxy resin.

18. The image forming method according to claim 15, wherein the toner particles have a shape factor SF-1 of from 100 to 140 and a shape factor SF-2 of from 100 to 120 as measured by an image analyzer.

19. The image forming method according to claim 15, wherein the toner particles have a ratio of shape factor SF-1 to shape factor SF-2, (SF-2)/(SF-1), of 1.0 or less.

20. The image forming method according to claim 15, wherein the toner particles have a weight-average particle diameter of from 2 μm to 10 μm.

21. The image forming method according to claim 15, wherein the toner particles have a weight-average particle diameter of from 4 μm to 8 μm.

22. The image forming method according to claim 15, wherein said toner has a coefficient of variation (A) of 35% or less in the number distribution of the toner particles as calculated according to the following expression:

$$\text{Coefficient of variation } A=[S/D_1]\times 100$$

wherein S represents a value of standard deviation in the number distribution of toner particles, and $D_1$ represents number-average particle diameter (μm) of the toner particles.

23. The image forming method according to claim 15, wherein said toner contains said wax in an amount of from 0.1% by weight to 50% by weight based on the weight average of the toner particles.

24. The image forming method according to claim 15, wherein said toner contains said wax in an amount of from 0.5% by weight to 30% by weight based on the weight of the toner particles.

25. The image forming method according to claim 15, wherein said wax has a maximum endothermic peak within the temperature range of from 40° C. to 130° C. at the time of temperature rise, in the DSC curve as measured with a differential scanning calorimeter.

26. The image forming method according to claim 15, wherein said wax has a maximum endothermic peak within the temperature range of from 50° C. to 100° C. at the time of temperature rise, in the DSC curve as measured with a differential scanning calorimeter.

27. The image forming method according to claim 15, wherein said wax is dispersed in the toner particles.

28. The image forming method according to claim 15, wherein said toner comprises polymerization toner particles produced by polymerizing in an aqueous medium a polymerizable monomer composition containing at least a polymerization monomer, the colorant, the wax and the polycarbonate resin.

29. The image forming method according to claim 15, wherein, in said developing step, said toner participates in the development while being carried on the surface of a toner carrying member;

said toner carrying member being set to have a surface movement speed from 1.05 to 3.0 times the surface movement speed of the electrostatic latent image bearing member; and said toner carrying member having a surface roughness Ra of 1.5 $\mu$m or smaller.

30. The image forming method according to claim 15, wherein, in said developing step, said toner participates in the development while being carried on the surface of a toner carrying member;

said toner carrying member having a non-magnetic sleeve and a magnet provided inside the non-magnetic sleeve; and a ferromagnetic metal blade being provided, leaving a space between the blade and the surface of the non-magnetic sleeve, to form a toner layer on said toner carrying member.

31. The image forming method according to claim 15, wherein, in said developing step:

said toner participates in the development while being carried on the surface of a toner carrying member; and an elastic blade is brought into touch with the surface of said toner carrying member to form a toner layer on the toner carrying member.

32. The image forming method according to claim 15, wherein, in said developing step, said toner participates in the development while being carried on the surface of a toner carrying member;

said toner carrying member being so provided as to have a gap between its surface and the surface of the electrostatic latent image bearing member, and a development bias having an alternating bias is applied to said toner carrying member at the time of development.

33. The image forming method according to claim 15, wherein, in said charging step, a charging member to which a voltage is externally applied is brought into contact with the surface of the electrostatic latent image bearing member to electrostatically charge the electrostatic latent image bearing member.

34. The image forming method according to claim 15, wherein, in said fixing step, the toner image is fixed to the recording medium by means of a heat fixing assembly in which any offset-preventive agent is not fed to its fixing member.

35. The image forming method according to claim 15, wherein, in said fixing step, the toner image is fixed to the recording medium by means of a heat fixing assembly not having any cleaning member coming into contact with the surface of a fixing member to clean the surface of the fixing member.

36. The image forming method according to claim 15, wherein, in said fixing step, the toner image is fixed to the recording medium by means of a heat fixing assembly which applies heat and pressure in the state the toner image having been transferred to the surface of the recording medium is brought into contact with a film.

37. The image forming method according to claim 15, wherein, in said developing step;

the electrostatic latent image is developed by a developing means which holds said toner; and an image is formed by a toner reuse system in which the toner remaining on the surface of the electrostatic latent image bearing member after transfer is collected to clean the surface, the toner collected is fed to the developing means and the collected toner is made to be held in the developing means so as to be again used to develop an electrostatic latent image.

38. The image forming method according to claim 15, wherein, in said transfer step, the toner image formed on the electrostatic latent image bearing member is transferred from the electrostatic latent image bearing member to the recording medium not via the intermediate transfer member.

39. The image forming method according to claim 38, wherein, in said transfer step, the toner image is transferred by bringing a transfer member to which a voltage is externally applied, into contact with the surface of the electrostatic latent image bearing member through the recording medium.

40. The image forming method according to claim 15, wherein, in said transfer step, the toner image formed on the electrostatic latent image bearing member is primarily transferred to the intermediate transfer member, and the toner image primarily transferred to the intermediate transfer member is secondarily transferred to the recording medium.

41. The image forming method according to claim 40, wherein, in said transfer step, the toner image is secondarily transferred to the recording medium by bringing a transfer member to which a voltage is externally applied, into contact with the surface of the intermediate transfer member through the recording medium.

42. The image forming method according to claim 15, wherein, in said developing step, a toner layer formed of said toner is formed on the surface of a toner carrying member, and the electrostatic latent image is developed in the state at least the toner layer on the toner carrying member comes into contact with the surface of the electrostatic latent image bearing member at the time of development.

43. The image forming method according to claim 15, wherein, in said developing step;

a toner layer formed of said toner is formed on the surface of a toner carrying member, and the electrostatic latent image is developed in the state at least the toner layer on the toner carrying member comes into contact with the surface of the electrostatic latent image bearing member at the time of development; and an image is formed by a cleaning-at-development system in which the toner remaining on the surface of the electrostatic latent image bearing member after transfer is collected to the surface of the toner carrying member to clean the former's surface, and the toner collected is made to be carried on the toner carrying member so as to be again used to develop an electrostatic latent image.

44. The image forming method according to claim 43, wherein a developing part in the developing step, a transfer part in the transfer step and a charging part in the charging step are disposed in the named order in the moving direction of said electrostatic latent image bearing member, and no cleaning member coming into contact with the surface of said electrostatic latent image bearing member to remove the toner remaining on the surface after transfer is present between said transfer part and charging part and between said charging part and developing part.

* * * * *

UNITED STATES PATENT AND TRADEMARK OFFICE

CERTIFICATE OF CORRECTION

PATENT NO. : 6,610,454 B2 
DATED : August 26, 2003
INVENTOR(S) : Akira Hashimoto et al.

It is certified that error appears in the above-identified patent and that said Letters Patent is hereby corrected as shown below:

Column 11,
Line 63, "1," should read -- 1,1 --.

Column 19,
Line 31, "to" should read -- from --.

Column 21,
Line 2, "an" (first occurrence) should be deleted; and
Line 64, "whe" should read -- when --.

Column 24,
Line 17, "toner particles (13), (15) and (17)" should read -- toner particles (1), (3) and (15) --;
Line 18, "Examples 12, 14 and 16:" should read -- Examples 1, 3 and 5 --;
Line 20, "particles (13)," should read -- particles (1), --;
Line 22, "particles (15)," should read -- particles (13), --; and
Line 24, "particles (17)," should read -- particles (15), --.

Column 25,
Line 45, "acton" should read -- action --.

Column 29,
Line 56, "shortm," should read -- short --.

Column 31,
Line 13, "of" (first occurrence) should be deleted.

Column 40,
Line 24, "weight" should read -- weight of --.

Column 44,
Line 33, "- (8)" should read -- to (8) --.

Column 45,
Line 3, "of $_{10}{}^{9}$" should read -- of $10^9$ --.

Column 55,
Table 8, "*1" should read -- *1: --; "*2" should read -- *2: --; and "*3" should read -- *3: --.

UNITED STATES PATENT AND TRADEMARK OFFICE

CERTIFICATE OF CORRECTION

PATENT NO. : 6,610,454 B2 
DATED : August 26, 2003
INVENTOR(S) : Akira Hashimoto et al.

It is certified that error appears in the above-identified patent and that said Letters Patent is hereby corrected as shown below:

Column 59,
Table 13, "C" should read -- D --.

Column 67,
Line 8, "Low molecular-weight" should read -- Low-molecular-weight --.

Column 73,
Table 16, "Pol.toner: Polymerization toner;" should read -- Pul.toner: Pulverization toner; --; and
Line 59, "wherein;" should read -- wherein: --.

Column 78,
Lines 18 and 59, "step;" should read -- step: --.

Signed and Sealed this

Twenty-fourth Day of February, 2004

JON W. DUDAS
*Director of the United States Patent and Trademark Office*